US008783361B2

(12) United States Patent
Zediker et al.

(10) Patent No.: US 8,783,361 B2
(45) Date of Patent: Jul. 22, 2014

(54) LASER ASSISTED BLOWOUT PREVENTER AND METHODS OF USE

(75) Inventors: Mark S. Zediker, Castle Rock, CO (US); Henry A. Bergeron, Houston, TX (US); Philip V. Clark, Sugar Land, TX (US); Joel F. Moxley, Denver, CO (US); Paul D. Deutch, Houston, TX (US); Lance D. Underwood, Morrison, CO (US); Charles C. Rinzler, Denver, CO (US); Ronald A. De Witt, Katy, TX (US); Sharath K. Kolachalam, Highlands Ranch, CO (US); Daryl L. Grubb, Littleton, CO (US)

(73) Assignees: Foro Energy, Inc., Houston, TX (US); Chevron U.S.A. Inc., Houston, TX (US)

( * ) Notice: Subject to any disclaimer, the term of this patent is extended or adjusted under 35 U.S.C. 154(b) by 605 days.

(21) Appl. No.: 13/034,175

(22) Filed: Feb. 24, 2011

(65) Prior Publication Data

US 2012/0217018 A1 Aug. 30, 2012

(51) Int. Cl.

| | |
|---|---|
| ***E21B 29/12*** | (2006.01) |
| ***E21B 43/116*** | (2006.01) |
| ***E21B 43/119*** | (2006.01) |
| ***E21B 29/06*** | (2006.01) |
| ***E21B 29/08*** | (2006.01) |
| ***E21B 34/04*** | (2006.01) |

(52) U.S. Cl.

USPC ..... 166/361; 166/297; 166/298; 166/55; 166/55.6; 166/363

(58) Field of Classification Search

USPC ..... 166/361, 363, 364, 297, 298, 55, 55.6, 166/85.4; 137/315.02; 251/1.1, 1.2, 1.3; 219/121.67, 121.72

See application file for complete search history.

(56) References Cited

U.S. PATENT DOCUMENTS

| | | | | |
|---|---|---|---|---|
| 914,636 | A | 3/1909 | Case | |
| 2,548,463 | A | 4/1951 | Blood | |
| 2,742,555 | A | 4/1956 | Murray | |
| 3,122,212 | A | 2/1964 | Karlovitz | |
| 3,168,334 | A | 2/1965 | Johnson | |
| 3,461,964 | A * | 8/1969 | Venghiattis | 166/297 |
| 3,493,060 | A | 2/1970 | Van Dyk | |
| 3,539,221 | A | 11/1970 | Gladstone | |

(Continued)

FOREIGN PATENT DOCUMENTS

| | | |
|---|---|---|
| EP | 0 565 287 A1 | 10/1993 |
| EP | 0 950 170 B1 | 9/2002 |

(Continued)

OTHER PUBLICATIONS

U.S. Appl. No. 12/543,968, filed Aug. 19, 2009, Rinzler et al.

(Continued)

*Primary Examiner* — Matthew Buck
*Assistant Examiner* — Edwin Toledo-Duran
(74) *Attorney, Agent, or Firm* — Glen P. Belvis; Steptoe & Johnson LLP

(57) ABSTRACT

There is provided a high power laser assisted blowout preventer and methods of use. In particular, there are provided systems and assemblies for utilizing high power laser energy within a blowout preventer to cut tubulars that are present within the bore of the blowout prevent, reducing the risk that such tubulars will inhibit the ability of the blowout preventer to seal a well.

58 Claims, 28 Drawing Sheets

(56) References Cited

U.S. PATENT DOCUMENTS 3,544,165 A 12/1970 Snedden
3,556,600 A 1/1971 Shoupp et al.
3,561,526 A * 2/1971 Williams et al. ..... 166/55
3,574,357 A 4/1971 Alexandru et al.
3,652,447 A 3/1972 Yant
3,693,718 A 9/1972 Stout
3,820,605 A 6/1974 Barber et al.
3,821,510 A 6/1974 Muncheryan
3,871,485 A 3/1975 Keenan, Jr.
3,882,945 A 5/1975 Keenan, Jr.
3,913,668 A 10/1975 Todd et al.
3,938,599 A 2/1976 Horn
3,960,448 A 6/1976 Schmidt et al.
3,977,478 A 8/1976 Shuck
3,981,369 A 9/1976 Bokenkamp
3,992,095 A 11/1976 Jacoby et al.
3,998,281 A 12/1976 Salisbury et al.
4,019,331 A 4/1977 Rom et al.
4,025,091 A 5/1977 Zeile, Jr.
4,026,356 A 5/1977 Shuck
4,043,575 A 8/1977 Roth
4,046,191 A * 9/1977 Neath ..... 166/352
4,061,190 A 12/1977 Bloomfield
4,066,138 A 1/1978 Salisbury et al.
4,081,027 A * 3/1978 Nguyen ..... 116/55
4,086,971 A 5/1978 Hall et al.
4,090,572 A 5/1978 Welch
4,113,036 A 9/1978 Stout
4,189,705 A 2/1980 Pitts, Jr.
4,194,536 A 3/1980 Stine et al.
4,199,034 A 4/1980 Salisbury et al.
4,227,582 A * 10/1980 Price ..... 175/16
4,228,856 A 10/1980 Reale
4,252,015 A 2/1981 Harbon et al.
4,256,146 A 3/1981 Genini et al.
4,266,609 A 5/1981 Rom et al.
4,280,535 A 7/1981 Willis
4,282,940 A 8/1981 Salisbury et al.
4,332,401 A 6/1982 Stephenson et al.
4,336,415 A 6/1982 Walling
4,340,245 A 7/1982 Stalder
4,370,886 A 2/1983 Smith, Jr. et al.
4,374,530 A 2/1983 Walling
4,375,164 A 3/1983 Dodge et al.
4,415,184 A 11/1983 Stephenson et al.
4,417,603 A 11/1983 Argy
4,444,420 A 4/1984 McStravick et al.
4,453,570 A 6/1984 Hutchison
4,459,731 A 7/1984 Hutchison
4,477,106 A 10/1984 Hutchison
4,531,552 A 7/1985 Kim
4,533,814 A * 8/1985 Ward ..... 219/121.64
4,565,351 A 1/1986 Conti et al.
4,662,437 A 5/1987 Renfro
4,694,865 A 9/1987 Tauschmann
4,741,405 A 5/1988 Moeny et al.
4,744,420 A 5/1988 Patterson et al.
4,770,493 A 9/1988 Ara et al.
4,793,383 A 12/1988 Gyory et al.
4,830,113 A 5/1989 Geyer
4,860,654 A 8/1989 Chawla et al.
4,860,655 A 8/1989 Chawla
4,872,520 A 10/1989 Nelson
4,923,008 A * 5/1990 Wachowicz et al. ..... 166/373
4,989,236 A 1/1991 Myllymäki
4,997,250 A 3/1991 Ortiz, Jr.
5,003,144 A 3/1991 Lindroth et al.
5,004,166 A 4/1991 Sellar
5,033,545 A 7/1991 Sudol
5,049,738 A 9/1991 Gergely et al.
5,070,904 A 12/1991 McMahon et al.
5,078,546 A * 1/1992 Fisk et al. ..... 405/156
5,084,617 A 1/1992 Gergely
5,086,842 A 2/1992 Cholet
5,107,936 A 4/1992 Foppe
5,121,872 A 6/1992 Legget
5,125,061 A 6/1992 Marlier et al.
5,140,664 A 8/1992 Bosisio et al.
5,163,321 A 11/1992 Perales
5,172,112 A 12/1992 Jennings
5,212,755 A 5/1993 Holmberg
5,285,204 A 2/1994 Sas-Jaworsky
5,348,097 A 9/1994 Giannesini et al.
5,351,533 A 10/1994 Macadam et al.
5,353,875 A 10/1994 Schultz et al.
5,396,805 A 3/1995 Surjaatmadja
5,400,857 A 3/1995 Whitby et al.
5,411,081 A 5/1995 Moore et al.
5,411,085 A 5/1995 Moore et al.
5,411,105 A 5/1995 Gray
5,413,045 A 5/1995 Miszewski
5,413,170 A 5/1995 Moore
5,423,383 A 6/1995 Pringle
5,425,420 A 6/1995 Pringle
5,435,351 A 7/1995 Head
5,435,395 A 7/1995 Connell
5,463,711 A 10/1995 Chu
5,465,793 A 11/1995 Pringle
5,469,878 A 11/1995 Pringle
5,479,860 A 1/1996 Ellis
5,483,988 A 1/1996 Pringle
5,488,992 A 2/1996 Pringle
5,500,768 A 3/1996 Doggett et al.
5,503,014 A 4/1996 Griffith
5,503,370 A 4/1996 Newman et al.
5,505,259 A 4/1996 Wittrisch et al.
5,515,926 A 5/1996 Boychuk
5,561,516 A 10/1996 Noble et al.
5,566,764 A 10/1996 Elliston
5,573,225 A 11/1996 Boyle et al.
5,577,560 A 11/1996 Coronado et al.
5,599,004 A 2/1997 Newman et al.
RE35,542 E * 6/1997 Fisk et al. ..... 405/156
5,638,904 A 6/1997 Misselbrook et al.
5,655,745 A 8/1997 Morrill
5,657,823 A * 8/1997 Kogure et al. ..... 166/340
5,694,408 A 12/1997 Bott et al.
5,735,502 A 4/1998 Levett et al.
5,757,484 A 5/1998 Miles et al.
5,771,974 A * 6/1998 Stewart et al. ..... 166/336
5,771,984 A 6/1998 Potter et al.
5,847,825 A 12/1998 Alexander
5,862,273 A 1/1999 Pelletier
5,864,113 A 1/1999 Cossi
5,896,482 A 4/1999 Blee et al.
5,896,938 A 4/1999 Moeny et al.
5,902,499 A 5/1999 Richerzhagen
5,924,489 A 7/1999 Hatcher
5,929,986 A 7/1999 Slater et al.
5,986,236 A 11/1999 Gainand et al.
5,986,756 A 11/1999 Slater et al.
RE36,525 E 1/2000 Pringle
6,015,015 A 1/2000 Luft et al.
6,026,905 A * 2/2000 Garcia-Soule ..... 166/336
6,032,742 A 3/2000 Tomlin et al.
6,038,363 A 3/2000 Slater et al.
6,047,781 A * 4/2000 Scott et al. ..... 175/5
RE36,723 E 6/2000 Moore et al.
6,084,203 A 7/2000 Bonigen
6,104,022 A 8/2000 Young et al.
RE36,880 E 9/2000 Pringle
6,116,344 A * 9/2000 Longbottom et al. ..... 166/298
6,147,754 A 11/2000 Theriault et al.
6,166,546 A 12/2000 Scheihing et al.
6,173,770 B1 1/2001 Morrill
6,215,734 B1 4/2001 Moeny et al.
6,227,300 B1 5/2001 Cunningham et al.
6,250,391 B1 6/2001 Proudfoot
6,273,193 B1 8/2001 Hermann et al.
6,301,423 B1 10/2001 Olson
6,321,839 B1 11/2001 Vereecken et al.
6,325,159 B1 * 12/2001 Peterman et al. ..... 175/7
6,328,343 B1 12/2001 Hosie et al.
6,352,114 B1 * 3/2002 Toalson et al. ..... 166/343

(56) References Cited

U.S. PATENT DOCUMENTS 6,355,928 B1 3/2002 Skinner et al.
6,356,683 B1 3/2002 Hu et al.
6,384,738 B1 5/2002 Carstensen et al.
6,386,300 B1 5/2002 Curlett et al.
6,401,825 B1 6/2002 Woodrow
6,426,479 B1 7/2002 Bischof
6,437,326 B1 8/2002 Yamate et al.
6,450,257 B1 9/2002 Douglas
6,497,290 B1 12/2002 Misselbrook et al.
6,543,538 B2 * 4/2003 Tolman et al. ..... 166/284
6,561,289 B2 5/2003 Portman et al.
6,564,046 B1 5/2003 Chateau
6,591,046 B2 7/2003 Stottlemyer
6,615,922 B2 9/2003 Deul et al.
6,626,249 B2 9/2003 Rosa
6,644,848 B1 11/2003 Clayton et al.
6,710,720 B2 3/2004 Carstensen et al.
6,712,150 B1 3/2004 Misselbrook et al.
6,719,042 B2 4/2004 Johnson et al.
6,725,924 B2 * 4/2004 Davidson et al. ..... 166/250.01
6,737,605 B1 5/2004 Kern
6,746,182 B2 6/2004 Munk et al.
6,747,743 B2 6/2004 Skinner et al.
6,755,262 B2 6/2004 Parker
6,808,023 B2 10/2004 Smith et al.
6,832,654 B2 12/2004 Ravensbergen et al.
6,847,034 B2 1/2005 Shah et al.
6,851,488 B2 2/2005 Batarseh
6,860,525 B2 3/2005 Parks
6,867,858 B2 3/2005 Owen et al.
6,870,128 B2 3/2005 Kobayashi et al.
6,874,361 B1 4/2005 Meltz et al.
6,880,646 B2 4/2005 Batarseh
6,885,784 B2 4/2005 Bohnert
6,888,097 B2 5/2005 Batarseh
6,888,127 B2 5/2005 Jones et al.
6,912,898 B2 7/2005 Jones et al.
6,913,079 B2 7/2005 Tubel
6,920,395 B2 7/2005 Brown
6,920,946 B2 7/2005 Oglesby
6,957,576 B2 10/2005 Skinner et al.
6,967,322 B2 11/2005 Jones et al.
6,978,832 B2 12/2005 Gardner et al.
6,994,162 B2 2/2006 Robison
7,040,746 B2 5/2006 McCain et al.
7,055,604 B2 6/2006 Jee et al.
7,055,629 B2 6/2006 Oglesby
7,072,044 B2 7/2006 Kringlebotn et al.
7,072,588 B2 7/2006 Skinner
7,086,467 B2 8/2006 Schlegelmilch et al.
7,086,484 B2 8/2006 Smith, Jr.
7,087,856 B2 8/2006 Lerner
7,126,332 B2 10/2006 Blanz et al.
7,134,488 B2 11/2006 Tudor et al.
7,147,064 B2 12/2006 Batarseh et al.
7,172,026 B2 2/2007 Misselbrook
7,195,731 B2 3/2007 Jones
7,199,869 B2 4/2007 MacDougall
7,210,343 B2 5/2007 Shammai et al.
7,212,283 B2 5/2007 Hother et al.
7,249,633 B2 7/2007 Ravensbergen et al.
7,264,057 B2 9/2007 Rytlewski et al.
7,270,195 B2 9/2007 MacGregor et al.
7,273,108 B2 9/2007 Misselbrook
7,334,637 B2 2/2008 Smith, Jr.
7,337,660 B2 3/2008 Ibrahim et al.
7,362,422 B2 4/2008 DiFoggio et al.
7,367,396 B2 5/2008 Springett et al.
7,395,696 B2 7/2008 Bissonnette et al.
7,395,866 B2 7/2008 Milberger et al.
7,416,032 B2 8/2008 Moeny et al.
7,416,258 B2 8/2008 Reed et al.
7,471,831 B2 12/2008 Bearman et al.
7,487,834 B2 2/2009 Reed et al.
7,490,664 B2 2/2009 Skinner et al.
7,503,404 B2 3/2009 McDaniel et al.
7,516,802 B2 4/2009 Smith, Jr.
7,518,722 B2 4/2009 Julian et al.
7,527,108 B2 5/2009 Moeny
7,530,406 B2 5/2009 Moeny et al.
7,559,378 B2 7/2009 Moeny
7,587,111 B2 9/2009 De Montmorillon et al.
7,591,315 B2 9/2009 Dore et al.
7,600,564 B2 10/2009 Shampine et al.
7,671,983 B2 3/2010 Shammai et al.
7,779,917 B2 8/2010 Kotrla et al.
7,802,385 B2 9/2010 Maringer et al.
7,832,477 B2 * 11/2010 Cavender et al. ..... 166/278
7,938,175 B2 5/2011 Skinner et al.
7,980,306 B2 * 7/2011 Lovell et al. ..... 166/250.17
8,056,633 B2 * 11/2011 Barra et al. ..... 166/298
8,322,441 B2 * 12/2012 Fenton ..... 166/368
2002/0039465 A1 4/2002 Skinner
2002/0189806 A1 12/2002 Davidson et al.
2003/0000741 A1 1/2003 Rosa
2003/0021634 A1 1/2003 Munk et al.
2003/0053783 A1 3/2003 Shirasaki
2003/0085040 A1 5/2003 Hemphill et al.
2003/0094281 A1 5/2003 Tubel
2003/0132029 A1 7/2003 Parker
2003/0136927 A1 7/2003 Baugh
2003/0145991 A1 8/2003 Olsen
2004/0006429 A1 1/2004 Brown
2004/0016295 A1 1/2004 Skinner et al.
2004/0020643 A1 2/2004 Thomeer et al.
2004/0033017 A1 2/2004 Kringlebotn et al.
2004/0074979 A1 4/2004 McGuire
2004/0093950 A1 5/2004 Bohnert
2004/0119471 A1 6/2004 Blanz et al.
2004/0129418 A1 7/2004 Jee et al.
2004/0195003 A1 10/2004 Batarseh
2004/0206505 A1 10/2004 Batarseh
2004/0207731 A1 10/2004 Bearman et al.
2004/0211894 A1 10/2004 Hother et al.
2004/0218176 A1 11/2004 Shammal et al.
2004/0244970 A1 12/2004 Smith, Jr.
2004/0252748 A1 12/2004 Gleitman
2004/0256103 A1 12/2004 Batarseh
2005/0012244 A1 1/2005 Jones
2005/0094129 A1 5/2005 MacDougall
2005/0099618 A1 5/2005 DiFoggio et al.
2005/0201652 A1 9/2005 Ellwood, Jr.
2005/0212284 A1 9/2005 Dole
2005/0230107 A1 10/2005 McDaniel et al.
2005/0252286 A1 11/2005 Ibrahim et al.
2005/0268704 A1 12/2005 Bissonnette et al.
2005/0269132 A1 12/2005 Batarseh et al.
2005/0272512 A1 12/2005 Bissonnette et al.
2005/0272513 A1 12/2005 Bissonnette et al.
2005/0272514 A1 12/2005 Bissonnette et al.
2005/0282645 A1 12/2005 Bissonnette et al.
2006/0038997 A1 2/2006 Julian et al.
2006/0065815 A1 3/2006 Jurca
2006/0102343 A1 5/2006 Skinner et al.
2006/0118303 A1 6/2006 Schultz et al.
2006/0185843 A1 8/2006 Smith, Jr.
2006/0191684 A1 8/2006 Smith, Jr.
2006/0201682 A1 9/2006 Reynolds
2006/0204188 A1 9/2006 Clarkson et al.
2006/0231257 A1 10/2006 Reed et al.
2006/0237233 A1 10/2006 Reed et al.
2007/0125163 A1 6/2007 Dria et al.
2007/0227741 A1 10/2007 Lovell et al.
2007/0247701 A1 10/2007 Akasaka et al.
2007/0267220 A1 11/2007 Magiawala et al.
2007/0280615 A1 12/2007 de Montmorillon et al.
2008/0078081 A1 4/2008 Huff et al.
2008/0093125 A1 4/2008 Potter et al.
2008/0099701 A1 5/2008 Whitby et al.
2008/0138022 A1 6/2008 Tassone
2008/0180787 A1 7/2008 DiGiovanni et al.
2008/0245568 A1 10/2008 Jeffryes
2008/0273852 A1 11/2008 Parker et al.
2009/0050371 A1 2/2009 Moeny

(56) References Cited

U.S. PATENT DOCUMENTS

| | | | |
|---|---|---|---|
| 2009/0133929 | A1 | 5/2009 | Rodland |
| 2009/0205675 | A1 | 8/2009 | Sarkar et al. |
| 2009/0260829 | A1 | 10/2009 | Mathis |
| 2009/0272424 | A1 | 11/2009 | Ortabasi |
| 2009/0279835 | A1 | 11/2009 | de Montmorillon et al. |
| 2009/0294050 | A1 | 12/2009 | Traggis et al. |
| 2010/0000790 | A1 | 1/2010 | Moeny |
| 2010/0001179 | A1 | 1/2010 | Kobayashi et al. |
| 2010/0032207 | A1 | 2/2010 | Potter et al. |
| 2010/0044102 | A1 | 2/2010 | Rinzler et al. |
| 2010/0044103 | A1 | 2/2010 | Moxley et al. |
| 2010/0044104 | A1 | 2/2010 | Zediker et al. |
| 2010/0044105 | A1 | 2/2010 | Faircloth et al. |
| 2010/0044106 | A1 | 2/2010 | Zediker et al. |
| 2010/0051847 | A1 | 3/2010 | Mailand et al. |
| 2010/0071794 | A1 | 3/2010 | Homan |
| 2010/0078414 | A1 | 4/2010 | Perry et al. |
| 2010/0089574 | A1 | 4/2010 | Wideman et al. |
| 2010/0089576 | A1 | 4/2010 | Wideman et al. |
| 2010/0089577 | A1 | 4/2010 | Wideman et al. |
| 2010/0147528 | A1 | 6/2010 | Baugh |
| 2010/0164223 | A1 | 7/2010 | Curtiss, III et al. |
| 2010/0197116 | A1 | 8/2010 | Shah et al. |
| 2010/0215326 | A1 | 8/2010 | Zediker et al. |
| 2010/0218955 | A1 | 9/2010 | Hart |
| 2010/0326659 | A1 | 12/2010 | Schultz et al. |
| 2010/0326665 | A1 | 12/2010 | Redlinger et al. |
| 2011/0030367 | A1 | 2/2011 | Dadd |
| 2012/0000646 | A1 | 1/2012 | Liotta et al. |
| 2012/0020631 | A1 | 1/2012 | Rinzler et al. |
| 2012/0061091 | A1 | 3/2012 | Radi |
| 2012/0067643 | A1 | 3/2012 | Dewitt et al. |
| 2012/0068086 | A1 | 3/2012 | Dewitt et al. |
| 2012/0074110 | A1 | 3/2012 | Zediker et al. |
| 2012/0217015 | A1 | 8/2012 | Zediker et al. |
| 2012/0217017 | A1 | 8/2012 | Zediker et al. |
| 2012/0217019 | A1 | 8/2012 | Zediker et al. |
| 2012/0248078 | A1 | 10/2012 | Zediker et al. |
| 2012/0255774 | A1 | 10/2012 | Grubb et al. |
| 2012/0255933 | A1 | 10/2012 | McKay et al. |
| 2012/0261188 | A1 | 10/2012 | Zediker et al. |
| 2012/0266803 | A1 | 10/2012 | Zediker et al. |
| 2012/0267168 | A1 | 10/2012 | Grubb et al. |
| 2012/0273269 | A1 | 11/2012 | Rinzler et al. |
| 2012/0273470 | A1 | 11/2012 | Zediker et al. |
| 2012/0275159 | A1 | 11/2012 | Fraze et al. |
| 2013/0011102 | A1 | 1/2013 | Rinzler et al. |

FOREIGN PATENT DOCUMENTS

| | | | | |
|---|---|---|---|---|
| FR | 2 716 924 | A1 | 9/1995 | |
| JP | 63242483 | A * | 10/1988 | ..... B23K 26/00 |
| JP | 09072738 | A | 3/1997 | |
| WO | WO 97/49893 | A1 | 12/1997 | |
| WO | WO 98/50673 | A1 | 11/1998 | |
| WO | WO 02/057805 | A2 | 7/2002 | |
| WO | WO 2004/009958 | A1 | 1/2004 | |
| WO | WO 2006/008155 | A1 | 1/2006 | |
| WO | WO 2006/054079 | A1 | 5/2006 | |
| WO | WO 2010/060177 | A1 | 6/2010 | |

OTHER PUBLICATIONS

U.S. Appl. No. 12/543,986, filed Aug. 19, 2009, Moxley et al.
U.S. Appl. No. 12/544,038, filed Aug. 19, 2009, Zediker et al.
U.S. Appl. No. 12/544,094, filed Aug. 19, 2009, Faircloth et al.
U.S. Appl. No. 12/544,136, filed Aug. 19, 2009, Zediker et al.
U.S. Appl. No. 12/706,576, filed Feb. 16, 2010, Zediker et al.
U.S. Appl. No. 12/840,978, filed Jul. 21, 2010, Rinzler et al.
U.S. Appl. No. 12/896,021, filed Oct. 1, 2010, Underwood et al.
U.S. Appl. No. 12/034,017, filed Feb. 24, 2011, Zediker et al.
U.S. Appl. No. 13/034,037, filed Feb. 24, 2011, Zediker et al.
U.S. Appl. No. 13/034,183, filed Feb. 24, 2011, Zediker et al.
U.S. Appl. No. 13/210,581, filed Aug. 16, 2011, DeWitt et al.
U.S. Appl. No. 13/211,729, filed Aug. 17, 2011, DeWitt et al.
U.S. Appl. No. 13/222,931, filed Aug. 31, 2011, Zediker et al.
U.S. Appl. No. 13/347,445, filed Jan. 10, 2012, Zediker et al.
U.S. Appl. No. 13/366,882, filed Feb. 6, 2012, McKay et al.
U.S. Appl. No. 13/403,132, filed Feb. 23, 2012, Zediker et al.
U.S. Appl. No. 13/403,287, filed Feb. 23, 2012, Grubb et al.
U.S. Appl. No. 13/403,509, filed Feb. 23, 2012, Fraze et al.
U.S. Appl. No. 13/403,615, filed Feb. 23, 2012, Grubb et al.
U.S. Appl. No. 13/403,692, filed Feb. 23, 2012, Zediker et al.
U.S. Appl. No. 13/403,723, filed Feb. 23, 2012, Rinzler et al.
U.S. Appl. No. 13/403,741, filed Feb. 23, 2012, Zediker et al.
U.S. Appl. No. 13/486,795, filed Jun. 1, 2012, Rinzler et al.
U.S. Appl. No. 13/565,345, filed Aug. 2, 2012, Zediker et al.
Related utility application assigned U.S. Appl. No. 13/565,345, filed Aug. 2, 2012, 112 pages.
International Search Report for PCT Application No. PCT/US09/54295, dated Apr. 26, 2010, 16 pgs.
International Search Report and Written Opinion for PCT App. No. PCT/US10/24368, dated Nov. 2, 2010, 16 pgs.
International Search Report for PCT Application No. PCT/US2012/026471, dated May 30, 2012, 13 pgs.
International Search Report for PCT Application No. PCT/US2012/026494, dated May 31, 2012, 12 pgs.
International Search Report for PCT Application No. PCT/US2012/026525, dated May 31, 2012, 8 pgs.
International Search Report for PCT Application No. PCT/US2012/026526, dated May 31, 2012, 10 pgs.
Agrawal Dinesh et al., Report on "Development of Advanced Drill Components for BHA Using Mircowave Technology Incorporating Carbide Diamond Composites and Functionally Graded Materials", believed to be published by Microwave Processing and Engineering Center, Material Research Institute, The Pennsylvania State University, 2003, 10 pgs.
Agrawal Dinesh et al., Report on "Graded Steel-Tungsten Cardide/Cobalt-Diamond Systems Using Microwave Heating", *Proceedings of the 2002 International Conference on Functionally Graded Materials*, 2002, pp. 50-58.
Agrawal Dinesh et al., "Microstructural Examination by TEM of WC/Co composites Prepared by Conventional and Microwave Processes", *15th International Plansee Seminar*, vol. 2, 2001, pp. 677-684.
Agrawal, Govind P., "Nonlinear Fiber Optics", Chap. 9, Fourth Edition, believed to be published by Academic Press copyright 2007, pp. 334-337.
Ai, H.A. et al., "Simulation of dynamic response of granite: A numerical approach of shock-induced damage beneath impact craters", *International Journal of Impact Engineering*, vol. 33, 2006, pp. 1-10.
Anton, Richard J. et al., "Dynamic Vickers indentation of brittle materials", *Wear*, vol. 239, 2000, pp. 27-35.
Ashby, M. F. et al., "The Failure of Brittle Solids Containing Small Cracks Under Compressive Stress States", *Acta Metall.*, vol. 34, No. 3,1986, pp. 497-510.
Aydin, A. et al., "The Schmidt hammer in rock material characterization", *Engineering Geology*, vol. 81, 2005, pp. 1-14.
Baflon, Jean-Paul et al., "On the Relationship Between the Parameters of Paris' Law for Fatigue Crack Growth in Aluminium Alloys", *Scripta Metallurgica*, vol. 11, No. 12, 1977, pp. 1101-1106.
Bailo, El Tahir et al., "Spectral signatures and optic coefficients of surface and reservoir shales and limestones at COIL, $CO_2$ and Nd:YAG laser wavelengths", believed to be published by *Petroleum Engineering Department, Colorado School of Mines*, 2004, 13 pgs.
Baird, J. A. "GEODYN: A Geological Formation/Drillstring Dynamics Computer Program", *Society of Petroleum Engineers of AIME*, 1964, 9 pgs.
Baird, Jerold et al., Phase 1 Theoretical Description, A Geological Formation Drill String Dynamic Interaction Finite Element Program (GEODYN), *Sandia National Laboratories*, Report No. Sand-84/7101, 1984, 196 pgs.
Batarseh, S. et al. "Well Perforation Using High-Power Lasers", *Society of Petroleum Engineers*, SPE 84418, 2003, pp. 1-10.

(56) References Cited

OTHER PUBLICATIONS

Author Unknown, "Geothermal Completion Technology Life-Cycle Cost Model (GEOCOM)", believed to be published by BDM Corporation, *Sandia National Laboratories*, for the U.S. Dept. of Energy, vols. 1 and 2, 1982, 222 pgs.
Beste, U. et al., "Micro-scratch evaluation of rock types—a means to comprehend rock drill wear", *Tribology International*, vol. 37, 2004, pp. 203-210.
Blackwell, B. F., "Temperature Profile in Semi-infinite Body With Exponential Source and Convective Boundary Condition", *Journal of Heat Transfer, Transactions of the ASME*, vol. 112, 1990, pp. 567-571.
Britz, Dieter, "Digital Simulation in Electrochemistry", *Lect. Notes Phys.*, vol. 666, 2005, pp. 103-117.
Browning, J. A. et al., "Recent Advances in Flame Jet Working of Minerals", *7th Symposium on Rock Mechanics*, 1965, pp. 281-313.
Cardenas, R., "Protected Polycrystalline Diamond Compact Bits for Hard Rock Drilling", Report No. DOE-99049-1381, believed to be published by U.S. Department of Energy, 2000, pp. 1-79.
Carstens, Jeffrey et al., "Heat-Assisted Tunnel Boring Machines", *Federal Railroad Administration and Urban Mass Transportation Administration*, believed to be published by U.S. Dept. of Transportation, Report No. FRA-RT-71-63, 1970, 340 pgs.
Clegg, John et al., "Improved Optimisation of Bit Selection Using Mathematically Modelled Bit-Performance Indices", *IADC/SPE International 102287*, 2006, pp. 1-10.
Close, F. et al., "Successful Drilling of Basalt in a West of Shetland Deepwater Discovery", *SPE International 96575*, Society of Petroleum Engineers, 2006, pp. 1-10.
Cobern, Martin E., "Downhole Vibration Monitoring & Control System Quarterly Technical Report #1", *APS Technology, Inc.*, Quarterly Technical Report #1, DVMCS, 2003, pp. 1-15.
Cogotsi, G. A. et al., "Use of Nondestructive Testing Methods in Evaluation of Thermal Damage for Ceramics Under Conditions of Nonstationary Thermal Effects", *Institute of Strength Problems, Academy of Sciences of the Ukrainian SSR*, 1985, pp. 52-56.
Cook, Troy, "Chapter 23, Calculation of Estimated Ultimate Recovery (EUR) for Wells in Continuous-Type Oil and Gas Accumulations", *U.S. Geological Survey Digital Data Series DDS-69-D*, Denver, Colorado: Version 1, 2005, pp. 1-9.
Dahl, Filip et al., "Development of a new direct test method for estimating cutter life, based on the Sievers J miniature drill test", *Tunnelling and Underground Space Technology*, vol. 22, 2007, pp. 106-116.
Damzen, M. J. et al., "Stimulated Brillion Scattering", Chapter 8—SBS in Optical Fibres, OP Publishing Ltd, Published by Institute of Physics, London, England, 2003, pp. 137-153.
Das, A. C. et al., "Acousto-ultrasonic study of thermal shock damage in castable refractory", Journal of Materials Science Letters, vol. 10, 1991, pp. 173-175.
De Guire, Mark R., "Thermal Expansion Coefficient (start)", *EMSE 201—Introduction to Materials Science & Engineering*, 2003, pp. 15.1-15.15.
Dinçer, Ismail et al., "Correlation between Schmidt hardness, uniaxial compressive strength and Young's modulus for andesites, basalts and tuffs", *Bull Eng Geol Env*, vol. 63, 2004, pp. 141-148.
Dunn, James C., "Geothermal Technology Development at Sandia", believed to be published by *Geothermal Research Division, Sandia National Laboratories*, 1987, pp. 1-6.
Eichler, H.J. et al., "Stimulated Brillouin Scattering in Multimode Fibers for Optical Phase Conjugation", *Optics Communications*, vol. 208, 2002, pp. 427-431.
Eighmy, T. T. et al., "Microfracture Surface Charaterizations: Implications for In Situ Remedial Methods in Fractured Rock", believed to be published by *U.S. Environmental Protection Agency*, EPA/600/R-05/121, 2006, pp. 1-99.
Elsayed, M.A. et al., "Measurement and analysis of Chatter in a Compliant Model of a Drillstring Equipped With a PDC Bit", *Mechanical Engineering Dept.*, believed to be published by *University of Southwestern Louisiana and Sandia National Laboratories*, 2000, pp. 1-10.
Ferro, D. et al., "Vickers and Knoop hardness of electron beam deposited ZrC and HfC thin films on titanium", *Surface & Coatings Technology*, vol. 200, 2006, pp. 4701-4707.
Figueroa, H. et al., "Rock removal using high power lasers for petroleum exploitation purposes", believed to be published by *Gas Technology Institute, Colorado School of Mines, Halliburton Energy Services, Argonne National Laboratory*, 2002, pp. 1-13.
Finger, John T. et al., "PDC Bit Research at Sandia National Laboratories", believed to be published by *Sandia National Laboratories*, SAND89-0079-UC-253, 1989, pp. 1-88.
Gahan, Brian C. et al. "Analysis of Efficient High-Power Fiber Lasers for Well Perforation", *Society of Petroleum Engineers*, SPE 90661, 2004, pp. 1-9.
Gahan, Brian C. et al. "Effect of Downhole Pressure Conditions on High-Power Laser Perforation", *Society of Petroleum Engineers*, SPE 97093, 2005, pp. 1-7.
Gahan, B. C. et al., "Laser Drilling: Determination of Energy Required to Remove Rock", *Society of Petroleum Engineers* International, SPE 71466, 2001, pp. 1-11.
Gahan, Brian C. et al., "Laser Drilling: Drilling with the Power of Light, Phase 1: Feasibility Study", *Topical Report*, Cooperative Agreement No. DE-FC26-00NT40917, 2000-2001, pp. 1-148.
Glowka, David A., "Design Considerations for a Hard-Rock PDC Drill Bit", believed to be published by *Sandia National Laboratories*, SAND-85-0666C, DE85 008313, 1985, pp. 1-23.
Glowka, David A., "Development of a Method for Predicting the Performance and Wear of PDC Drill Bits", believed to be published by *Sandia National Laboratories*, SAND86-1745-UC-66c, 1987, pp. 1-206.
Glowka, David A. et al., "Program Plan for the Development of Advanced Synthetic-Diamond Drill Bits for Hard-Rock Drilling", believed to be published by *Sandia National Laboratories*, SAND 93/1953, 1993, pp. 1-50.
Glowka, David A. et al., "Progress in the Advanced Synthetic-Diamond Drill Bit Program", believed to be published by *Sandia National Laboratories*, SAND95-2617C, 1994, pp. 1-9.
Glowka, David A., "The Use of Single—Cutter Data in the Analysis of PDC Bit Designs", *61st Annual Technical Conference and Exhibition of Society of Petroleum Engineers*, 1986, pp. 1-37.
Graves, Ramona M. et al., "Application of High Power Laser Technology to Laser/Rock Destruction: Where Have We Been? Where Are We Now?", *SW AAPG Convention*, 2002, pp. 213-224.
Graves, Ramona M. et al., "Laser Parameters That Effect Laser-Rock Interaction: Determining the Benefits of Applying Star Wars Laser Technology for Drilling and Completing Oil and Natural Gas Wells", Topical Report, believed to be published by *Petroleum Engineering Department, Colorado School of Mines*, 2001, pp. 1-157.
Gurarie, V. N., "Stress resistance parameters of brittle solids under laser/plasma pulse heating", *Materials Science and Engineering*, vol. A288, 2000, pp. 168-172.
Habib, P. et al., "The Influence of Residual Stresses on Rock Hardness", *Rock Mechanics*, vol. 6, 1974, pp. 15-24.
Hall, Kevin, "The role of thermal stress fatigue in the breakdown of rock in cold regions", *Geomorphology*, vol. 31, 1999, pp. 47-63.
Han, Wei, "Computational and experimental investigations of laser drilling and welding for microelectronic packaging", *Dorchester Polytechnic Institute*, A Dissertation submitted in May 2004, pp. 1-242.
Hareland, G. et al., "Cutting Efficiency of a Single PDC Cutter on Hard Rock", *Journal of Canadian Petroleum Technology*, vol. 48, No. 6, 2009, pp. 1-6.
Hashida, T. et al., "Numerical simulation with experimental verification of the fracture behavior in granite under confining pressures based on the tension-softening model", *International Journal of Fracture*, vol. 59, 1993, pp. 227-244.
Healy, Thomas E., "Fatigue Crack Growth in Lithium Hydride", believed to be published by *Lawrence Livermore National Laboratory*, 1993, pp. 1-32.

(56) References Cited

OTHER PUBLICATIONS

Hettema, M. H. H. et al., "The Influence of Steam Pressure on Thermal Spalling of Sedimentary Rock: Theory and Experiments", *Int. J. Rock Mech. Min. Sci.*, vol. 35, No. 1, 1998, pp. 3-15.
Hibbs, Louis E. et al., "Wear Mechanisms for Polycrystalline-Diamond Compacts as Utilized for Drilling in Geothermal Environments", believed to be published by *Sandia National Laboratories*, for the United States Government, Report No. SAND-82/7213, 1983, 287 pgs.
Hoek, E., "Fracture of Anisotropic Rock", *Journal of the South African Institute of Mining and Metallurgy*, vol. 64, No. 10, 1964, pp. 501-523.
Hoover, Ed R. et al., "Failure Mechanisms of Polycrystalline-Diamond Compact Drill Bits in Geothermal Environments", Sandia Report, believed to be published by *Sandia National Laboratories*, SAND81-1404, 1981, pp. 1-35.
Huff, C. F. et al., "Recent Developments in Polycrystalline Diamond-Drill-Bit Design", believed to be published by *Sandia National Laboratories*, 1980, pp. 1-29.
Jimeno, Carlos Lopez et al., Drilling and Blasting of Rocks, *a. a. Balkema* Publishers, 1995, 30 pgs.
Kahraman, S. et al., "Dominant rock properties affecting the penetration rate of percussive drills", *International Journal of Rock Mechanics and Mining Sciences*, 2003, vol. 40, pp. 711-723.
Kelsey, James R., "Drilling Technology/GDO", believed to be published by *Sandia National Laboratories*, SAND-85-1866c, DE85 017231, 1985, pp. 1-7.
Kerr, Callin Joe, "PDC Drill Bit Design and Field Application Evolution", *Journal of Petroleum Technology*, 1988, pp. 327-332.
Ketata, C. et al., "Knowledge Selection for Laser Drilling in the Oil and Gas Industry", *Computer Society*, 2005, pp. 1-6.
Khan, Ovais U. et al., "Laser heating of sheet metal and thermal stress development", *Journal of Materials Processing Technology*, vol. 155-156, 2004, pp. 2045-2050.
Kim, K. R. et al., "$CO_2$ laser-plume interaction in materials processing", *Journal of Applied Physics*, vol. 89, No. 1, 2001, pp. 681-688.
Klotz, K. et al., "Coatings with intrinsic stress profile: Refined creep analysis of (Ti,A1)N and cracking due to cyclic laser heating", *Thin Solid Films*, vol. 496, 2006, pp. 469-474.
Kobayashi, Toshio et al., "Drilling a 2-inch in Diameter Hole in Granites Submerged in Water by $CO_2$ Lasers", *SPE International, IADC 119914 Drilling Conference and Exhibition*, 2009, pp. 1-11.
Kubacki, Emily et al., "Optics for Fiber Laser Applications", believed to be published by *CVI Laser, LLC*, Technical Reference Document #20050415, 2005, 5 pgs.
Kujawski, Daniel, "A fatigue crack driving force parameter with load ratio effects", *International Journal of Fatigue*, vol. 23, 2001, pp. S239-S246.
Labuz, J. F. et al., "Microrack-dependent fracture of damaged rock", *International Journal of Fracture*, vol. 51, 1991, pp. 231-240.
Lacy, Lewis L., "Dynamic Rock Mechanics Testing for Optimized Fracture Designs", *Society of Petroleum Engineers International, Annual Technical Conference and Exhibition*, 1997, pp. 23-36.
Lally, Evan M., "A Narrow-Linewidth Laser at 1550 nm Using the Pound-Drever-Hall Stabilization Technique", *Thesis*, submitted to Virginia Polytechnic Institute and State University, Blacksburg, Virginia, 2006, 92 pgs.
Lau, John H., "Thermal Fatigue Life Prediction of Flip Chip Solder Joints by Fracture Mechanics Method", *Engineering Fracture Mechanics*, vol. 45, No. 5, 1993, pp. 643-654.
Leong, K. H. et al., "Lasers and Beam Delivery for Rock Drilling", believed to be published by *Argonne National Laboratory*, ANL/TD/TM03-01, 2003, pp. 1-35.
Leung, M. et al., "Theoretical study of heat transfer with moving phase-change interface in thawing of frozen food", *Journal of Physics D: Applied Physics*, vol. 38, 2005, pp. 477-482.
Lima, R. S. et al., "Elastic Modulus Measurements via Laser-Ultrasonic and Knoop Indentation Techniques in Thermally Sprayed Coatings", *Journal of Thermal Spray Technology*, vol. 14(1), 2005, pp. 52-60.
Lin, Y. T., "The Impact of Bit Performance on Geothermal-Well Cost", believed to be published by *Sandia National Laboratories*, SAND-81-1470C, 1981, pp. 1-6.
Lomov, I. N. et al., "Explosion in the Granite Field: Hardening and Softening Behavior in Rocks", believed to be published by *Lawrence Livermore National Laboratory*, 2001, pp. 1-7.
Long, S. G. et al., "Thermal fatigue of particle reinforced metal-matrix composite induced by laser heating and mechanical load", *Composites Science and Technology*, vol. 65, 2005, pp. 1391-1400.
Lyons, K. David et al., "NETL Extreme Drilling Laboratory Studies High Pressure High Temperature Drilling Phenomena", believed to be published by *National Energy Technology Laboratory*, 2007, pp. 1-6.
McElhenny, John E. et al., "Unique Characteristic Features of Stimulated Brillouin Scattering in Small-Core Photonic Crystal Fibers", *J. Opt. Soc. Am. B*, vol. 25, No. 4, 2008, pp. 582-593.
Marshall, David B. et al., "Indentation of Brittle Materials", *Microindentation Techniques in Materials Science and Engineering, ASTM STP 889; American Society for Testing and Materials*, 1986, pp. 26-46.
Maurer, William C., "Advanced Drilling Techniques", published by Petroleum Publishing Co., copyright 1980, 26 pgs.
Maurer, William C., "Novel Drilling Techniques", published by Pergamon Press, UK, copyright 1968, pp. 1-64.
Mazerov, Katie, "Bigger coil sizes, hybrid rigs, rotary steerable advances push coiled tubing drilling to next level", *Drilling Contractor*, 2008, pp. 54-60.
Medvedev, I. F. et al., "Optimum Force Characteristics of Rotary-Percussive Machines for Drilling Blast Holes", Moscow, Translated from *Fiziko-Tekhnicheskie Problemy Razrabotki Poleznykh Iskopaemykh*, No. 1, 1967, pp. 77-80.
Mensa-Wilmot, Graham et al., "Advanced Cutting Structure Improves PDC Bit Performance in Hard and Abrasive Drilling Environments", *Society of Petroleum Engineers International*, 2003, pp. 1-13.
Messaoud, Louafi, "Influence of Fluids on the Essential Parameters of Rotary Percussive Drilling", *Laboratoire d'Environnement (Tébessa)*, vol. 14, 2009, pp. 1-8.
Mocofanescu, A. et al., "SBS threshold for single mode and multimode GRIN fibers in an all fiber configuration", *Optics Express*, vol. 13, No. 6, 2005, pp. 2019-2024.
Moradian, Z. A. et al., "Predicting the Uniaxial Compressive Strength and Static Young's Modulus of Intact Sedimentary Rocks Using the Ultrasonic Test", *International Journal of Geomechanics*, vol. 9, No. 1, 2009, pp. 14-19.
Muto, Shigeki et al., "Laser cutting for thick concrete by multi-pass technique", *Chinese Optics Letters*, vol. 5 Supplement, 2007, pp. S39-S41.
Naqavi, I. Z. et al., "Laser heating of multilayer assembly and stress levels: elasto-plastic consideration", *Heat and Mass Transfer*, vol. 40, 2003, pp. 25-32.
Nara, Y. et al., "Sub-critical crack growth in anisotropic rock", *International Journal of Rock Mechanics and Mining Sciences*, vol. 43, 2006, pp. 437-453.
Nemat-Nasser, S. et al., "Compression-Induced Nonplanar Crack Extension With Application to Splitting, Exfoliation, and Rockburst", *Journal of Geophysical Research*, vol. 87, No. B8, 1982, pp. 6805-6821.
O'Hare, Jim et al., "Design Index: A Systematic Method of PDC Drill-Bit Selection", *Society of Petroleum Engineers International*, IADC/SPE Drilling Conference, 2000, pp. 1-15.
Okon, P. et al., "Laser Welding of Aluminium Alloy 5083", *21st International Congress on Applications of Lasers and Electro-Optics*, 2002, pp. 1-9.
Ortega, Alfonso et al., "Frictional Heating and Convective Cooling of Polycrystalline Diamond Drag Tools During Rock Cutting", Report No. SAND 82-0675c, believed to be published by *Sandia National Laboratories*, 1982, 23 pgs.
Ortega, Alfonso et al., "Studies of the Frictional Heating of Polycrystalline Diamond Compact Drag Tools During Rock Cutting", believed to be published by *Sandia National Laboratories*, SAND-80-2677, 1982, pp. 1-151.

(56) References Cited

OTHER PUBLICATIONS

Ortiz, Blas et al., Improved Bit Stability Reduces Downhole Harmonics (Vibrations), *International Association of Drilling Contractors/Society of Petroleum Engineers Inc.*, 1996, pp. 379-389.
Palashchenko, Yuri A., "Pure Rolling of Bit Cones Doubles Performance", *I & Gas Journal*, vol. 106, 2008, 8 pgs.
Pardoen, T. et al., "An extended model for void growth and Coalescence", *Journal of the Mechanics and Physics of Solids*, vol. 48, 2000, pp. 2467-2512.
Park, Un-Chul et al., "Thermal Analysis of Laser Drilling Processes", *IEEE Journal of Quantum Electronics*, 1972, vol. QK-8, No. 2, 1972, pp. 112-119.
Parker, Richard A. et al., "Laser Drilling Effects of Beam Application Methods on Improving Rock Removal", *Society of Petroleum Engineers*, SPE 84353, 2003, pp. 1-7.
Pavlina, E. J. et al., "Correlation of Yield Strength and Tensile Strength with Hardness for Steels", *Journals of Materials Engineering and Performance*, vol. 17, No. 6, 2008, pp. 888-893.
Ping, Cao et al., "Testing study of subcritical crack growth rate and fracture toughness in different rocks", *Transactions of Nonferrous Metals Society of China*, vol. 16, 2006, pp. 709-714.
Plinninger, Ralf J. et al., "Predicting Tool Wear in Drill and Blast", *Tunnels & Tunneling International Magazine*, 2002, pp. 1-5.
Plinninger, Dr. Ralf J. et al., "Wear Prediction in Hardrock Excavation Using the CERCHAR Abrasiveness Index (CAI)", *EUROCK 2004 & 53rd Geomechanics Colloquium. Schubert (ed.)*, VGE, 2004, pp. 1-6.
Polsky, Yarom et al., "Enhanced Geothermal Systems (EGS) Well Construction Technology Evaluation Report", believed to be published by *Sandia National Laboratories*, Sandia Report, SAND2008-7866, 2008, pp. 1-108.
Pooniwala, Shahvir, "Lasers: The Next Bit", *Society of Petroleum Engineers*, No. SPE 104223, 2006, pp. 1-10.
Potyondy, D. O. et al., "A Bonded-particle model for rock", *International Journal of Rock Mechanics and Mining Sciences*, vol. 41, 2004, pp. 1329-1364.
Qixian, Luo et al., "Using compression wave ultrasonic transducers to measure the velocity of surface waves and hence determine dynamic modulus of elasticity for concrete", *Construction and Building Materials*, vol. 10, No. 4, 1996, pp. 237-242.
Radkte, Robert, "New High Strength and faster Drilling TSP Diamond Cutters", Report by *Technology International, Inc.*, DOE Award No. DE-FC26-97FT34368, 2006, 97 pgs.
Rauenzahn, R. M., "Analysis of Rock Mechanics and Gas Dynamics of Flame-Jet Thermal Spallation Drilling", believed to be published by *Massachusetts Institute of Technology*, submitted in partial fulfillment of doctorate degree, 1986, pp. 1-583.
Rauenzahn, R. M. et al., "Rock Failure Mechanisms of Flame-Jet Thermal Spallation Drilling—Theory and Experimental Testing", *Int. J. Rock Merch. Min. Sci. & Geomech. Abstr.*, vol. 26, No. 5, 1989, pp. 381-399.
Raymond, David W., "PDC Bit Testing At Sandia Reveals Influence of Chatter in Hard-Rock Drilling", *Geothermal Resources Council Monthly Bulletin*, SAND99-2655J, 1999, 7 pgs.
Rossmanith, H. P. et al., "Wave Propagation, Damage Evolution, and Dynamic Fracture Extension. Part I. Percussion Drilling", *Materials Science*, vol. 32, No. 3, 1996, pp. 350-358.
Sachpazis, C. I, M. Sc., Ph. D., "Correlating Schmidt Hardness With Compressive Strength and Young's Modulus of Carbonate Rocks", *International Association of Engineering Geology*, Bulletin, No. 42, 1990, pp. 75-83.
Sano, Osam et al., "Acoustic Emission During Slow Crack Growth", believed to be published by *Department Mining and Mineral Engineering, NII-Electronic Library Service*, 1980, pp. 381-388.
Schormair, Nik et al., "The influence of anisotropy on hard rock drilling and cutting", *The Geological Society of London*, IAEG, Paper No. 491, 2006, pp. 1-11.
Shannon, G. J. et al., "High power laser welding in hyperbaric gas and water environments", *Journal of Laser Applications*, vol. 9, 1997, pp. 129-136.
Shuja, S. Z. et al., "Laser heating of semi-infinite solid with consecutive pulses: Influence of materaial properties on temperature field", *Optics & Laser Technology*, vol. 40, 2008, pp. 472-480.
Smith, E., "Crack Propagation at a Constant Crack Tip Stress Intensity Factor", *Int. Journal of Fracture*, vol. 16, 1980, pp. R215-R218.
Solomon, A. D. et al., "Moving Boundary Problems in Phase Change Models Current Research Questions", *Engineering Physics and Mathematics Division*, ACM Signum Newsletter, vol. 20, Issue 2, 1985, pp. 8-12.
Sousa, Luis M. O. et al., "Influence of microfractures and porosity on the physico-mechanical properties and weathering of ornamental granites", *Engineering Geology*, vol. 77, 2005, pp. 153-168.
Stone, Charles M. et al., "Qualification of a Computer Program for Drill String Dynamics", believed to be published by *Sandia National Laboratories*, SAND-85-0633C, 1985, pp. 1-20.
Takarli, Mokhfi et al., "Damage in granite under heating/cooling cycles and water freeze-thaw condition", *International Journal of Rock Mechanics and Mining Sciences*, vol. 45, 2008, pp. 1164-1175.
Tanaka, K. et al., "The Generalized Relationship Between the Parameters *C* and *m* of Paris' Law for Fatigue Crack Growth", *Scripta Metallurgica*, vol. 15, No. 3, 1981, pp. 259-264.
Tang, C. A. et al., "Coupled analysis of flow, stress and damage (FSD) in rock failure", *International Journal of Rock Mechanics and Mining Sciences*, vol. 39, 2002, pp. 477-489.
Thorsteinsson, Hildigunnur et al., "The Impacts of Drilling and Reservoir Technology Advances on EGS Exploitation", *Proceedings, Thirty-Third Workshop on Geothermal Reservoir Engineering, Institute for Sustainable Energy, Environment, and Economy (ISEEE)*, 2008, pp. 1-14.
Author unknown, "Chapter 6—Drilling Technology and Costs", from Report for The Future of Geothermal Energy, believed to be published by the U.S. Dept. of Energy, 2005, 53 pgs.
Varnado, S. G. et al., "The Design and Use of Polycrystalline Diamond Compact Drag Bits in The Geothermal Environment", *Society of Petroleum Engineers of AIME*, SPE 8378, 1979, pp. 1-11.
Wen-gui, Cao et al., "Damage constituitive model for strain-softening rock based on normal distribution and its parameter determination", *J. Cent. South Univ. Technol.*, vol. 14, No. 5, 2007, pp. 719-724.
Wiercigroch, M., "Dynamics of ultrasonic percussive drilling of hard rocks", *Journal of Sound and Vibration*, vol. 280, 2005, pp. 739-757.
Williams, R. E. et al., "Experiments in Thermal Spallation of Various Rocks", *Transactions of the ASME*, vol. 118, 1996, pp. 2-8.
Willis, David A. et al., "Heat transfer and phase change during picosecond laser ablation of nickel", *International Journal of Heat and Mass Transfer*, vol. 45, 2002, pp. 3911-3918.
Wong, Teng-fong et al., "Microcrack statistics, Weibull distribution and micromechanical modeling of compressive failure in rock", *Mechanics of Materials*, vol. 38, 2006, pp. 664-681.
Wood, Tom, "Dual Purpose COTD™ Rigs Establish New Operational Records", believed to be published by *Treme Coil Drilling Corp., Drilling Technology Without Borders*, 2009, pp. 1-18.
Xia, K. et al., "Effects of microstructures on dynamic compression of Barre granite", *International Journal of Rock Mechanics and Mining Sciences*, vol. 45, 2008. pp. 879-887, available at: www.sciencedirect.com.
Xu, Zhiyue et al., "Laser Spallation of Rocks for Oil Well Drilling", *Proceedings of the 23rd International Congress on Applications of Lasers and Electro-Optics*, 2004, pp. 1-6.
Xu, Z et al. "Modeling of Laser Spallation Drilling of Rocks fro gas- and Oilwell Drilling", *Society of Petroleum Engineers*, SPE 95746, 2005, pp. 1-6.
Xu, Z. et al., "Specific Energy for Laser Removal of Rocks", *Proceedings of the 20th International Congress on Applications of Lasers & Electro-Optics*, 2001, pp. 1-8.
Xu, Z. et al., "Specific energy for pulsed laser rock drilling", *Journal of Laser Applications*, vol. 15, No. 1, 2003, pp. 25-30.
Yamshchikov, V. S. et al., "An Evaluation of the Microcrack Density of Rocks by Ultrasonic Velocimetric Method", believed to be published by *Moscow Mining Institute*. (*Translated from Fiziko-Tekhnicheskie Problemy Razrabotki Poleznykh Iskopaemykh*), 1985, pp. 363-366.

(56) References Cited

OTHER PUBLICATIONS

Yilbas, B. S. et al., "Laser short pulse heating: Influence of pulse intensity on temperature and stress fields", *Applied Surface Science*, vol. 252, 2006, pp. 8428-8437.
Yilbas, B. S. et al., "Laser treatment of aluminum surface: Analysis of thermal stress field in the irradiated región", *Journal of Materials Processing Technology*, vol. 209, 2009, pp. 77-88.
Yilbas, B. S. et al., "Nano-second laser pulse heating and assisting gas jet considerations", *International Journal of Machine Tools & Manufacture*, vol. 40, 2000, pp. 1023-1038.
Yilbas, B. S. et al., "Repetitive laser pulse heating with a convective boundary condition at the surface", *Journal of Physics D: Applied Physics*, vol. 34, 2001, pp. 222-231.
Yun, Yingwei et al., "Thermal Stress Distribution in Thick Wall Cylinder Under Thermal Shock", *Journal of Pressure Vessel Technology, Transactions of the ASME*, 2009, vol. 131, pp. 1-6.
Zeuch, D.H. et al., "Rock Breakage Mechanism Wirt a PDC Cutter", *Society of Petroleum Engineers, 60th Annual Technical Conference*, Las Vegas, Sep. 22-25, 1985, 11 pgs.
Zhai, Yue et al., "Dynamic failure analysis on granite under uniaxial impact compressive load", *Front. Archit. Civ. Eng. China*, vol. 2, No. 3, 2008, pp. 253-260.
Zhou, X.P., "Microcrack Interaction Brittle Rock Subjected to Uniaxial Tensile Loads", *Theoretical and Applied Fracture Mechanics*, vol. 47, 2007, pp. 68-76.
Zhou, Zehua et al., "A New Thermal-Shock-Resistance Model for Ceramics: Establishment and validation", *Materials Science and Engineering*, A 405, 2005, pp. 272-276.
Zhu, Dongming et al., "Influence of High Cycle Thermal Loads on Thermal Fatigue Behavior of Thick Thermal Barrier Coatings", believed to be published by *National Aeronautics and Space Administration, Army Research Laboratory*, Technical Report ARL-TR-1341, NASA TP-3676, 1997, pp. 1-50.
Zhu, Dongming et al., "Investigation of thermal fatigue behavior of thermal barrier coating systems", *Surface and Coatings Technology*, vol. 94-95, 1997, pp. 94-101.
Zhu, Dongming et al., "Investigation of Thermal High Cycle and Low Cycle Fatigue Mechanisms of Thick Thermal Barrier Coatings", believed to be published by *National Aeronautics and Space Administration, Lewis Research Center*, NASA/TM-1998-206633, 1998, pp. 1-31.
Zhu, Dongming et al., "Thermophysical and Thermomechanical Properties of Thermal Barrier Coating Systems", believed to be published by *National Aeronautics and Space Administration, Glenn Research Center*, NASA/TM-2000-210237, 2000, pp. 1-22.
Author unknown, "A Built-for-Purpose Coiled Tubing Rig", believed to be published by Schulumberger Wells,No. DE-PS26-03NT15474, 2006, p. 18.
Author unknown, "Diamond-Cutter Drill Bits", believed to be published by Geothermal Energy Program, Office of Geothermal and Wind Technologies, 2000, 2 pages.
Author unknown, "Introducing the XTC200DTR Plus", believed to be published by Extreme Drilling Corporation, 2009, 10 pages.
Author unknown, "IADC Dull Grading System for Fixed Cutter Bits", believed to be published by Hughes Christensen, 1996, 14 pages.
Author unknown, "Percussion Drilling Manual Impax™ Hammer Bit", by Smith Tool, 2002, 67 pages.
Author unknown, "Simple Drilling Methods", believed to be published by WEDC Loughborough University, United Kingdom, 1995, pp. 41-44.
Author unknown, "Capital Drilling Equipment Brochure", believed to be published by GE Oil & Gas Business, 2008, 15 pages.
Chastain, T. et al., "Deep Water Drilling System", *SPE Drilling Engineering*, Aug. 1986, pp. 325-328.
Author unknown, "Drilling Systems: Reliable to the Extremes", believed to be published by GE Oil & Gas (Drilling & Production) Brochure, 2009, 15 pages.
Author unknown, "Forensic Examination of Deepwater Horizon Blowout Preventer", a DNV (Det Norske Veritas) report for US Department of the Interior, Bureau of Ocean Energy Management, Regulation, and Enforcement, Mar. 20, 2011, 200 pages.
Author unknown, "Mini Shear Study", a West Engineering Services, Inc. Case Study for U.S. Minerals Management Services, Dec. 2002, pp. 1-16.
Author unknown, "Shear Ram Blowout Preventer Forces Required", believed to be published by Barringer and Associates, Inc., 2010, 17 pages.
Author unknown, "Shear Ram Capabilities Study", a West Engineering Services Study for US Minerals Management Services, Sep. 2004, 61 pages.

* cited by examiner

LASER ASSISTED BLOWOUT PREVENTER AND METHODS OF USE

BACKGROUND OF THE INVENTION

1. Field of the Invention

The present inventions relate to blowout preventers and, in particular, subsea blowout preventers used for the offshore exploration and production of hydrocarbons, such as oil and natural gas. Further, the present inventions relate to the implementation of high power lasers in association with the blowout preventer's mechanical well control assemblies. Thus, and in particular, the present inventions relate to novel laser assisted subsea blowout preventers and methods of using such devices to manage and control offshore drilling activities.

As used herein, unless specified otherwise the terms "blowout preventer," "BOP," and "BOP stack" are to be given their broadest possible meaning, and include: (i) devices positioned at or near the borehole surface, e.g., the seafloor, which are used to contain or manage pressures or flows associated with a borehole; (ii) devices for containing or managing pressures or flows in a borehole that are associated with a subsea riser; (iii) devices having any number and combination of gates, valves or elastomeric packers for controlling or managing borehole pressures or flows; (iv) a subsea BOP stack, which stack could contain, for example, ram shears, pipe rams, blind rams and annular preventers; and, (v) other such similar combinations and assemblies of flow and pressure management devices to control borehole pressures, flows or both and, in particular, to control or manage emergency flow or pressure situations.

As used herein, unless specified otherwise "offshore" and "offshore drilling activities" and similar such terms are used in their broadest sense and would include drilling activities on, or in, any body of water, whether fresh or salt water, whether manmade or naturally occurring, such as for example rivers, lakes, canals, inland seas, oceans, seas, bays and gulfs, such as the Gulf of Mexico. As used herein, unless specified otherwise the term "offshore drilling rig" is to be given its broadest possible meaning and would include fixed towers, tenders, platforms, barges, jack-ups, floating platforms, drill ships, dynamically positioned drill ships, semi-submersibles and dynamically positioned semi-submersibles. As used herein, unless specified otherwise the term "seafloor" is to be given its broadest possible meaning and would include any surface of the earth that lies under, or is at the bottom of, any body of water, whether fresh or salt water, whether manmade or naturally occurring. As used herein, unless specified otherwise the terms "well" and "borehole" are to be given their broadest possible meaning and include any hole that is bored or otherwise made into the earth's surface, e.g., the seafloor or sea bed, and would further include exploratory, production, abandoned, reentered, reworked, and injection wells. As used herein the term "riser" is to be given its broadest possible meaning and would include any tubular that connects a platform at, on, or above the surface of a body of water, including an offshore drilling rig, a floating production storage and offloading ("FPSO") vessel, and a floating gas storage and offloading ("FGSO") vessel, to a structure at, on, or near the seafloor for the purposes of activities such as drilling, production, workover, service, well service, intervention and completion.

As used herein the term "drill pipe" is to be given its broadest possible meaning and includes all forms of pipe used for drilling activities; and refers to a single section or piece of pipe. As used herein the terms "stand of drill pipe," "drill pipe stand," "stand of pipe," "stand" and similar type terms are to be given their broadest possible meaning and include two, three or four sections of drill pipe that have been connected, e.g., joined together, typically by joints having threaded connections. As used herein the terms "drill string," "string," "string of drill pipe," string of pipe" and similar type terms are to be given their broadest definition and would include a stand or stands joined together for the purpose of being employed in a borehole. Thus, a drill string could include many stands and many hundreds of sections of drill pipe.

As used herein the term "tubular" is to be given its broadest possible meaning and includes drill pipe, casing, riser, coiled tube, composite tube, vacuum insulated tubing ("VIT), production tubing and any similar structures having at least one channel therein that are, or could be used, in the drilling industry. As used herein the term "joint" is to be given its broadest possible meaning and includes all types of devices, systems, methods, structures and components used to connect tubulars together, such as for example, threaded pipe joints and bolted flanges. For drill pipe joints, the joint section typically has a thicker wall than the rest of the drill pipe. As used herein the thickness of the wall of a tubular is the thickness of the material between the internal diameter of the tubular and the external diameter of the tubular.

As used herein, unless specified otherwise "high power laser energy" means a laser beam having at least about 1 kW (kilowatt) of power. As used herein, unless specified otherwise "great distances" means at least about 500 m (meter). As used herein the term "substantial loss of power," "substantial power loss" and similar such phrases, mean a loss of power of more than about 3.0 dB/km (decibel/kilometer) for a selected wavelength. As used herein the term "substantial power transmission" means at least about 50% transmittance.

2. Discussion of Related Art

Deep Water Drilling

Offshore hydrocarbon exploration and production has been moving to deeper and deeper waters. Today drilling activities at depths of 5000 ft, 10,000 ft and even greater depths are contemplated and carried out. For example, its has been reported by RIGZONE, www.rigzone.com, that there are over 300 rigs rated for drilling in water depths greater than 1,000 ft (feet), and of those rigs there are over 190 rigs rated for drilling in water depths greater than 5,000 ft, and of those rigs over 90 of them are rated for drilling in water depths of 10,000 ft. When drilling at these deep, very-deep and ultra-deep depths the drilling equipment is subject to the extreme conditions found in the depths of the ocean, including great pressures and low temperatures at the seafloor.

Further, these deep water drilling rigs are capable of advancing boreholes that can be 10,000 ft, 20,000 ft, 30,000 ft and even deeper below the sea floor. As such, the drilling equipment, such as drill pipe, casing, risers, and the BOP are subject to substantial forces and extreme conditions. To address these forces and conditions drilling equipment, for example, drill pipe and drill strings, are designed to be stronger, more rugged, and in many cases heavier. Additionally, the metals that are used to make drill pipe and casing have become more ductile.

Typically, and by way of general illustration, in drilling a subsea well an initial borehole is made into the seabed and then subsequent and smaller diameter boreholes are drilled to extend the overall depth of the borehole. Thus, as the overall borehole gets deeper its diameter becomes smaller; resulting in what can be envisioned as a telescoping assembly of holes with the largest diameter hole being at the top of the borehole closest to the surface of the earth.

Thus, by way of example, the starting phases of a subsea drill process may be explained in general as follows. Once the drilling rig is positioned on the surface of the water over the area where drilling is to take place, an initial borehole is made by drilling a 36" hole in the earth to a depth of about 200-300 ft. below the seafloor. A 30" casing is inserted into this initial borehole. This 30" casing may also be called a conductor. The 30" conductor may or may not be cemented into place. During this drilling operation a riser is generally not used and the cuttings from the borehole, e.g., the earth and other material removed from the borehole by the drilling activity, are returned to the seafloor. Next, a 26" diameter borehole is drilled within the 30" casing, extending the depth of the borehole to about 1,000-1,500 ft. This drilling operation may also be conducted without using a riser. A 20" casing is then inserted into the 30" conductor and 26" borehole. This 20" casing is cemented into place. The 20" casing has a wellhead secured to it. (In other operations an additional smaller diameter borehole may be drilled, and a smaller diameter casing inserted into that borehole with the wellhead being secured to that smaller diameter casing.) A BOP is then secured to a riser and lowered by the riser to the sea floor; where the BOP is secured to the wellhead. From this point forward all drilling activity in the borehole takes place through the riser and the BOP.

The BOP, along with other equipment and procedures, is used to control and manage pressures and flows in a well. In general, a BOP is a stack of several mechanical devices that have a connected inner cavity extending through these devices. BOP's can have cavities, e.g., bore diameters ranging from about 4⅛" to 26¾." Tubulars are advanced from the offshore drilling rig down the riser, through the BOP cavity and into the borehole. Returns, e.g., drilling mud and cuttings, are removed from the borehole and transmitted through the BOP cavity, up the riser, and to the offshore drilling rig.

The BOP stack typically has an annular preventer, which is an expandable packer that functions like a giant sphincter muscle around a tubular. Some annular preventers may also be used or capable of sealing off the cavity when a tubular is not present. When activated, this packer seals against a tubular that is in the BOP cavity, preventing material from flowing through the annulus formed between the outside diameter of the tubular and the wall of the BOP cavity. The BOP stack also typically has ram preventers. As used herein unless specified otherwise, the term "ram preventer" is to be given its broadest definition and would include any mechanical devices that clamp, grab, hold, cut, sever, crush, or combinations thereof, a tubular within a BOP stack, such as shear rams, blind rams, variable rams, variable pipe rams, blind-shear rams, pipe rams, casing shear rams, and preventers such as Hydril's HYDRIL PRESSURE CONTROL COMPACT Ram, Hydril Pressure Control Conventional Ram, HYDRIL PRESSURE CONTROL QUICK-LOG, and HYDRIL PRESSURE CONTROL SENTRY Workover, SHAFFER ram preventers, and ram preventers made by Cameron.

Thus, the BOP stack typically has a pipe ram preventer, and my have more than one of these. Pipe ram preventers typically are two half-circle like clamping devices that are driven against the outside diameter of a tubular that is in the BOP cavity. Pipe ram preventers can be viewed as two giant hands that clamp against the tubular and seal-off the annulus between the tubular and the BOP cavity wall. Blind ram preventers may also be contained in the BOP stack, these rams can seal the cavity when no tubulars are present.

Pipe ram preventers and annular preventers typically can only seal the annulus between a tubular in the BOP and the BOP cavity; they cannot seal-off the tubular. Thus, in emergency situations, e.g., when a "kick" (a sudden influx of gas, fluid, or pressure into the borehole) occurs, or if a potential blowout situation arises, flows from high downhole pressures can come back up through the inside of the tubular, the annulus between the tubular and riser, and up the riser to the drilling rig. Additionally, in emergency situations, the pipe ram and annular preventers may not be able to form a strong enough seal around the tubular to prevent flow through the annulus between the tubular and the BOP cavity. Thus, BOP stacks include a mechanical shear ram assembly. (As used herein, unless specified otherwise, the term "shear ram" would include blind shear rams, shear sealing rams, shear seal rams, shear rams and any ram that is intended to, or capable of, cutting or shearing a tubular.) Mechanical shear rams are typically the last line of defense for emergency situations, e.g., kicks or potential blowouts. Mechanical shear rams function like giant gate valves that are supposed to quickly close across the BOP cavity to seal it. They are intended to cut through any tubular in the BOP cavity that would potentially block the shear ram from completely sealing the BOP cavity.

BOP stacks can have many varied configurations and components, which are dependent upon the conditions and hazards that are expected during deployment and use. These components could include, for example, an annular type preventer, a rotating head, a single ram preventer with one set of rams (blind or pipe), a double ram preventer having two sets of rams, a triple ram type preventer having three sets of rams, and a spool with side outlet connections for choke and kill lines. Examples of existing configurations of these components could be: a BOP stack having a bore of 7 1/16" and from bottom to top a single ram, a spool, a single ram, a single ram and an annular preventer and having a rated working pressure of 5,000 psi; a BOP stack having a bore of 13⅝" and from bottom to top a spool, a single ram, a single ram, a single ram and an annular preventer and having a rated working pressure of 10,000 psi; and, a BOP stack having a bore of 18¾" and from bottom to top, a single ram, a single ram, a single ram, a single ram, an annular preventer and an annular preventer and having a rated working pressure of 15,000 psi.

BOPs need to contain the pressures that could be present in a well, which pressures could be as great as 15,000 psi or greater. Additionally, there is a need for shear rams that are capable of quickly and reliably cutting through any tubular, including drilling collars, pipe joints, and bottom hole assemblies that might be present in the BOP when an emergency situation arises or other situation where it is desirable to cut tubulars in the BOP and seal the well. With the increasing strength, thickness and ductility of tubulars, and in particular tubulars of deep, very-deep and ultra-deep water drilling, there has been an ever increasing need for stronger, more powerful, and better shear rams. This long standing need for such shear rams, as well as, other information about the physics and engineering principles underlying existing mechanical shear rams, is set forth in: West Engineering Services, Inc., "Mini Shear Study for U.S. Minerals Management Services" (Requisition No. 2-1011-1003, December 2002); West Engineering Services, Inc., "Shear Ram Capabilities Study for U.S. Minerals Management Services" (Requisition No. 3-4025-1001, September 2004); and, Barringer & Associates Inc., "Shear Ram Blowout Preventer Forces Required" (Jun. 6, 2010, revised Aug. 8, 2010).

High Power Laser Beam Conveyance

Prior to the recent breakthroughs of co-inventor Dr. Mark Zediker and those working with him at Foro Energy, Inc., Littleton Colo., it was believed that the transmission of high power laser energy over great distances without substantial loss of power was unobtainable. Their breakthroughs in the transmission of high power laser energy, in particular power levels greater than 5 kW, are set forth, in part, in the novel and innovative teachings contained in US patent application publications 2010/0044106 and 2010/0215326 and in Rinzler et. al, pending U.S. patent application Ser. No. 12/840,978 titled "Optical Fiber Configurations for Transmission of Laser Energy Over Great Distances" (filed Jul. 21, 2010). The disclosures of these three US patent applications, to the extent that they refer or relate to the transmission of high power laser energy, and lasers, fibers and cable structures for accomplishing such transmissions, are incorporated herein by reference. It is to be noted that this incorporation by reference herein does not provide any right to practice or use the inventions of these applications or any patents that may issue therefrom and does not grant, or give rise to, any licenses thereunder.

The utilization and application of high power lasers to BOP and risers is set forth in U.S. patent application Ser. Nos. 13/034183, 13/034,017, and 13/034037 filed concurrently herewith, the entire disclosures of which are incorporated herein by reference.

SUMMARY

In drilling operations it has long been desirable to have a BOP that has the ability to quickly, reliably, and in a controlled manner sever tubulars and seal off, or otherwise manage the pressure, flow, or both of a well. As the robustness of tubulars, and in particular tubulars for deep sea drilling, has increased, the need for such a BOP has continued, grown and become more important. The present invention, among other things, solves this need by providing the articles of manufacture, devices and processes taught herein.

Thus, there is provided herein a blowout preventer stack having: a ram movable from a first position to a second position; and, a laser cutter for emitting a laser beam defining a beam path positioned relative to the ram and facing a cavity formed within the stack, wherein the beam path enters into the cavity and the second position is located within the cavity.

There is also provided a blowout preventer stack including a ram preventer; the stack defining a cavity; and, a laser cutter, wherein the laser cutter is positioned to deliver a laser beam along a beam path. Further, the ram preventer may be a shear ram assembly and the stack may also include: an annular preventer assembly; a pipe ram assembly; and, the annular preventer assembly, shear ram assembly and pipe ram assembly share the cavity, the cavity having an axis.

Still further, there is provided a subsea blowout preventer stack in which the beam path may be directed toward the axis of the cavity, may be directed towards the cavity, or wherein the beam path intersects the axis of the cavity.

Additionally, there is provided a blowout preventer in which the a laser cutter has a shield located adjacent to the cavity, wherein the laser cutter shield protects the laser cutter from damage from the conditions present in the BOP cavity, such as pressure, temperature, tubular or line structures moving through or rotating within the cavity, cuttings, hydrocarbons, and drilling fluids, the laser cutter from drilling fluids, while not appreciably interfering with the movement of tubulars through the cavity.

Further still, there is provided a blowout preventer having: a laser cutter; a ram preventer including a ram; a cavity within the stack for passing tubulars through the cavity; the laser cutter having a beam path; the ram capable of movement into the cavity; an area within the cavity for engagement of the ram with a tubular; and, the beam path positioned between the laser cutter and intersecting the area in the cavity for the ram engagement with a tubular.

Furthermore, there is provided a blowout preventer for use on land, sea or both, having a laser cutter; a ram preventer, having a ram; a cavity within a stack for passing tubulars therethrough; the laser cutter having a beam path; the ram capable of movement into the cavity; an area within the cavity for engagement of the ram with a tubular; and, the beam path directed above the area within the cavity for engagement of the ram with the tubular.

There is yet further provided a laser assisted blowout preventer, for use on land, on the sea or both, the blowout preventer having: an annular preventer; a pipe ram assembly; and, a laser shear ram assembly having: a ram movable from a first position to a second position; and, a laser cutter positioned relative to the ram and facing a cavity formed within the laser assisted blowout preventer, wherein the laser cutter emits a laser beam that defines a, laser cutter beam path that enters into the cavity and the second position is located within the cavity. As a subsea blowout preventer this preventer may also have: a shear ram assembly and a second pipe ram assembly; wherein the annular preventer, laser shear ram assembly, shear ram assembly, pipe ram assembly and second pipe ram assembly form a stack of components.

Still additionally, there is provided a laser assisted blowout preventer wherein the laser cutter beam path extends toward a center axis of the cavity, wherein the cavity has a vertical axis and the laser cutter beam path forms an acute angle with the vertical axis, wherein the cavity has a vertical axis and the laser cutter beam path that forms an obtuse angle with the vertical axis, or wherein the body cavity has a vertical axis and the laser cutter beam path forms about a 90 degree angle with the vertical axis.

Moreover, there is also provided a laser assisted blowout preventer wherein the laser cutter is capable of at least partially orbiting an axis of the cavity while firing the laser beam. This cutter may also have a second laser cutter. These laser assisted blowout preventers may be configured such that it takes about ½ of an orbit to complete a cut of a tubular, it takes about ⅓ of an orbit to complete a cut of a tubular, it takes about ¼ of an orbit to complete a cut of a tubular.

Further, there is provided a laser assisted blowout preventer wherein the laser cutter is contained in a ram. Further, the ram may have a path of travel for movement of the ram from the first position to the second position, the laser cutter beam path may be transverse to the ram path of travel, or the laser cutter beam path may be parallel to the ram path of travel.

Still further, there is provided a laser assisted blowout having: a plurality of laser cutters, wherein each laser cutter emits a laser beam that defines a beam path, wherein the cavity is substantially circular; and each of the plurality of laser cutters is adjacent to but not in the cavity, and the beam paths are configured in a spoke like configuration.

Yet further, there is provided a laser assisted blowout preventer having: a frame; a blowout preventer stack associated with the frame, the blowout preventer stack having; a cavity formed within the blowout preventer for passing tubulars therethrough; and, a laser delivery assembly positioned outside of the cavity when not activated.

There is also provided a laser assisted subsea blowout preventer drilling system, the system having: a subsea riser; a blowout preventer stack having: a cavity for passing tubulars through the blowout preventer stack, wherein the cavity is in mechanical communication with the subsea riser, wherein tubulars can be passed to and from the subsea riser into the cavity for the purpose of advancing a borehole; a laser delivery assembly; a shear ram assembly, wherein the laser delivery assembly is optically and mechanically associated with the shear ram assembly; whereby, upon activation the laser delivery system delivers a high power laser beam to a tubular within the blowout preventer cavity resulting in cutting the tubular to reduce the risk that the tubular would prevent the closing of the shear ram assembly. Regarding this laser assisted subsea blowout preventer drilling system, the high power laser beam forms a laser delivery pattern to sever the tubular in the blowout preventer cavity, wherein the high power laser beam forms a laser delivery pattern to weaken the tubular in the blowout preventer cavity, or wherein the high power laser beam forms a laser delivery pattern to remove two discrete areas of the tubular.

Yet further, there is provided a laser assisted subsea blowout preventer drilling system, the system having: a subsea riser; a blowout preventer stack; the blowout preventer stack having: a cavity for passing tubulars therethrough, wherein the cavity for the blowout preventer stack is in fluid communication with the subsea riser; a laser delivery assembly; and, a shear ram assembly having an opposed pair of shear rams, wherein the laser delivery assembly is associated with the shear ram assembly.

Moreover, there is provided an offshore drilling rig having a laser assisted subsea blowout preventer system for the rapid cutting of tubulars in the blowout preventer during emergency situations, the laser system having: a riser capable of being lowered from and operably connected to an offshore drilling rig to a depth at or near a seafloor; a blowout preventer capable of being operably connected to the riser and lowered by the riser from the offshore drilling rig to the seafloor; a high power laser in optical communication with a laser cutter; and, the laser cutter operably associated with the blowout preventer and riser, whereby the laser cutter is capable of being lowered to at or near the seafloor and upon activation delivering a high power laser beam to a tubular that is within the blowout preventer.

Additionally, there is provided an offshore drilling rig having a laser assisted subsea blowout preventer system for the rapid cutting of tubulars in the blowout preventer during emergency situations, the laser system having: a riser positioned at a depth at or near a seafloor, wherein the riser is operably connected to an offshore drilling rig; a blowout preventer positioned at or near the seafloor, wherein the blowout preventer is operably connected to the riser; a high power laser in optical communication with a laser cutter; and, the laser cutter operably associated with the blowout preventer and riser and positioned at or near the seafloor, whereby upon activation the laser cutter delivers a high power laser beam to a tubular that is within the blowout preventer.

Still additionally, there is provided an offshore drilling rig having a laser assisted subsea blowout drilling system, the system having: a riser capable of being lowered from and operably connected to an offshore drilling rig to a depth at or near a seafloor; a blowout preventer capable of being operably connected to the riser and lowered by the riser from the offshore drilling rig to the seafloor; the blowout preventer including a shear ram capable of mechanically interacting with an area of a tubular that is within the blowout preventer; the shear ram being associated with a laser cutter; a high power laser in optical communication with the laser cutter; and, the laser cutter operably associated with the blowout preventer and riser, whereby the laser cutter is capable of being lowered to at or near the seafloor and upon activation delivering a high power laser beam to the tubular that is within the blowout preventer and to an area on the tubular that is at or near the area of mechanical interaction with the shear ram.

Further, there is provided a deep water offshore drilling rig capable of drilling in over 5000 feet of water, having a laser delivery assembly associated with a blowout preventer and a riser for the rapid cutting of tubulars in the blowout preventer stack, the offshore drilling rig having: a hoisting means and a high power laser having at least 20 kW of power; at least 5000 feet of riser sections, capable of being connected together and lowered to a depth at or near a seafloor; a blowout preventer capable of being operably connected to the riser and lowered to the seafloor; the high power laser in optical communication with a laser cutter; the laser cutter opto-mechanically associated with the blowout preventer, whereby the laser cutter is capable of being lowered to at or near the seafloor and upon activation delivering a high power laser beam to a tubular that is within the blowout preventer and to an area on the tubular that is intended to be cut. And, further this drilling rig may have the hoisting means including a derrick a drawworks and a top drive.

Yet further, there is provided a subsea blowout preventer stack having: a ram and a laser cutter positioned within the stack; the laser cutter having a means to deliver a predetermined laser beam cutting pattern; whereby the predetermined laser beam cutting pattern corresponds to an area of a tubular to be removed within the stack.

There is also provided a method of drilling subsea wells by using a laser assisted blowout preventer and riser, the method including: lowering a laser assisted blowout preventer having a first inner cavity from an offshore drilling rig to a seafloor using a riser having a second inner cavity, the seafloor having a borehole; securing the blowout preventer to the borehole, whereby the borehole, the first inner cavity and the second inner cavity are in fluid and mechanical communication; and, advancing the borehole by lowering tubulars from the offshore drilling rig down through the second inner cavity, the first inner cavity and into the borehole; wherein, the laser assisted blowout preventer has the capability to perform laser cutting of a tubular present in the first inner cavity. The blowout preventer used in this method may be a laser assisted blowout preventer having: a frame; a blowout preventer stack associated with the frame; the blowout preventer stack including a third cavity for passing tubulars therethrough, which third cavity is at least a part the first cavity; and, the blowout preventer stack including the laser delivery assembly, wherein the laser delivery assembly is positioned outside of the first and third cavities when not activated.

DESCRIPTION OF THE PREFERRED EMBODIMENTS

Figure 1:
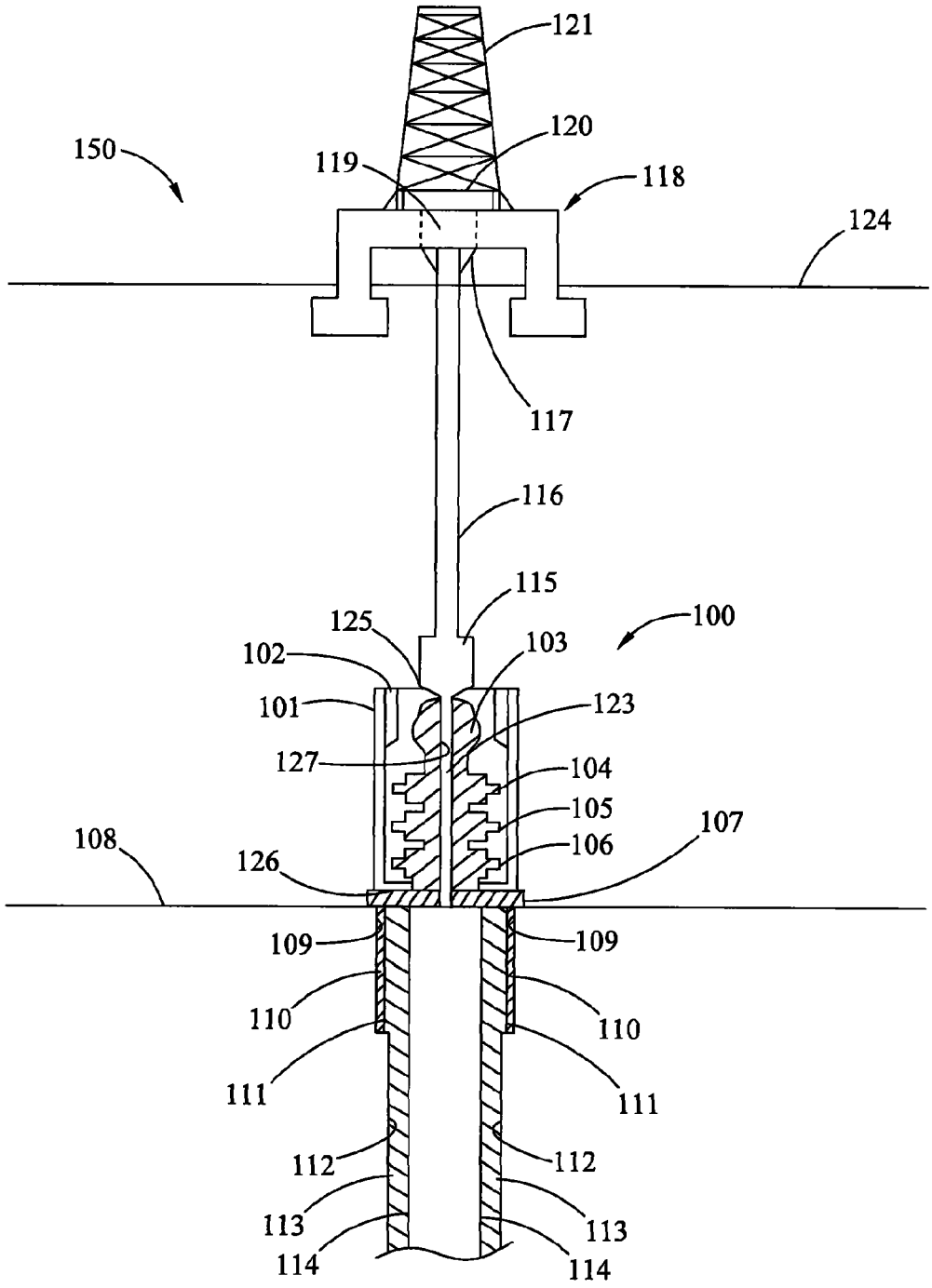
FIG. 1 is a schematic diagram of an embodiment of a laser assisted subsea BOP drilling system of the present invention.

In general, the present inventions relate to a BOP having high power laser beam cutters that are used in conjunction with mechanical closing devices to manage the conditions of a well, such as pressure, flow or both. Thus, by way of example, an embodiment of a laser assisted subsea BOP drilling system 150 is schematically shown in FIG. 1. In this embodiment there is provided a laser assisted blowout preventer (BOP) 100. The laser assisted BOP 100 has a frame 101, which protects the BOP, has lifting and handling devices (not shown), a control and connection module 102, and other equipment and devices utilized in subsea operation, which are known to the offshore drilling art, but are not shown in the figure. The laser assisted BOP 100 of this example has an annular preventer 103, a laser shear ram assembly 104 with a laser delivery assembly, a first pipe ram 105 and a second pipe ram 106. This assembly of preventers and rams could also be referred to as a laser assisted BOP stack. The stack has a cavity or passage 123 going through it from its top 125 (closest to the surface of the water 124) to its bottom 126 (closest to the seafloor 108). This passage 123, for example, could be about 18¾" in diameter. The passage 123 would have a passage or cavity wall 127.

Typically, in deep sea drilling operations a 21" riser and an 18¾" BOP are used. The term "21" riser" is generic and covers risers having an outer diameter in the general range of 21" and would include for example a riser having a 21¼" outer diameter. Wall thickness for 21" risers can range of from about ⅝" to ⅞" or greater. Risers and BOPs, however, can vary in size, type and configuration. Risers can have outer diameters ranging from about 13⅜" to about 24." BOP's can have cavities, e.g., bore diameters ranging from about 4⅛" to 26¾." Risers may be, for example, conventional pipe risers, flexible pipe risers, composite tube structures, steel cantenary risers ("SCR"), top tensioned risers, hybrid risers, and other types of risers known to those skilled in the offshore drilling art or later developed. The use of smaller and larger diameter risers, different types and configurations of risers, BOPs having smaller and larger diameter cavities, and different types and configurations of BOPs, are contemplated; and, the teachings and inventions of this specification are not limited to, or by, the size, type or configuration of a particular riser or BOP.

The top 125 of the laser assisted BOP 100 is secured to a riser 116 by a flex joint 115. The flex joint 115, which may also be referred to as a flex connecter or ball joint, allows the riser 116 to be at an angle with respect to the laser assisted BOP 100, and thus, accommodates some movement of the riser 116 and the drilling rig 118 on the surface of the water 124. The riser 116 is connected to the drilling rig 118 by riser tensioners 117 and other equipment known to those of skill in the offshore drilling art, but not shown in this figure. The drilling rig 118, which in this example is shown as a semi-submersible, has a moon pool 119, a drill floor 120, a derrick 121, and other drilling and drilling support equipment and devices utilized for operation, which are known to the offshore drilling art, but are not shown in the figure. Although a semi-submersible is shown in this embodiment, any type of offshore drilling rig, vessel, or platform may be utilized and thus may have a laser assisted BOP drilling system.

When deployed, as shown in FIG. 1, the laser assisted BOP 100 is attached to the riser 116, lowered to the seafloor 108 and secured to a wellhead 107. The wellhead 107 is position and fixed to a casing 114, which has been cemented, into a borehole 112 and into a larger diameter casing 111 by cement 113. The larger diameter casing 111 is cemented into a larger diameter borehole 109 by cement 110. Thus, by way of example, casing 114 can be 20" casing and borehole 112 can be a 26" diameter borehole, casing 111 can be 30" casing and borehole 109 can be a 36" diameter borehole. From this point forward, generally, all the drilling activity in the borehole takes place through the riser and the BOP.

In general, and by way of example, during deployment a laser assisted BOP (such as the embodiment of FIG. 1) is attached to the riser, lowered by the offshore drilling rig to the seafloor and secured to a wellhead. The wellhead is positioned and fixed to a casing, which has been cemented into a borehole. From this point forward, generally, all the drilling activity in the borehole takes place through the riser and the BOP. Such drilling activity would include, for example, lowering a string of drill pipe having a drill bit at its end from the offshore drilling rig down the interferer cavity of the riser, through the cavity of the laser assisted BOP and into the borehole. Thus, the drill string would run from the offshore drilling rig on the surface of the water to the bottom of the borehole, potentially many tens of thousands of feet below the water surface and seafloor. The drill bit would be rotated against the bottom of the borehole, while drilling mud is pumped down the interior of the drill pipe and out the drill bit. The drilling mud would carry the cuttings, e.g., borehole material removed by the rotating bit, up the annulus between the borehole wall and the outer diameter of the drill string, continuing up through the annulus between BOP cavity wall and the outer diameter of the drill string, and continuing up through the annulus between the inner diameter of the riser cavity and the outer diameter of the drill string, until the drilling mud and cuttings are generally directed by a bell housing, or in extreme situations a diverter, to further processing or handling on the offshore drilling rig. Thus, the drilling mud is pumped from the offshore drilling rig through a drill string in the riser to the bottom of the borehole and returned to the drill ship, in part, by the riser and the laser assisted and BOP.

The laser assisted BOPs of the present inventions, for example the laser assisted BOP 100 of FIG. 1, may be used to control and manage both pressures and flows in a well; and may be used to manage and control emergency situations, such as a kick or a potential blowout. The annular preventer, for example annular preventer 103 of FIG. 1, which for example has an expandable packer that seals against a tubular that is in the BOP cavity 123 preventing material from flowing through the annulus formed between the outside diameter of the tubular and the inner cavity wall 127 of the laser assisted BOP 100. The rams, for example the pipe rams 105 and 106 of FIG. 1, may both have two half-circle like clamping devices that are driven against the outside diameter of a tubular that is in the BOP cavity 123, or one may be a blind ram that can seal the cavity when no tubulars are present.

Laser assisted BOPs, for example the laser assisted BOP 100 of FIG. 1, may include laser shear ram assemblies, for example laser shear ram assembly 104. Laser shear ram assemblies may be the last line of defense for emergency situations, e.g., kicks or potential blowouts. In general, laser shear rams assemblies use a laser beam to cut or weaken a tubular, including drilling collars, pipe joints, and bottom hole assemblies that might be present in the BOP cavity 123 when an emergency situation arises, or other situation where it would be advantageous to cut tubulars in the BOP, so that the rams can quickly and reliably close across the BOP cavity 123 to seal it, and thus, seal the well. The laser BOP should contain the pressures that could be present in a well, and for example, should be capable of withstanding pressures of 5,000 psi, 10,000 psi, 15,000 psi, preferably 20,000 psi for deep sea drilling, or greater. Thus, laser assisted BOPs will have the capability to reliably and quickly seal a well, regardless of the thickness and type of tubular that is present in the BOP when an emergency or other situation arises.

In FIG. 1 the riser and BOP is configured along the lines of a drilling riser BOP package with the BOP positioned at or near the seafloor, typically attached to a wellhead as seen in drilling activities. The present laser modules, laser cutters, laser assemblies and laser-BOP assemblies of the present inventions have applications to other types of risers, riser-BOP packages and activities, both on land and offshore. Thus, they have applications in relation to drilling, workover, servicing, testing, intervention and completing activities. They also have applications to surface BOPs, e.g., where the BOP is positioned above the surface of the water and the riser extends from the BOP to the seafloor, were drilling is done in the riser, where the riser is a production riser, and other configurations known to, or later developed by the art.

Laser assisted subsea BOP drilling systems may have a single high power laser, and preferably may have two or three high power lasers, and may have several high power lasers, for example, six or more. High power solid-state lasers, specifically semiconductor lasers and fiber lasers are preferred, because of their short start up time and essentially instant-on capabilities. The high power lasers for example may be fiber lasers or semiconductor lasers having 10 kW, 20 kW, 50 kW or more power and, which emit laser beams with wavelengths preferably in about the 1550 nm (nanometer), or 1083 nm ranges. Examples of preferred lasers, and in particular solid-state lasers, such as fiber lasers, are set forth in US patent application publications 2010/0044106 and 2010/0215326 and in pending U.S. patent application Ser. No. 12/840,978. The laser, or lasers, may be located on the offshore drilling rig, above the surface of the water, and optically connected to the BOP on the seafloor by way of a high power long distance laser transmission cable, preferred examples of which are set forth in US patent application publications 2010/0044106 and 2010/0215326 and in pending U.S. patent application Ser. No. 12/840,978. The laser transmission cable may be contained in a spool and unwound and attached to the BOP and riser as they are lowered to the seafloor. The lasers may also be contained in, or associated with, the BOP frame, eliminating the need for a long distance of high power optical cable to transmit the laser beam from the surface of the water down to the seafloor. In view of the extreme conditions in which the laser shear rams are required to operate and the need for high reliability in their operation, one such configuration of a laser assisted subsea BOP drilling system is to have at least one high power laser located on the offshore drilling rig and connect to the BOP by a high power transmission cable and to have at least one laser in, or associated with, the BOP frame on the seafloor.

Figure 2:
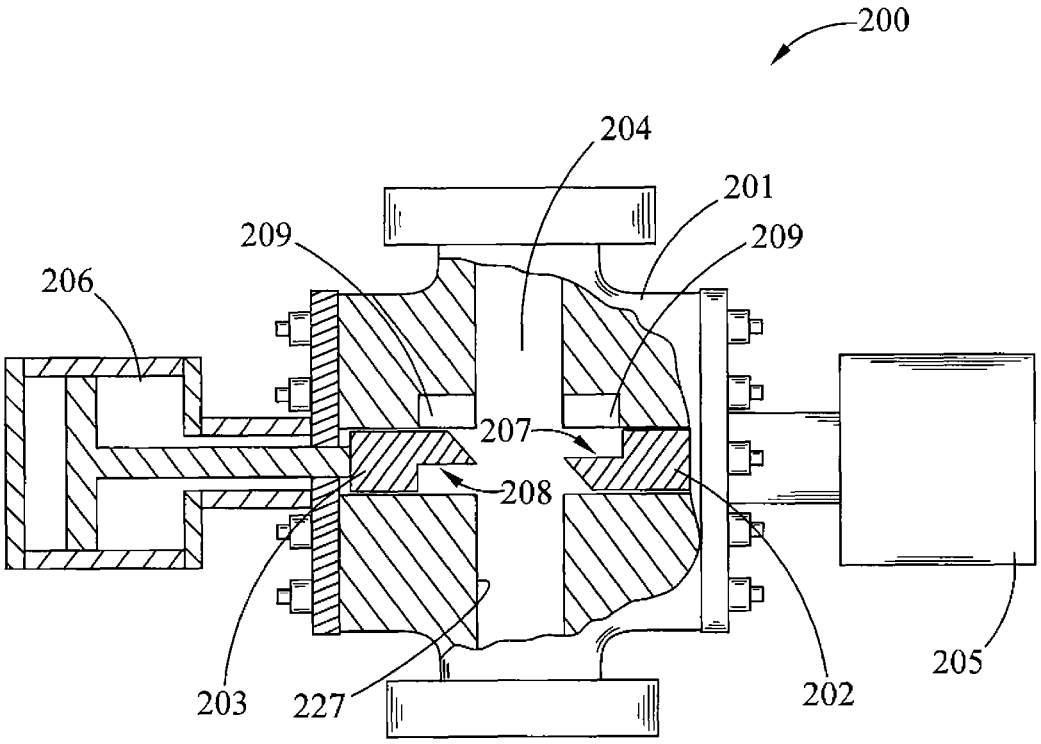
FIG. 2 is a partial cut away cross-sectional view of an embodiment of a laser shear ram assembly of the present invention.

Turning to FIG. 2 there is shown an example of an embodiment of a laser shear ram assembly that could be used in a BOP stack. The laser shear ram assembly 200 has a body 201. The body 201 has a lower shear ram 202, (closer to the wellhead) and an upper shear ram 203 that upon activation are forced into inner cavity 204 by lower piston assembly 205 and upper piston assembly 206. Upon activation the mating surfaces 207, 208 of the shear rams 202, 203 engage each other and seal off the inner cavity 204, and thus, the well. The inner cavity 204 has an inner cavity wall 227. There is also provided a laser delivery assembly 209. The laser delivery assembly 209 is located in the body 201 of the laser shear ram assembly 200. The laser delivery assembly 209 may be, for example, an annular assembly that surrounds, or partially surround, the inner cavity 204. This assembly 209 is located above shear rams 202, 203, i.e., the side further away from the wellhead. The laser delivery assembly 209 is optically associated with at least one high power laser source.

During drilling and other activities tubulars, not shown in FIG. 2, are typically positioned within the inner cavity 204. An annulus is formed between the outer diameter of the tubular and the inner cavity wall 227. These tubulars have an outer diameter that can range in size from about 18" down to a few inches, and in particular, typically range from about 16⅖ (16.04)" inches to about 5", or smaller. When tubulars are present in the cavity 204, upon activation of the laser shear ram assembly 200, the laser delivery assembly 209 delivers high power laser energy to the tubular located in the cavity 204. The high power laser energy cuts the tubular completely, or at a minimum weakens the tubular, to permit the shear rams 202, 203 to quickly seal off the cavity 204, moving any remaining tubular sections out of the way of the shear rams if the tubular was completely severed by the laser energy, or severing the tubular if only weakened by the laser and moving the severed tubular sections out of the way of the shear rams. Thus, the laser shear ram assembly 200 assures that the shear rams surface 207, 208 engage, seal, and thus, seal-off the BOP cavity 204 and the well.

Although a single laser delivery assembly is shown in the example of the embodiment of FIG. 2, multiple laser delivery assemblies, assemblies of different shapes, and assemblies in different positions, may be employed. Further, configurations where the laser delivery assembly is located below the shear rams, i.e., the side closer to the wellhead, as well as, configurations where laser delivery assemblies are located above, below, within, or combinations thereof, the shear rams, or other sections or modules of the BOP stack may also be employed. The ability of the laser energy to cut, remove, weaken, structurally weaken, or substantially weaken the tubular in the inner cavity enables the potential use of a single shear ram, where two shear rams may otherwise be required or needed; thus, reducing the number of moving parts, reducing the weight of the BOP, reducing the height of the BOP and reducing the deck footprint for the BOP, as well as other benefits, in the overall assembly. Further, the ability to make precise and predetermined laser energy delivery patterns to tubulars and the ability to make precise and predetermined cuts in and through tubulars, provides the ability to have the shear ram cutting and mating surfaces configured in a way to match, complement, or otherwise work more efficiently with the laser energy delivery pattern. Thus, shear ram configurations matched or tailored to the laser energy delivery pattern are contemplated by the present inventions. Further, the ability to make precise and predetermined cuts in and through tubulars, provides the ability, even in an emergency situation, to sever the tubular without crushing it and to have a predetermined shape to the severed end of the tubular to assist in later attaching a fishing tool to recover the severed tubular from the borehole. Further, the ability to sever the tubular, without crushing it, provides a greater area, i.e., a bigger opening, in the lower section of the severed tubular through which drilling mud, or other fluid, can be pumped into the well, by the kill line associated with the BOP stack.

The body of laser shear ram assembly may be a single piece that is machined to accommodate the laser delivery assembly, or it may be made from multiple pieces that are fixed together in a manner that provides sufficient strength for its intended use, and in particular to withstand pressures of 5,000 psi, 10,000 psi, 15,000 psi, 20,000 psi, and greater. The area of the body that contains the laser delivery assembly may be machined out, or otherwise fabricated to accommodate the laser delivery assembly, while maintaining the strength requirements for the body's intended use. The body of the laser shear ram assembly may also be two or more separate components or modules, e.g., one component or module for the laser delivery assembly and another for the shear rams. These modules could be attached to each other by, for example, bolted flanges, or other suitable attachment means known to those of skill in the offshore drilling art. The body, or a module making up the body, may have a passage, passages, channels, or other such structures, to convey fiber optic cables for transmission of the laser beam from the laser source into the body and to the laser delivery assembly, as well as, other cables that relate to the operation or monitoring of the laser delivery assembly and its cutting operation.

Figure 3A:
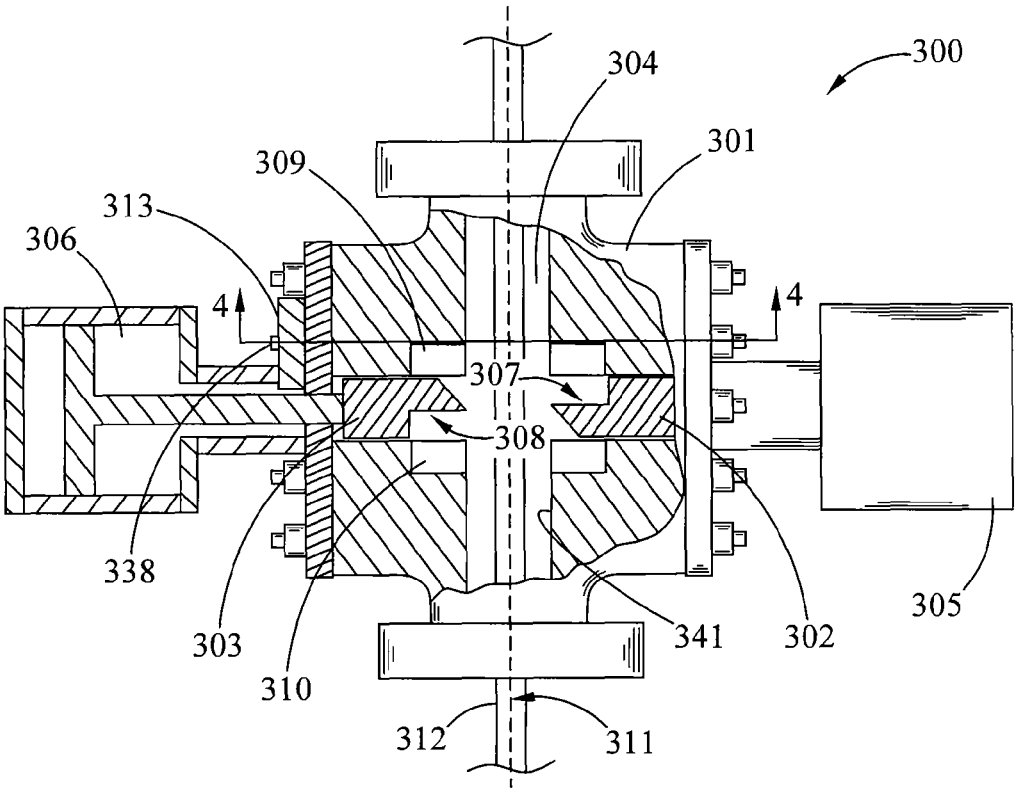
FIG. 3A is a partial cut away cross-sectional view of another embodiment of a laser shear ram assembly of the present invention.

In FIG. 3A there is shown an example of an embodiment of a laser shear ram assembly that could be used in a laser assisted BOP. Thus, there is shown a laser shear ram assembly 300 having a body 301. The body has a cavity 304, which cavity has a center axis 311 (dashed line) and a wall 341. The BOP cavity also has a vertical axis and in this embodiment the vertical axis and the center axis are the same, which is generally the case for BOPS. (The naming of these axes are based upon the configuration of the BOP and are relative to the BOP structures themselves, not the position of the BOP with respect to the surface of the earth. Thus, the vertical axis of the BOP will not change if the BOP for example were laid on its side.) Typically, the center axis of cavity 311 is on the same axis as the center axis of the wellhead cavity or opening through which tubulars are inserted into the borehole.

The body 301 contains and supports lower shear ram 302 and upper shear ram 303, which rams have piston assemblies 305 and 306 associated therewith. In operation, the piston assemblies 305, 306 drive the rams 302, 303 toward the center axis 311, engaging, cutting and moving through tubular 312, and sealing the cavity 304, and thus, the well. The body 301 also has a feed-through assembly 313 for managing pressure and permitting optical fiber cables and other cables, tubes, wires and conveyance means, which may be needed for the operation of the laser cutter, to be inserted into the body 301. The body houses an upper laser delivery assembly 309 and a lower laser delivery assembly 310.

Figure 3B:
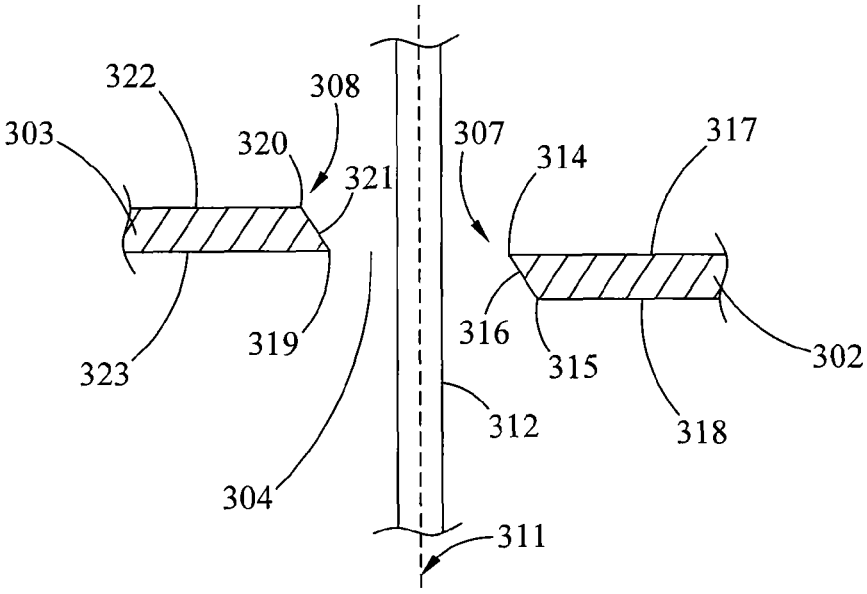
FIG. 3B is a detailed cross-sectional view of a portion of the ram of the laser shear ram assembly of FIG. 3A, taken along line 4-4 of FIG. 3A.

Turning to FIG. 3B there is shown a more detailed illustration of shear ram mating surfaces 308, 307 of the embodiment shown in FIG. 3A. Thus, mating surfaces 308 of upper shear ram 303 have an upper surface 322, a lower surface 323, a face 321, a leading edge 319, which edge is between the lower surface 323 and the face 321, and a trailing edge 320, which edge is between the upper surface 322 and the face 321. Mating surfaces 307 of lower shear ram 302 has an upper surface 317, a lower surface 318, a face 316, a leading edge 314, which edge is between the upper surface 317 and the face 316, and a trailing edge 315, which edge is between the face 316 and the lower surface 318.

FIGS. 4A to 4D, are cross-sectional views of the embodiment shown in FIGS. 3A and 3B taken along line 4-4 and show the sequences of operation of the laser shear ram assembly 300, in cutting the tubular 312 and sealing the cavity 304. In FIGS. 4A to 4D there is also shown further detail of the upper laser delivery assembly 309 of laser ram assembly 300. In this embodiment, lower laser assembly 310 could have similar components and configurations as upper laser delivery assembly 309. However, lower laser assembly 310 could have different configurations and more or fewer laser cutters.

The laser delivery assembly 309 has four laser cutters 326, 327, 328, and 329. Flexible support cables are associated with each of the laser cutters. Thus, flexible support cable 331 is associated with laser cutter 326, flexible support cable 332 is associated with laser cutter 327, flexible support cable 333 is associated with laser cutter 328, and flexible support cable 330 is associated with laser cutter 329. The flexible support cables are located in channel 339 and enter feed-through assembly 313. In the general area of the feed-through assembly 313, the support cables transition from flexible to semi-flexible, and may further be included in conduit 338 for conveyance to a high power laser, or other sources of materials for the cutting operation. The flexible support cables 330, 331, 332, and 333 have extra, or additional length, which accommodates the orbiting of the laser cutters 326, 327, 328 and 329 around the axis 311, and around the tubular 312.

Figure 4A:
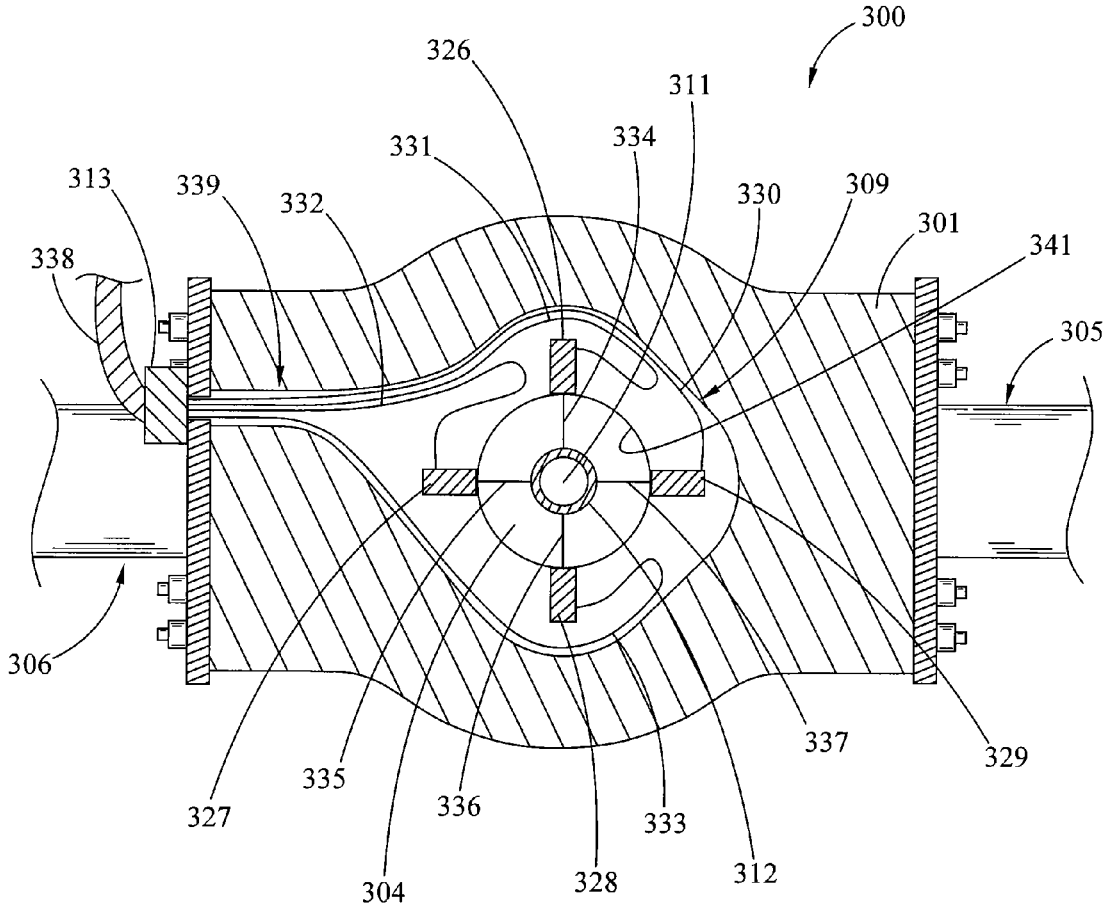
FIGS. 4A, 4B, 4C & 4D are transverse cross-sectional views of the embodiment of the laser shear ram assembly of FIG. 3A.

FIGS. 4A to 4D show the sequence of activation of the laser shear ram assembly 300 to sever a tubular 312 and seal off the cavity 304. In this example, the first view (e.g., a snap shot, since the sequence preferably is continuous rather than staggered or stepped) of the sequence is shown in FIG. 4A. As activated the four lasers cutters 326, 327, 328 and 329 shoot laser beams 334, 335, 336 and 337 respectively. The beams are directed toward the center axis 311. As such, the beams are shot from within the BOP, from outside of the cavity wall 341, and travel toward the center axis 311 of the BOP. The laser beams strike tubular 312 and begin cutting, i.e., removing material from, the tubular 312. If the cavity 304 is viewed as the face of a clock, the laser cutters 326, 327, 328 and 329 could be viewed as being initially positioned at 12 o'clock, 9 o'clock, 6 o'clock and 3 o'clock, respectively. Upon activation, the laser cutters and their respective laser beams, begin to orbit around the center axis 311, and the tubular 312. (In this configuration the laser cutters would also rotate about their own axis as they orbit, and thus, if they moved through one complete orbit they would also have moved through one complete rotation.) In the present example the cutters and beams orbit in a counter clockwise direction, as viewed in the figures; however, a clockwise rotation may also be used. As the laser beams are shot and the orbiting occurs, the shear rams 303, 302 are driven towards each other and toward the tubular 312.

Figure 4B:
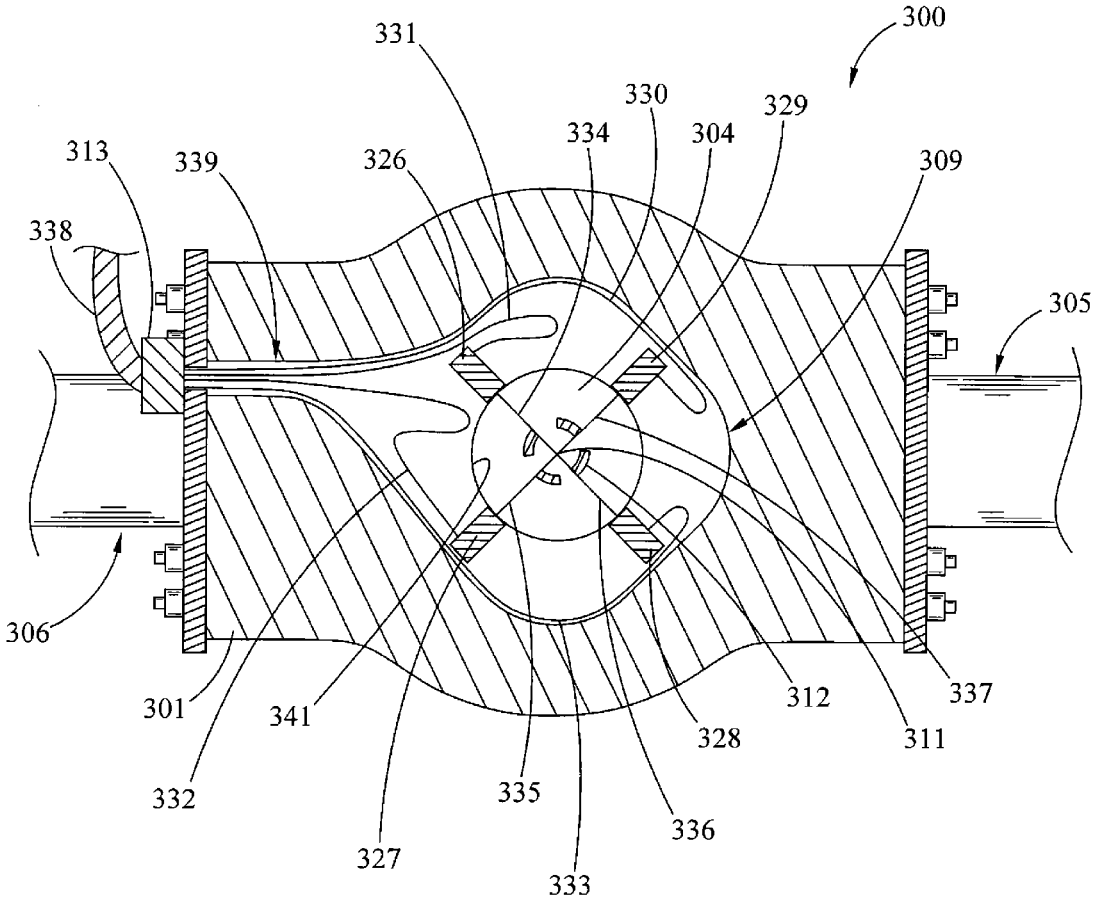
Figure 4C:
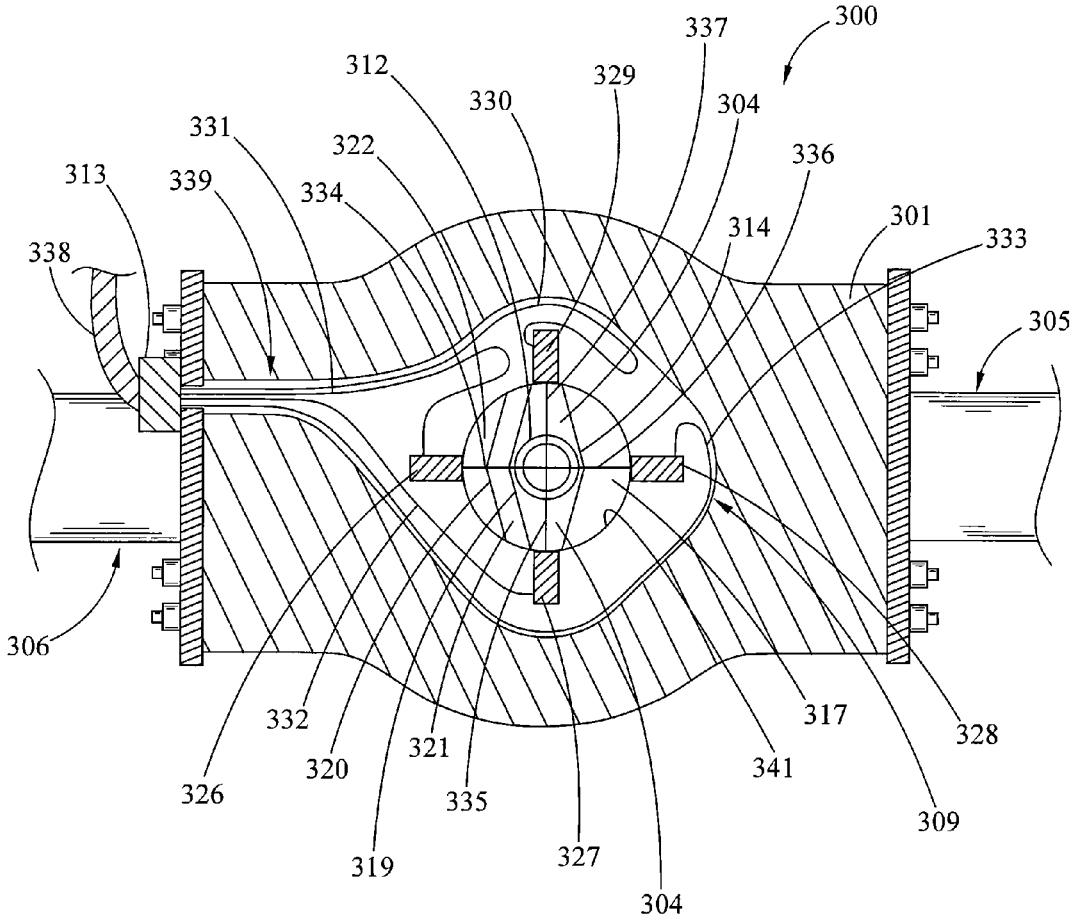

Thus, as seen in the next view of the sequence, FIG. 4B, the laser cutters, 326, 327, 328 and 329 have rotated 45 degrees, with laser beams that travel along beam paths 334,335, 336, and 337 having cut through four ⅛ sections (i.e., a total of half) of the circumference of the tubular 312. FIG. 4C then shows the cutter having moved through a quarter turn. Thus, in FIG. 4C, the lasers cutters, 326, 327, 328 and 329 have rotated a quarter turn, with the laser beams 334, 335, 336 and 337 having cut through the tubular 312. Thus, cutter 326 could be seen as having moved from the 12 o'clock position to 9 o'clock position, with the other cutters having similarly changed their respective clock face positions. There is further shown upper surface 322, trailing edge 320, face 321, and leading edge 319, of the upper ram and upper surface 317 and leading edge 314 of the lower ram as they approach and engage the tubular 312 and the area where the laser beams have cut the tubular.

Figure 4D:
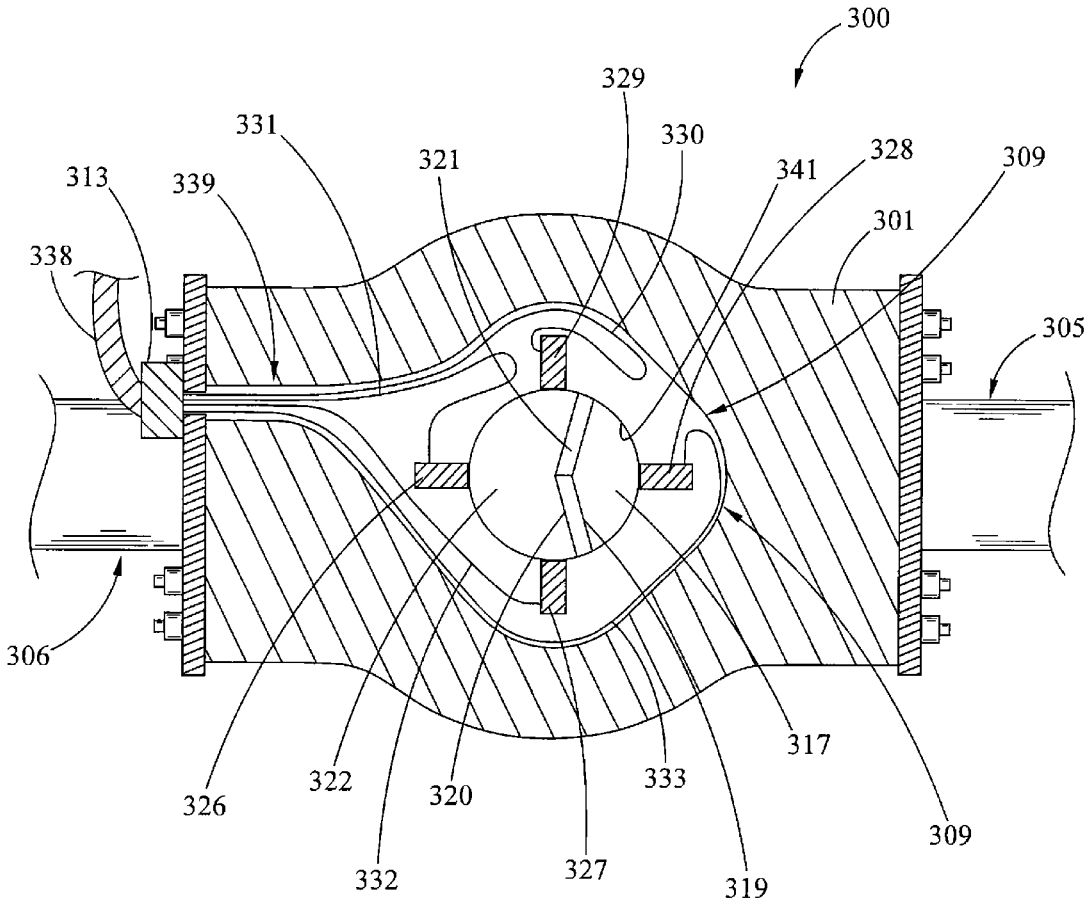

FIG. 4D then shows the last view of the sequence with the laser cutters having been deactivated and no longer shooting their laser beams and the shear rams in sealing engagement. The cavity 304 is completely filled and blocked by the shear rams 303, 302. As seen in FIG. 4C only upper surface 322, trailing edge 320, face 321 and leading edge 319 of the upper ram 303 and a portion of upper surface 317 of the lower ram 302, the other portions of upper surface 317 being in engagement with lower surface 323 of ram 302.

During the cutting operation, and in particular for circular cuts that are intended to sever the tubular, it is preferable that the tubular not move in a vertical direction. Thus, at or before the laser cutters are fired, the pipe rams, the annular preventer, or a separate holding device should be activated to prevent vertical movement of the pipe during the laser cutting operation.

The rate of the orbital movement of the laser cutters is dependent upon the number of cutters used, the power of the laser beam when it strikes the surface of the tubular to be cut, the thickness of the tubular to be cut, and the rate at which the laser cuts the tubular. The rate of the orbital motion should be slow enough to ensure that the intended cuts can be completed.

In addition to orbiting cutters, the laser beam can be scanned, e.g., moved in a fan like pattern. In this manner the beam path would be scanned along the area to be cut, e.g., an area of a tubular, while the cutter, or at least the base of the cutter, remained in a fixed position. This scanning of the laser beam can be accomplished, for example, by moving the cutter back and forth about a fixed point, e.g, like the movement of an oscillating fan. It may also be accomplished by having optics contained within the cutter that scans the beam path, e.g., a laser scanner, and thus the laser beam in the fan like pattern. For example a multi-faceted mirror or prim that is rotated may be utilized as a scanner. It should be noted, however, that scanning processes in general might be less efficient the other cutting approaches provided in this specification. Additional scanning patterns for the beam path and laser beam many also be employed to accomplished or address a specific cutting application or tubular configuration in a BOP cavity.

The orbital or other movement of the laser cutters can be accomplished by mechanical, hydraulic and electro-mechanical systems known to the art. For example, the cutters can be mounted to step motors that are powered by batteries, in the BOP, electrical cables from the surface, or both. The step motors may further have controllers associated with them, which controllers can be configured to control the step motors to perform specific movements corresponding to specific cutting steps. Cam operated systems may be employed to move the cutters through a cutting motion or cycle. The cams may be driven by electric motors, hydraulic motors, hydraulic pistons, or combinations of the forgoing, to preferably provide for back-up systems to move the cutters, should one motive means fail. A gearbox, a rack gear assembly, or combinations thereof may be utilized to provide cutter movement, in conjunction with an electric motor, hydraulic motor or piston assembly. The control system may be integral to the cutter motive means, such as a step motor control combination, may be part of the BOP, such as being contained with the other control system on the BOP, or it may be on the rig, or combinations of the forgoing.

The use of the term "completed" cut, and similar such terms, includes severing the tubular into two sections, i.e., a cut that is all the way through the wall and around the entire circumference of the tubular, as well as, cuts in which enough material is removed from the tubular to sufficiently weaken the tubular to ensure that the shear rams are in sealing engagement. Depending upon the particular configuration of the laser shear ram assembly, and the BOP's intended use, a completed cut could be, for example: severing the tubular into two separate sections; the removal of a ring of material around the outer portion of the tubular, from about 10% to about 90% of the wall thickness; a number of perforations created in the wall, but not extending through the wall of the tubular; a number of perforations going completely through the wall of the tubular; a number of slits created in the wall, but not extending through the wall of the tubular; a number of slits going completely through the wall of the tubular; the material removed by the shot patterns disclosed in this specification; or, other patterns of material removal and combinations of the foregoing. It is preferred that the complete cut is made in less than one minute, and more preferable that the complete cut be made in 30 seconds or less.

The rate of the orbital motion can be fixed at the rate needed to complete a cut for the most extreme tubular or combination of tubulars, or the rate of rotation could be variable, or predetermined, to match the particular tubular, or types of tubulars, that will be present in the BOP during a particular drilling operation.

The greater the number of laser cutters in a rotating laser delivery assembly, the slower the rate of orbital motion can be to complete a cut in the same amount of time. Further, increasing the number of laser cutters decreases the time to complete a cut of a tubular, without having to increase the orbital rate. Increasing the power of the laser beams will enable quicker cutting of tubulars, and thus allow faster rates of orbiting, fewer laser cutters, shorter time to complete a cut, or combinations thereof.

The laser cutters used in the examples and illustrations of the embodiments of the present inventions may be any suitable device for the delivery of high power laser energy. Thus, any configuration of optical elements for culminating and focusing the laser beam can be employed. A further consideration, however, is the management of the optical effects of fluids and materials that may be located within the annulus between the tubular and the BOP inner cavity wall.

Such drilling fluids could include, by way of example, water, seawater, salt water, brine, drilling mud, nitrogen, inert gas, diesel, mist, foam, or hydrocarbons. There can also likely be present in these drilling fluids borehole cuttings, e.g., debris, which are being removed from, or created by, the advancement of the borehole or other downhole operations. There can be present two-phase fluids and three-phase fluids, which would constitute mixtures of two or three different types of material. These drilling fluids can interfere with the ability of the laser beam to cut the tubular. Such fluids may not transmit, or may only partially transmit, the laser beam, and thus, interfere with, or reduce the power of, the laser beam when the laser beam is passed through them. If these fluids are flowing, such flow may further increase their non-transmissiveness. The non-transmissiveness and partial-transmissiveness of these fluids can result from several phenomena, including without limitation, absorption, refraction and scattering. Further, the non-transmissiveness and partial-transmissiveness can be, and likely will be, dependent upon the wavelength of the laser beam.

In an 18¾" BOP, i.e., the cavity or bore has a diameter of about 18¾," depending upon the configuration of the laser cutters and the size of the tubular in the cavity, the laser beam could be required to pass through over 6" of drilling fluids. In other configurations the laser cutters may be positioned in close, or very close, proximity to the tubular to be cut and moved in a manner where this close proximity is maintained. In these configurations the distance for the laser beam to travel between the laser cutters and the tubular to be cut may be maintained within about 2", less than about 2", less than about 1" and less than about ½", and maintained within the ranges of less than about 3" to less than about ½", and less than about 2" to less than about ½".

In particular, for those configurations and embodiments where the laser has a relatively long distance to travel, e.g., greater than about 1" or 2" (although this distance could be more or less depending upon laser power, wavelength and type of drilling fluid, as well as, other factors) it is advantageous to minimize the detrimental effects of such borehole fluids and to substantially ensure, or ensure, that such fluids do not interfere with the transmission of the laser beam, or that sufficient laser power is used to overcome any losses that may occur from transmitting the laser beam through such fluids. To this end, mechanical, pressure and jet type systems may be utilized to reduce, minimize or substantially eliminate the effect of the drilling fluids on the laser beam.

For example, mechanical devices such as packers and rams, including the annular preventer, may be used to isolate the area where the laser cut is to be performed and the drilling fluid removed from this area of isolation, by way of example, through the insertion of an inert gas, or an optically transmissive fluid, such as an oil or diesel fuel. The use of a fluid in this configuration has the added advantage that it is essentially incompressible. Moreover, a mechanical snorkel like device, or tube, which is filled with an optically transmissive fluid (gas or liquid) may be extended between or otherwise placed in the area between the laser cutter and the tubular to be cut. In this manner the laser beam is transmitted through the snorkel or tube to the tubular.

A jet of high-pressure gas may be used with the laser cutter and laser beam. The high-pressure gas jet may be used to clear a path, or partial path for the laser beam. The gas may be inert, or it may be air, oxygen, or other type of gas that accelerates the laser cutting. The relatively small amount of oxygen needed, and the rapid rate at which it would be consumed by the burning of the tubular through the laser-metal-oxygen interaction, should not present a fire hazard or risk to the drilling rig, surface equipment, personnel, or subsea components.

The use of oxygen, air, or the use of very high power laser beams, e.g., greater than about 1 kW, could create and maintain a plasma bubble or a gas bubble in the cutting area, which could partially or completely displace the drilling fluid in the path of the laser beam.

Variable ram preventers could be used in conjunction with oxygen (or air) and laser cutters. Thus, a single variable ram could be used to grasp and seal against a tubular in the BOP cavity. The variable ram would form a small cavity within the rams, when engaged against the tubular, which cavity would surround the tubular. This cavity could then have its pressure reduced to at or near atmospheric, by venting the cavity. Oxygen, or air, (or other gases or transmissive liquids) could be added to the cavity before the laser cutters, which would contained within the rams, are fired. In this manner the variable rams would have laser cutters therein, form an isolation cavity when engaged with a tubular, and provide a means to quickly cut the tubular with minimal interference from drilling fluids. Two variable rams, one above the other may also be used, if a larger isolation cavity is desirable, or if additional space is needed for the laser cutters. Moreover, although the cavity could be vented to at or about atmospheric pressure, an increased pressure may be maintained, to for example, reduce or slow the influx of any drilling fluid from within the tubular as it is being cut.

A high-pressure laser liquid jet, having a single liquid stream, may be used with the laser cutter and laser beam. The liquid used for the jet should be transmissive, or at least substantially transmissive, to the laser beam. In this type of jet laser beam combination the laser beam may be coaxial with the jet. This configuration, however, has the disadvantage and problem that the fluid jet does not act as a wave-guide. A further disadvantage and problem with this single jet configuration is that the jet must provide both the force to keep the drilling fluid away from the laser beam and be the medium for transmitting the beam.

A compound fluid laser jet may be used as a laser cutter. The compound fluid jet has an inner core jet that is surrounded by annular outer jets. The laser beam is directed by optics into the core jet and transmitted by the core jet, which functions as a waveguide. A single annular jet can surround the core, or a plurality of nested annular jets can be employed. As such, the compound fluid jet has a core jet. This core jet is surrounded by a first annular jet. This first annular jet can also be surrounded by a second annular jet; and the second annular jet can be surrounded by a third annular jet, which can be surrounded by additional annular jets. The outer annular jets function to protect the inner core jet from the drill fluid present in the annulus between the BOP cavity wall and the tubular. The core jet and the first annular jet should be made from fluids that have different indices of refraction. In the situation where the compound jet has only a core and an annular jet surrounding the core the index of refraction of the fluid making up the core should be greater than the index of refraction of the fluid making up the annular jet. In this way, the difference in indices of refraction enable the core of the compound fluid jet to function as a waveguide, keeping the laser beam contained within the core jet and transmitting the laser beam in the core jet. Further, in this configuration the laser beam does not appreciably, if at all, leave the core jet and enter the annular jet.

The pressure and the speed of the various jets that make up the compound fluid jet can vary depending upon the applications and use environment. Thus, by way of example the pressure can range from about 3000 psi, to about 4000 psi to about 30,000 psi, to preferably about 70,000 psi, to greater pressures. The core jet and the annular jet(s) may be the same pressure, or different pressures, the core jet may be higher pressure or the annular jets may be higher pressure. Preferably the core jet is higher pressure than the annular jet. By way of example, in a multi-jet configuration the core jet could be 70,000 psi, the second annular jet (which is positioned adjacent the core and the third annular jet) could be 60,000 psi and the third (outer, which is positioned adjacent the second annular jet and is in contact with the work environment medium) annular jet could be 50,000 psi. The speed of the jets can be the same or different. Thus, the speed of the core jet can be greater than the speed of the annular jet, the speed of the annular jet can be greater than the speed of the core jet and the speeds of multiple annular jets can be different or the same. The speeds of the core jet and the annular jet can be selected, such that the core jet does contact the drilling fluid, or such contact is minimized. The speeds of the jet can range from relatively slow to very fast and preferably range from about 1 ms (meters/second), to about 50 m/s, to about 200 m/s, to about 300 m/s and greater. The order in which the jets are first formed can be the core jet first, followed by the annular rings, the annular ring jet first followed by the core, or the core jet and the annular ring being formed simultaneously. To minimize, or eliminate, the interaction of the core with the drilling fluid, the annular jet is created first followed by the core jet.

In selecting the fluids for forming the jets and in determining the amount of the difference in the indices of refraction for the fluids the wavelength of the laser beam and the power of the laser beam are factors that should be considered. Thus, for example for a high power laser beam having a wavelength in the 1080 nm (nanometer) range the core jet can be made from an oil having an index of refraction of about 1.53 and the annular jet can be made from a mixture of oil and water having an index of refraction from about 1.33 to about 1.525. Thus, the core jet for this configuration would have an NA (numerical aperture) from about 0.95 to about 0.12, respectively. Further details, descriptions, and examples of such compound fluid laser jets are contained in Zediker et. al, Provisional U.S. Patent Application Ser. No. 61/378,910, titled Waveguide Laser Jet and Methods of Use, filed Aug. 31, 2010, the entire disclosure of which is incorporated herein by reference. It is to be noted that said incorporation by reference herein does not provide any right to practice or use the inventions of said application or any patents that may issue therefrom and does not grant, or give rise to, any licenses thereunder.

In addition to the use of high power laser beams to cut the tubulars, other forms of directed energy or means to provide the same, may be utilized in the BOP stack. Such directed energy means would include plasma cutters, arc cutters, high power water jets, and particle water jets. Each of these means, however, has disadvantages when compared to high power laser energy. In particular, high power laser energy has greater control, reliability and is substantially potentially less damaging to the BOP system components than are these other means. Nevertheless, the use of these others less desirable means is contemplated herein by the present inventions as a directed energy means to cut tubulars within a BOP cavity.

Figures 23, 23A, 23B:
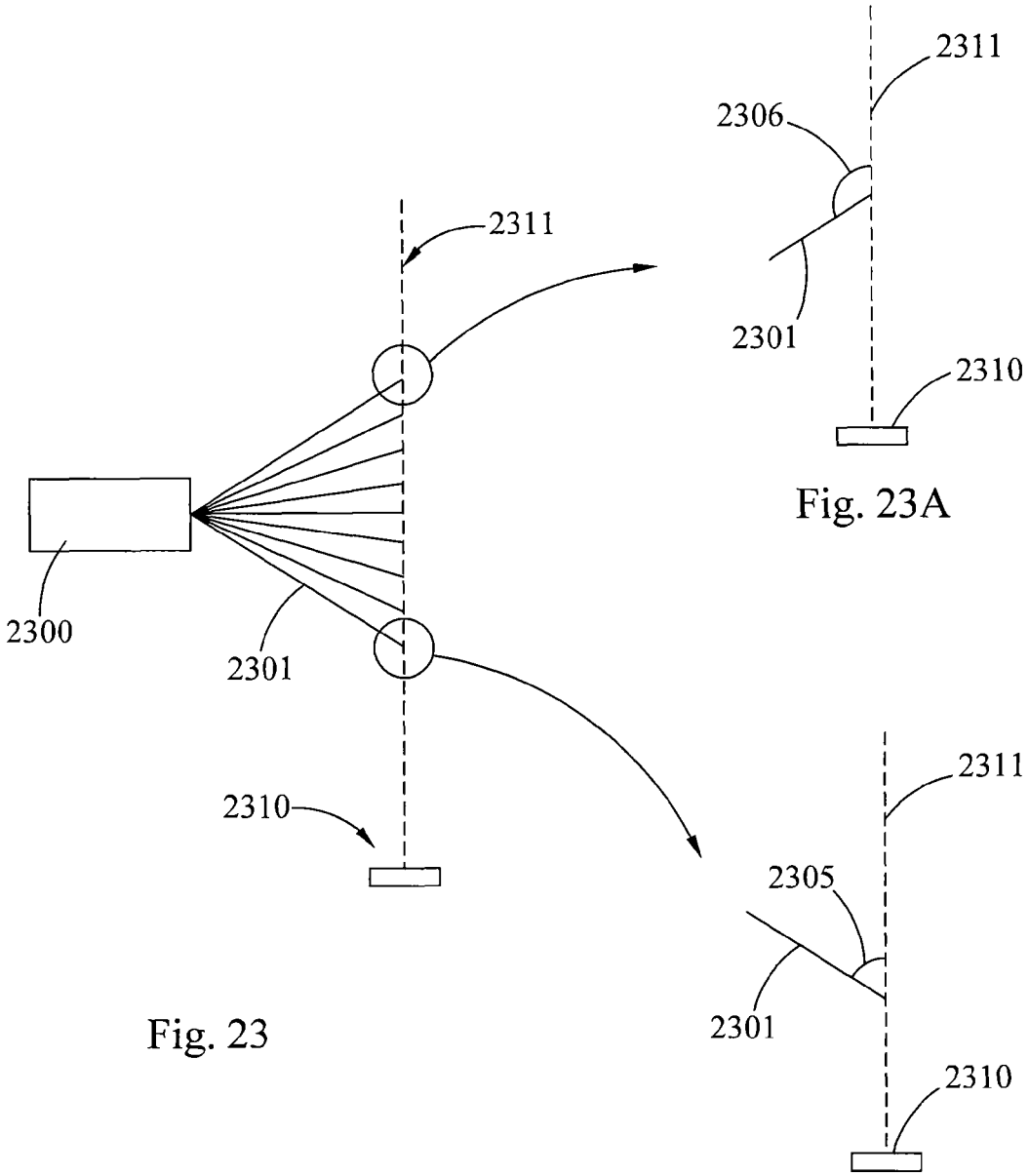
FIGS. 23 to 23B is a schematic illustration of laser beam paths of the present invention.

The angle at which the laser beam contacts the tubular may be determined by the optics within the laser cutter or it may be determined by the angle or positioning of the laser cutter itself. In FIG. 23 there is shown a schematic representation of a laser cutter 2300 with a beam path 2301 leaving the cutter at various angles. When a laser beam is propagated, e.g., fired or shot from the laser cutter, the laser beam would travel along a beam path. The beam path is further shown in relation to the BOP cavity vertical axis (dashed line) 2311. As seen in the enlarged views of FIGS. 23A and 23B, the angle that the beam path 2301 forms with vertical axis 2311, and thus the angle that a laser beam traveling along this beam path forms with vertical axis 2311, can be an acute angle 2305 or an obtuse angle 2306 relative to the portion of the axis 2311 furthest away from the wellhead connection side 2310. A normal or 90° angle may also be utilized. The BOP wellhead connection side 2310 is shown in the Figures as a reference point for the angle determinations used herein.

The laser cutters have a discharge end from which the laser beam is propagated. The laser cutters also have a beam path. The beam path is defined by the path that the laser beam is intended to take, and extends from the discharge end of the laser cutter to the material or area to be cut; and potentially beyond.

The angle between the beam path (and a laser beam traveling along that beam path) and the BOP vertical axis, corresponds generally to the angle at which the beam path and the laser beam will strike a tubular that is present in the BOP cavity. However, using a reference point that is based upon the BOP to determine the angle is preferred, because tubulars may shift or in the case of joints, or a damaged tubular, present a surface that has varying planes that are not parallel to the BOP cavity center axis.

Because the angle formed between the laser beam and the BOP vertical axis can vary, and be predetermined, the laser cutter's position, or more specifically the point where the laser beam leaves the cutter does not necessarily have to be normal to the area to be cut. Thus, the laser cutter position or the beam launch angle can be such that the laser beam travels from: above the area to be cut, which would result in an acute angle being formed between the laser beam and the BOP vertical axis; the same level as the area to be cut, which would result in a 90° angle being formed between the laser beam and the BOP vertical axis; or, below the area to be cut, which would result in an obtuse angle being formed between the laser beam and the BOP cavity vertical axis. In this way, the relationship between the shape of the rams, the surfaces of the rams, the forces the rams exert, and the location of the area to be cut by the laser can be evaluated and refined to optimize the relationship of these factors for a particular application.

The ability to predetermine the angle that the laser beam forms with the BOP vertical axis provides the ability to have specific and predetermined shapes to the end of a severed tubular. Thus, if the laser beam is coming from above the cutting area an inward taper can be cut on the upper end of the lower piece of the severed tubular. If the laser beam is coming from below the area to be cut an outward taper can be cut on the upper end of the lower piece of the severed tubular. If the laser beam is coming from the same level as the cutting area no taper will be cut on the ends of the severed tubulars. These various end shapes for the severed lower tubular maybe advantageous for attaching various types of fishing tools to that tubular to remove it from the well at some later point in time.

The number of laser cutters utilized in a configuration of the present inventions can be a single cutter, two cutters, three cutters, and up to and including 12 or more cutters. As discussed above, the number of cutters depends upon several factors and the optimal number of cutters for any particular configuration and end use may be determined based upon the end use requirements and the disclosures and teachings provided in this specification.

Examples of laser power, fluence and cutting rates, based upon published data, are set forth in Table I.

TABLE I

| type | thickness (mm) | laser power (watts) | spot size (microns) | Laser fluence ($MW/cc^2$) | gas | cutting rate (m/min) |
|---|---|---|---|---|---|---|
| mild steel | 15 | 5,000 | 300 | 7.1 | $O_2$ | 1.8 |
| stainless steel | 15 | 5,000 | 300 | 7.1 | $N_2$ | 1.6 |

The flexible support cables for the laser cutters provide the laser energy and other materials that are needed to perform the cutting operation. Although shown as a single cable for each laser cutter, multiple cables could be used. Thus, for example, in the case of a laser cutter employing a compound fluid laser jet the flexible support cable would include a high power optical fiber, a first line for the core jet fluid and a second line for the annular jet fluid. These lines could be combined into a single cable or they may be kept separate. Additionally, for example, if a laser cutter employing an oxygen jet is utilized, the cutter would need a high power optical fiber and an oxygen line. These lines could be combined into a single cable or they may be kept separate as multiple cables. The lines and optical fibers should be covered in flexible protective coverings or outer sheaths to protect them from borehole fluids, the BOP environment, and the movement of the laser cutters, while at the same time remaining flexible enough to accommodate the orbital movement of the laser cutters. As the support cables near the feed-through assembly the flexibility decreases and more rigid means to protect them can be employed. For example, the optical fiber may be placed in a metal tube. The conduit that leaves the feed-through assembly adds additional protection to the support cables, during assembly of the BOP, handling of the BOP, deployment of the BOP, and from the environmental conditions at the seafloor.

It is preferable that the feed-through assemblies, the conduits, the support cables, the laser cutters and other subsea components associated with the operation of the laser cutters, should be constructed to meet the pressure requirements for the intended use of the BOP. The laser cutter related components, if they do not meet the pressure requirements for a particular use, or if redundant protection is desired, may be contained in or enclosed by a structure that does meet the requirements. Thus, if the BOP is rated at 10,000 psi these components should be constructed to withstand that pressure. For deep and ultra-deep water uses the laser cutter related components should preferably be capable of operating under pressures of 15,000 psi, 20,000 psi or greater. The materials, fittings, assemblies, useful to meet these pressure requirements are known to those of ordinary skill in the offshore drilling arts, related sub-sea Remote Operated Vehicle ("ROV") art, and in the high power laser art.

Figure 5:
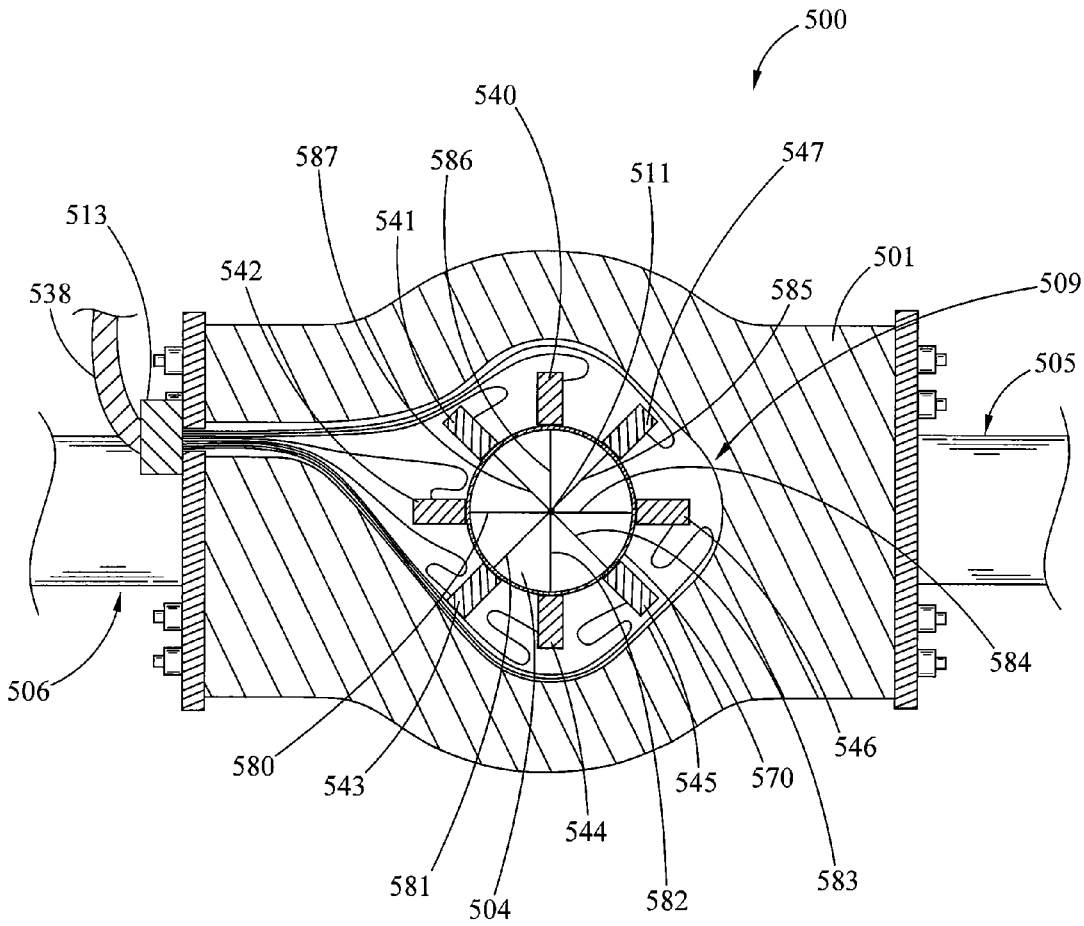
FIG. 5 is a transverse cross-sectional view of another embodiment of a laser shear ram assembly of the present invention.

In FIG. 5 there is shown an example of an embodiment of a laser ram assembly that could be used in a laser assisted BOP. Thus, there is shown a laser shear ram assembly 500 having a body 501. The body has a cavity 504, which cavity has a center axis 511. The body 501 also has a feed-through assembly 513 for managing pressure and permitting optical fiber cables and other cables, tubes, wires and conveyance means, which may be needed for the operation of the laser cutter, to be inserted into the body 501. Ram piston assemblies 505, 506, which are partially shown in this Figure, are associated with the body 501. The body houses a laser delivery assembly 509. The laser delivery assembly 509 has eight laser cutters 540, 541, 542, 543, 544, 545, 546 and 547. Flexible support cables are associated with each of the laser cutters. The flexible support cables have sufficient length to accommodate the orbiting of the laser cutters around the center axis 511. In this embodiment the cutters need only go through ⅛ of a complete orbit to obtain a cut around the entire circumference of a tubular. The flexible support cables are located in a channel and enter feed-through assembly 513. Feed-through assembly is pressure rated to the same level as the BOP, and thus should be capable of withstanding pressures of 5,000 psi, 10,000 psi, 15,000 psi, 20,000 psi and greater. In the general area of the feed-through assembly 513 the support cables transition from flexible to semi-flexible, and may further be included in conduit 538 for conveyance to a high power laser, or other sources.

There is also provided a shield 570. This shield 570 protects the laser cutters and the laser delivery assembly from drilling fluids and the movement of tubulars through the BOP cavity. Is it preferably positioned such that it does not extend into, or otherwise interfere with, the BOP cavity or the movement of tubulars through that cavity. It is preferably pressure rated at the same level as the other BOP components. Upon activation, it may be mechanically or hydraulically moved away from the laser beam's path or the laser beam may propagate through it, cutting and removing any shield material that initially obstructs the laser beam. Upon activation the lasers cutters propagate laser beams (which also may be referred to as shooting the laser or firing the laser to create a laser beam) from outside of the BOP cavity into that cavity and toward any tubular that may be in that cavity. Thus, there are laser beam paths 580, 581, 582, 583, 584, 585, 586, and 587, which paths rotate around center axis 511 during operation.

In general, operation of a laser assisted BOP stack where at least one laser beam is directed toward the center of the BOP and at least one laser cutter is configured to orbit (partially or completely) around the center of the BOP to obtain circumferential cuts, i.e., cuts around the circumference of a tubular (including slot like cuts that extend partially around the circumference, cuts that extend completely around the circumference, cuts that go partially through the tubular wall thickness, cut that go completely through the tubular wall thickness, or combinations of the foregoing) may occur as follows. Upon activation, the laser cutter fires a laser beam toward the tubular to be cut. At a time interval after the laser beam has been first fired the cutter begins to move, orbiting around the tubular, and thus the laser beam is moved around the circumference of the tubular, cutting material away from the tubular. The laser beam will stop firing at the point when the cut in the tubular is completed. At some point before, during, or after the firing of the laser beam, ram shears are activated, severing, displacing, or both any tubular material that may still be in their path, and sealing the BOP cavity and the well.

Figure 6:
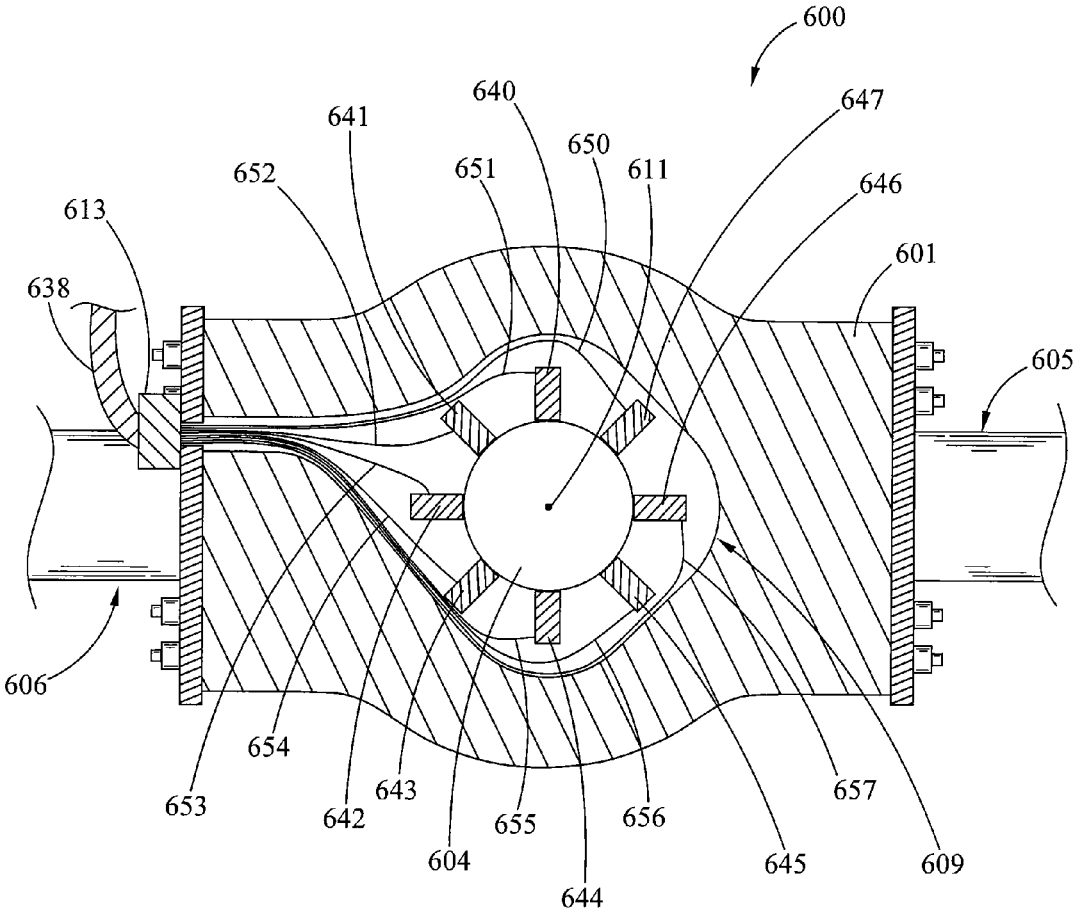
FIG. 6 is a transverse cross-sectional view of another embodiment of a laser shear ram assembly of the present invention.

In FIG. 6 there is shown an example of an embodiment of a laser ram assembly, having fixed laser cutters, for use in a laser assisted BOP. Thus, there is shown a laser shear ram assembly 600 having a body 601. The body has a cavity 604, which cavity has a center axis 611. The body 601 also has a feed-through assembly 613 for managing pressure and permitting optical fiber cables and other cables, tubes, wires and conveyance means, which may be needed for the operation of the laser cutter, to be inserted into the body 601. Ram piston assemblies 605, 606, which are partially shown in this Figure, are associated with the body 601. The body houses a laser delivery assembly 609. The laser delivery assembly 609 has eight laser cutters 640, 641, 642, 643, 644, 645, 646 and 647.

In this embodiment the cutters do not orbit or move. The cutters are configures such that their beam paths (not shown) are radially distributed around and through the center axis 611. Support cables 650, 651, 652, 653, 654, 655, 656 and 657 are associated with each of the laser cutters 640, 641, 642, 643, 644, 645, 646 and 647. The support cables in this embodiment do not need to accommodate the orbiting of the laser cutters around the center axis 611, because the laser cutters are fixed and do not orbit. Further, because the laser cutters are fixed the support cables 650, 651, 652, 653, 654, 655, 656 and 657 may be semi-flexible or ridged and the entire assembly 609 may be contained within an epoxy of other protective material. The support cables are located in a channel and enter feed-through assembly 613. Feed-through assembly is pressure rated to the same level as the BOP, and thus should be capable of withstanding pressures of 5,000 psi, 10,000 psi, 15,000 psi, 20,000 psi and greater. In the general area of the feed-through assembly 613 the support cables transition from flexible to semi-flexible, and may further be included in conduit 638 for conveyance to a high power laser, or other sources. A shield, such as the shield 570 in FIG. 5, may also be used with this and other embodiments, but is not shown in this Figure.

Although eight evenly spaced laser cutters are shown in the example of a fixed laser cutter embodiment in FIG. 6, other configurations are contemplated. Fewer or more laser cutters may be used. The cutters may be positioned such that their respective laser beam paths are parallel, or at least non-intersecting within the BOP, instead of radially intersecting each other, as would be the case for the embodiment shown in FIG. 6.

In the operation of such fixed laser cutter embodiments, the laser cutters would fire laser beams, along beam paths. The beam paths do not move with respect to the BOP. The laser beams would cut material from the tubular substantially weakening it and facilitating the severing and displacement of the tubular by the shear ram. Depending upon the placement of the laser beams on the tubular, the spot size of the laser beams on the tubular, and the power of the laser beam on the tubular, the cutters could quickly sever the tubular into two sections. If such a severing laser cut is made above the shear rams, the lower section of the tubular may drop into the borehole, provided that there is sufficient space at the bottom of the borehole, and thus out of the path of the shear rams, a blind ram, or both. A similar cut, which completely severs the tubular into two pieces, could be made by the orbiting cutter embodiments, for example the embodiment shown in FIG. 3A, and some of the ram laser cutter embodiments, for example the embodiment shown in FIG. 10A, and other embodiment of the present inventions.

Figure 7:
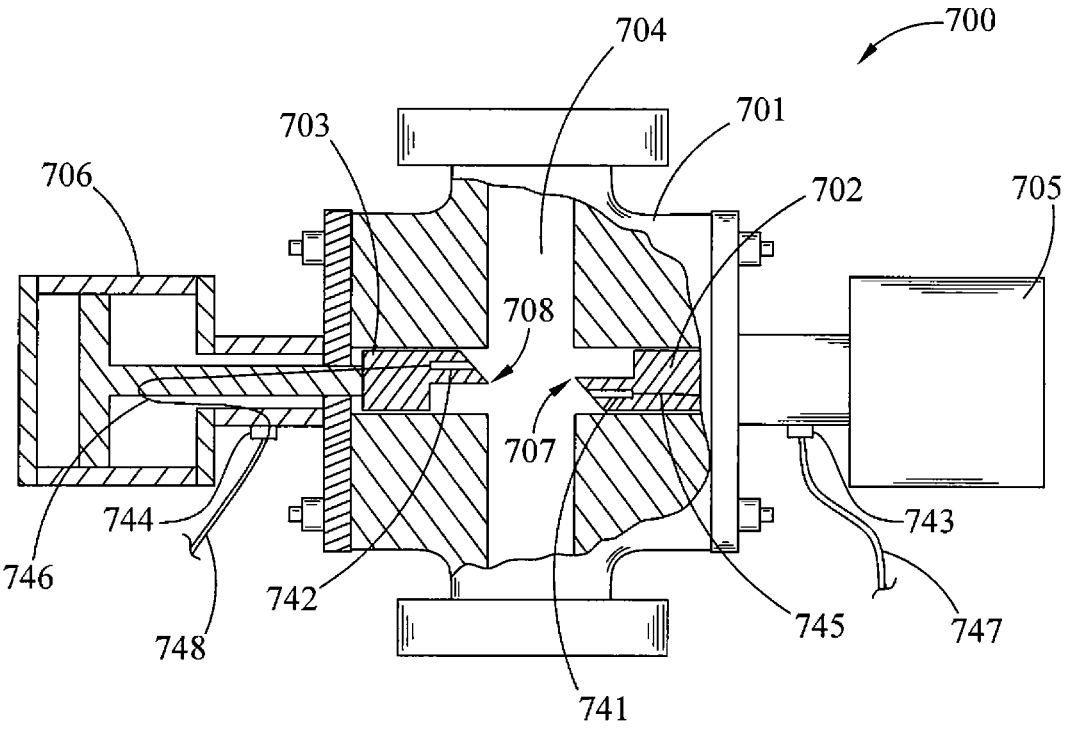
FIG. 7 is a partial cut away cross-sectional view of another embodiment of a laser shear ram assembly of the present invention.

Turning to FIG. 7 there is shown an example of an embodiment of a laser shear ram assembly that could be used in a laser assisted BOP. The laser shear ram assembly 700 has a body 701. The body 701 has a lower shear ram 702, (closer to the wellhead) and an upper shear ram 703 that upon activation are forced into inner cavity 704 by lower piston assembly 705 and upper piston assembly 706. There is also provided laser delivery assemblies 741, 742. Laser delivery assemblies 741, 742 are located in rams 702, 703 respectively. The laser delivery assemblies 741, 742 have flexible support cables 745, 746 respectively, which pass through feed-through assemblies 743, 744 respectively, into conduits 747, 748 respective, which conduits are optically associated with at least one high power laser source. The feed-through assemblies as well as all places where the flexible support cable passes through should be pressure rated to meet the requirements of the BOP and specifically the pressure requirements associated with the structures through which the cable is passed. Sufficient lengths of the flexible support cables 745, 746 are provided to accommodate the movement of the shear rams 702, 703 and the piston assemblies 705,706.

During drilling and other activities tubulars, not shown in FIG. 7, are typically positioned within the inner cavity 704. When tubulars are present in the cavity 704, upon activation of the laser shear ram assembly 700, the laser delivery assemblies 741, 742 deliver high power laser energy to the tubular located in the cavity 704. The high power laser energy cuts the tubular completely, or at a minimum weakens the tubular, to permit the shear rams 702, 703 to quickly seal-off the cavity 704, moving the tubular sections out of the way of the shear rams if completely cut by the laser energy, or cutting the tubular if only weakened by the laser and moving the tubular sections out of the way of the shear rams, and thus, assuring that the shear rams surface 707, 708 engage, seal, and thus, seal-off the BOP cavity 704 and the well.

By having the laser delivery assemblies in the rams, such as laser delivery assemblies 741, 742 of the embodiment seen in FIG. 7, the distance of the laser beam path through any drilling fluids can be greatly reduced if not eliminated. Thus, the firing of the laser beam may be delayed until the rams are very close to, or touching, the tubular to be cut.

Shields for the laser cutters or laser delivery assemblies may also be used with laser ram configurations, such as the embodiment shown in FIG. 7, where the cutters or assemblies are located in the rams. Thus, such shields may be associated with the ram faces and removed upon activation or cut through by the laser beam.

Figure 8:
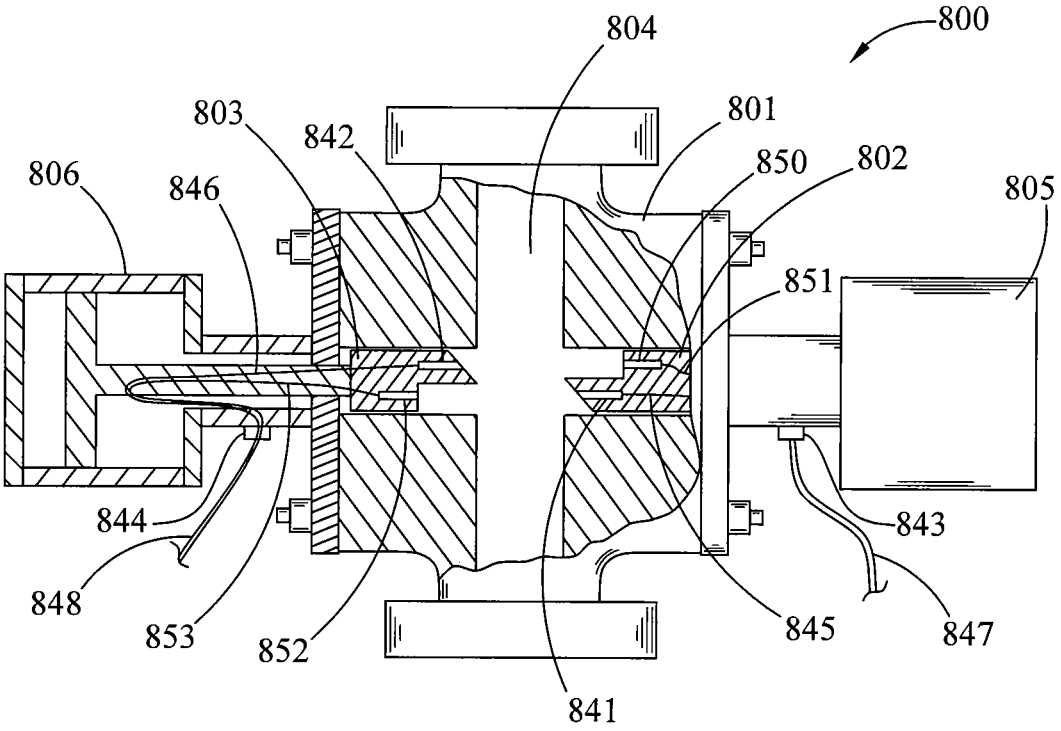
FIG. 8 is a partial cut away cross-sectional view of another embodiment of a laser shear ram assembly of the present invention.

Turning to FIG. 8 there is shown an example of an embodiment of a laser shear ram assembly that could be used in a laser assisted BOP. The laser shear ram assembly 800 has a body 801. The body 801 has a lower shear ram 802, (closer to the wellhead) and an upper shear ram 803 that upon activation are forced into inner cavity 804 by lower piston assembly 805 and upper piston assembly 806. There is also provided laser delivery assemblies 841, 842, 850, 852. Laser delivery assemblies 841, 850 are located in ram 802. Laser delivery assemblies 842, 852 are located in ram 803. The laser delivery assemblies 841, 842, 850, 852 have flexible support cables 845, 846, 851, 853, which pass through feed-through assemblies 843 (cables 845, 851), 844 (cables 846, 853), into conduits 847, 848 respective, which conduits are optically associated with at least one high power laser source. The feed-through assemblies, as well as, all places where the flexible support cable passes through should be pressure rated to meet the requirements of the BOP and specifically the pressure requirements associated with the structures through which the cable is passed. Sufficient lengths of the flexible support cables 845, 846, 851, 853 are provided to accommodate the movement of the shear rams 802, 803 and the piston assemblies 805, 806.

During drilling and other activities tubulars, not shown in FIG. 8, are typically positioned within the inner cavity 804. When tubulars are present in the cavity 804, upon activation of the laser shear ram assembly 800, the laser delivery assemblies 841, 842, 850, 852 deliver high power laser energy to the tubular located in the cavity 804. The high power laser energy cuts the tubular completely, or at a minimum weakens the tubular, to permit the shear rams 802, 803 to quickly seal-off the cavity 804, moving the tubular sections out of the way of the shear rams if completely cut by the laser energy, or cutting the tubular if only weakened by the laser and moving the tubular sections out of the way of the shear rams, and thus, assuring that the shear rams engage, seal, and thus, seal-off the BOP cavity 804 and the well. In this embodiment should the rams not be able to completely cut through or otherwise seal the laser delivery assemblies 850 and 852 could be repeatedly fired to remove any material obstructing the sealing of the rams.

Figure 9:
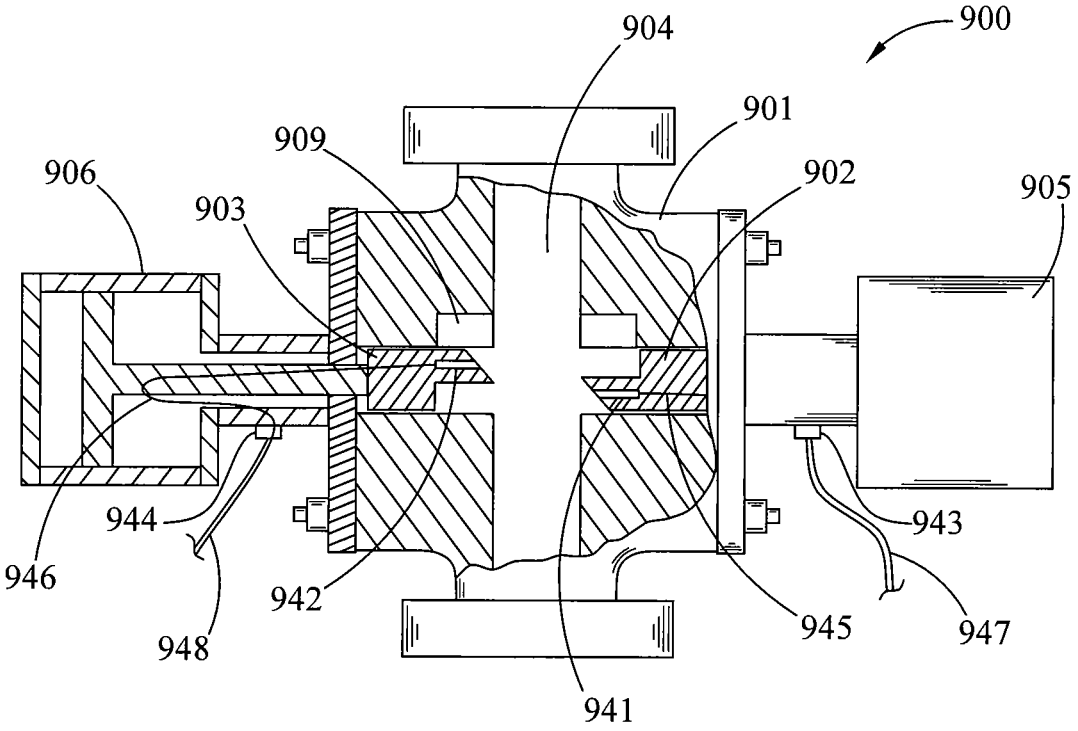
FIG. 9 is a partial cut away cross-sectional view of another embodiment of a laser shear ram assembly of the present invention.

Turning to FIG. 9 there is shown an example of an embodiment of a laser shear ram assembly that could be used in a laser assisted BOP. The laser shear ram assembly 900 has a body 901. The body 901 has a lower shear ram 902, (closer to the wellhead) and an upper shear ram 903 that upon activation are forced into inner cavity 904 by lower piston assembly 905 and upper piston assembly 906. There is also provided laser delivery assemblies 941, 942, and 909. Laser delivery assemblies 941, 942 are located in rams 902, 903. Laser delivery assembly 909 is located in body 901. Laser delivery assemblies 941, 942 have flexible support cables 945, 946 respectively, which pass through feed-through assemblies 943, 944, into conduits 947, 948 respective, which conduits are optically associated with at least one high power laser source. Laser assembly 909 has flexible support cables and a feed-through assembly associated therewith, but which are not shown in the Figure. Laser assembly 909 can be of any type of laser assembly shown or taught for use in the body by in the present specification, such as for example the assemblies in embodiments shown in FIG. 4A, 5 or 6. The feed-through assemblies, as well as, all places where the flexible support cable passes through, should be pressure rated to meet the requirements of the BOP and specifically the pressure requirements associated with the structures through which the cable is passed. Sufficient lengths of the flexible support cables 945, 946 are provided to accommodate the movement of the shear rams 902, 903 and the piston assemblies 905, 906.

During drilling and other activities tubulars, not shown in FIG. 9, are typically positioned within the inner cavity 904. When tubulars are present in the cavity 904, upon activation of the laser shear ram assembly 900, the laser delivery assemblies 941, 942, 909 deliver high power laser energy to the tubular located in the cavity 904. The high power laser energy cuts the tubular completely, or at a minimum weakens the tubular, to permit the shear rams 902, 903 to quickly seal-off the cavity 904, moving the tubular sections out of the way of the shear rams if completely cut by the laser energy, or cutting the tubular if only weakened by the laser and moving the tubular sections out of the way of the shear rams, and thus, assuring that the shear rams engage, seal, and thus, seal-off the BOP cavity 904 and the well.

Figure 14:
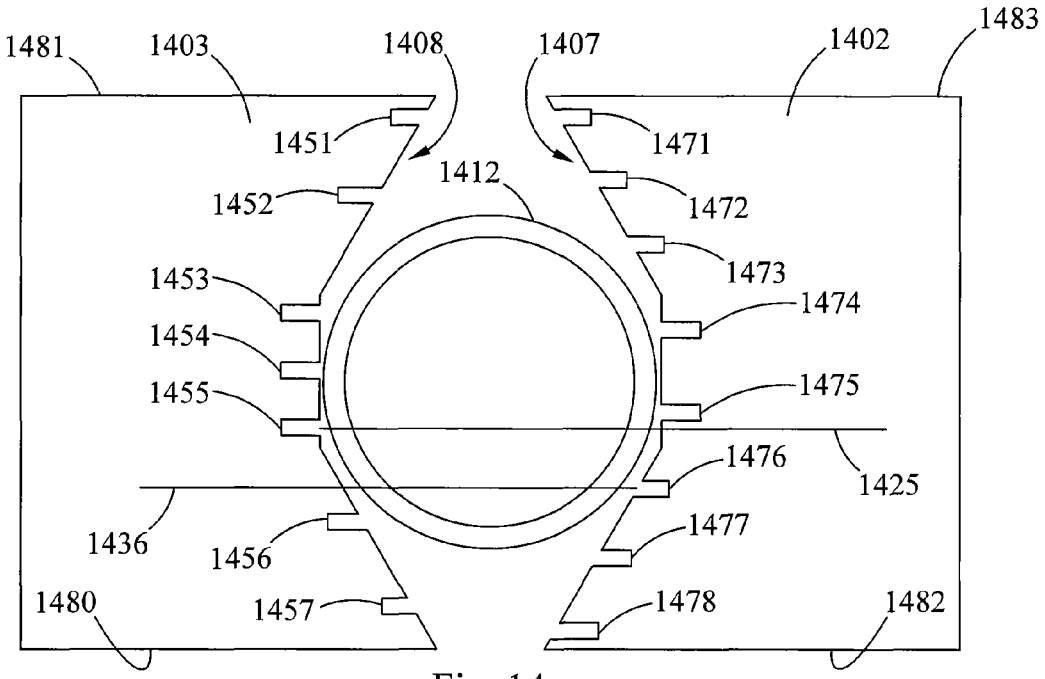
FIG. 14 is a plan schematic view of a pair of opposed laser shear rams of the present invention having laser cutters.
Figure 15:
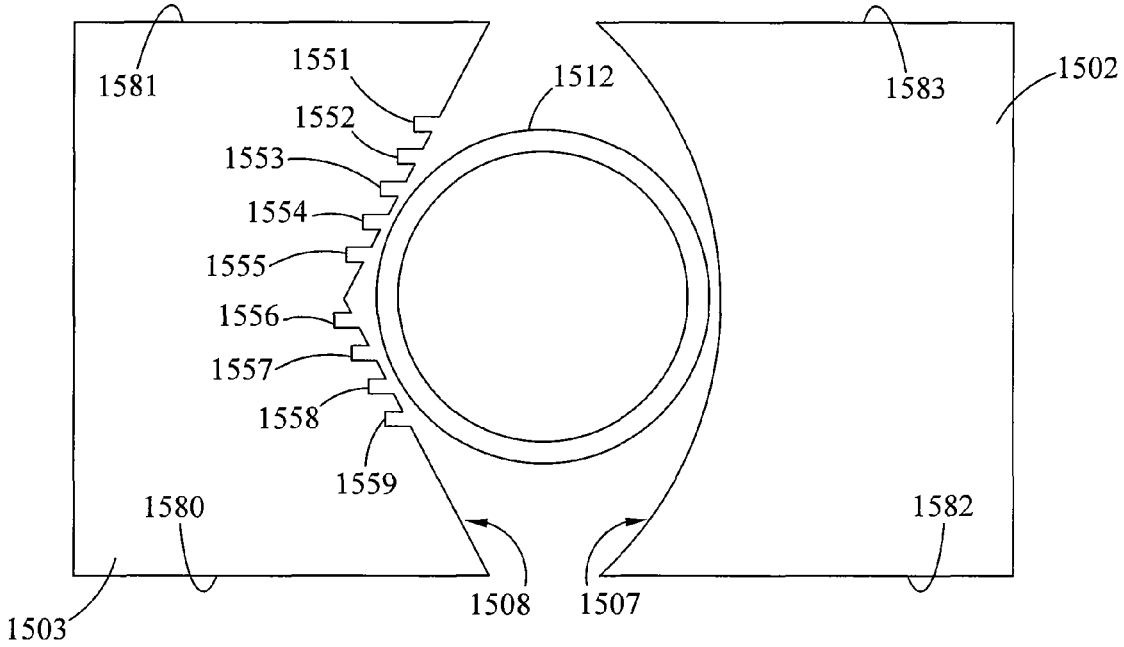
FIG. 15 is a plan schematic view of a pair of opposed laser shear rams of the present invention having laser cutters in one of the rams.

FIGS. 10A-C, 11A-C, 12A-C, 13A-C, 14 and 15 show illustrative examples of configurations of laser cutters for laser assemblies in shear rams. Although some of these figures could be viewed as an upper ram, and in some of these figures upper and lower rams are designated, these figures and their teachings are applicable to upper and lower rams, and various locations in those rams, such as for example the locations of assemblies 850 and 841 of the embodiment shown in FIG. 8. Further, fewer or greater numbers of laser cutters may be used, the locations of the cutters may be varied, the position of the cutters may be uniformly or non-uniformly distributed across the face of the ram, and other variations of laser cutter placement may be employed. Further, these rams or the laser cutters may also have shields associated with them, to protect the cutters from borehole fluids and tubulars. FIGS. 14 and 15 also provide examples of the various shapes that the mating surfaces of a shear ram may employ. The laser shear rams of the present invention may utilize any mating surface shape now known to the art or later developed.

Figure 10B:
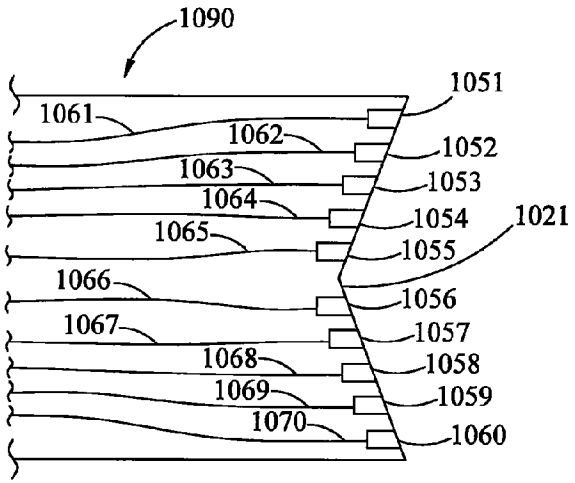
FIGS. 10A, 10B & 10C are views of a section of a laser shear ram of the present invention having laser cutters.
Figure 10A:
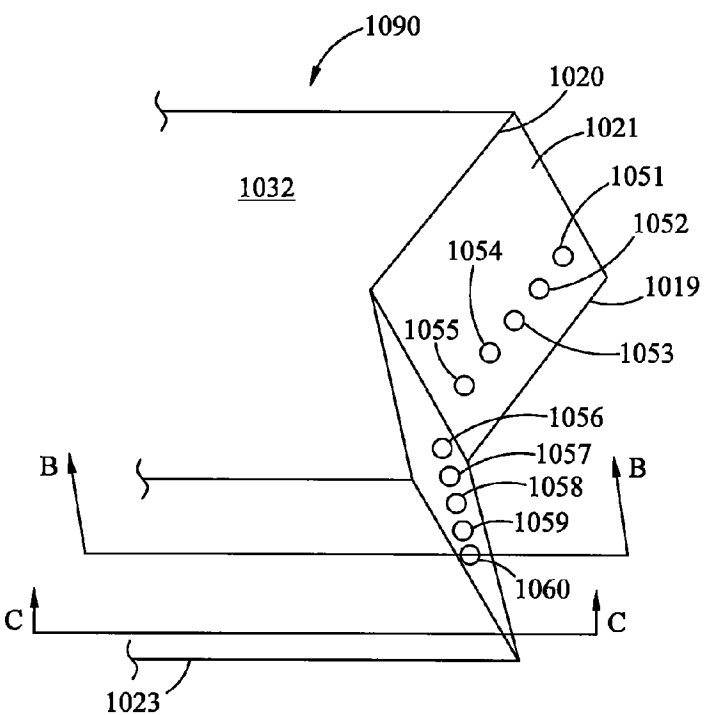
Figure 10C:
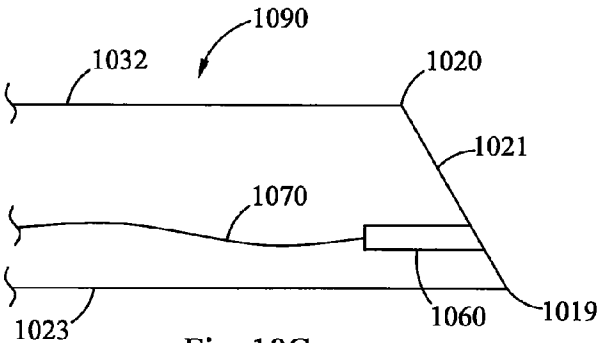

In FIGS. 10A-10C there is shown a configuration of laser cutters in a shear ram, only the leading portion, e.g., the portion intend to engage a tubular, of the ram is shown. Specifically, FIG. 10A shows a perspective view of the ram. FIG. 10B shows transverse cross-sectional view taken along line B-B of FIG. 10A and FIG. 10C of FIG. 10A shows a vertical cross-sectional view taken along line C-C. The shear ram shear 1090 has a trailing edge 1020, a trailing edge surface 1032, a leading edge 1019, a leading edge surface 1023, and a face surface 1021 positioned between and connecting the leading edge 1019 and the trailing edge 1020. The shear ram 1090 has 10 laser cutters 1051, 1052, 1053, 1054, 1055, 1056, 1057, 1058, 1059 and 1060. These laser cutters are positioned on the face surface 1021 about ⅓ to ¼ of the way along the face from the leading edge 1019, as is generally depicted in the figures. Each of the laser cutters 1051, 1052, 1053, 1054, 1055, 1056, 1057, 1058, 1059 and 1060 has a support cable 1061, 1062, 1063, 1064, 1064, 1065, 1066, 1067, 1068, 1069 and 1070 associated with it. The laser cutters are also essentially evenly spaced across the face surface 1021.

Figure 11B:
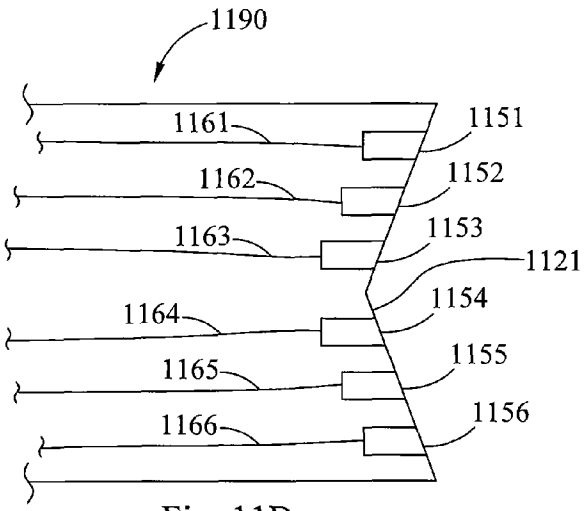
FIGS. 11A, 11B & 11C are views of a section of another laser shear ram of the present invention having laser cutters.
Figure 11A:
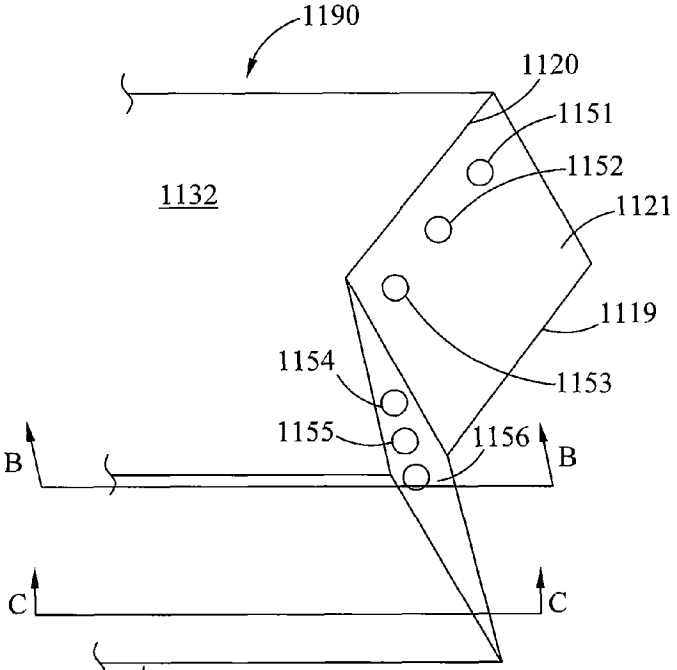
Figure 11C:
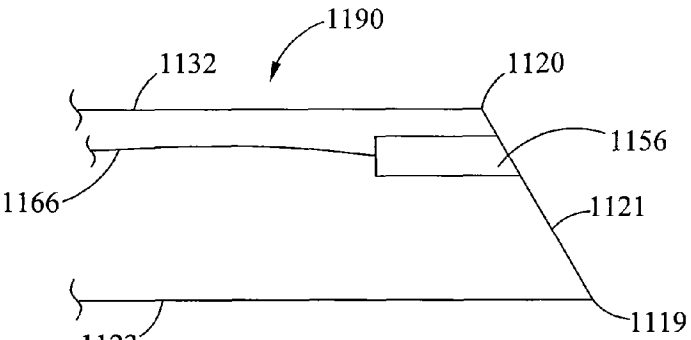

In FIGS. 11A-11C there is shown a configuration of laser cutters in a shear ram, only the leading portion, e.g., the portion intend to engage a tubular, of the ram is shown. Specifically, FIG. 11A shows a perspective view of the ram. FIG. 11B shows transverse cross-sectional view taken along line B-B of FIG. 11A and FIG. 11C shows a vertical cross-sectional view taken along line C-C of FIG. 11A. The shear ram 1190 has a trailing edge 1120, a trailing edge surface 1132, a leading edge 1119, a leading edge surface 1123, and a face surface 1121 positioned between and connecting the leading edge 1119 and the trailing edge 1120. The shear ram 1190 has six laser cutters 1151, 1152, 1153, 1154, 1155 and 1156. These laser cutters are positioned on the face surface 1121 in the half of the face closest to the trailing edge 1120, as is generally depicted in the figures. Each of the laser cutters 1151, 1152, 1153, 1154, 1155 and 1156 has a support cable 1161, 1162, 1163, 1164, 1164, 1065 and 1166, associated with it. The laser cutters are also essentially evenly spaced across the face surface 1121.

Figure 12B:
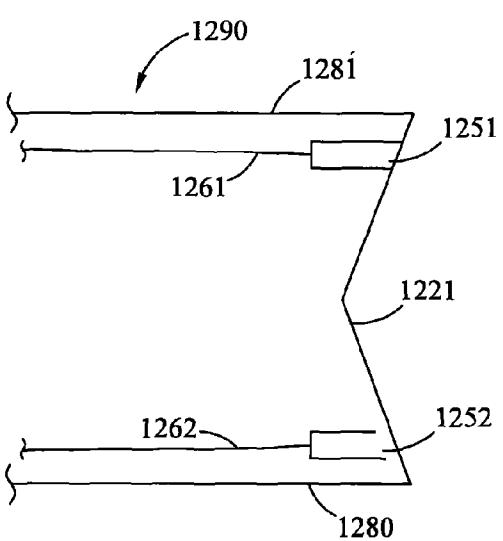
FIGS. 12A, 12B & 12C are views of a section of another laser shear ram of the present invention having laser cutters.
Figure 12A:
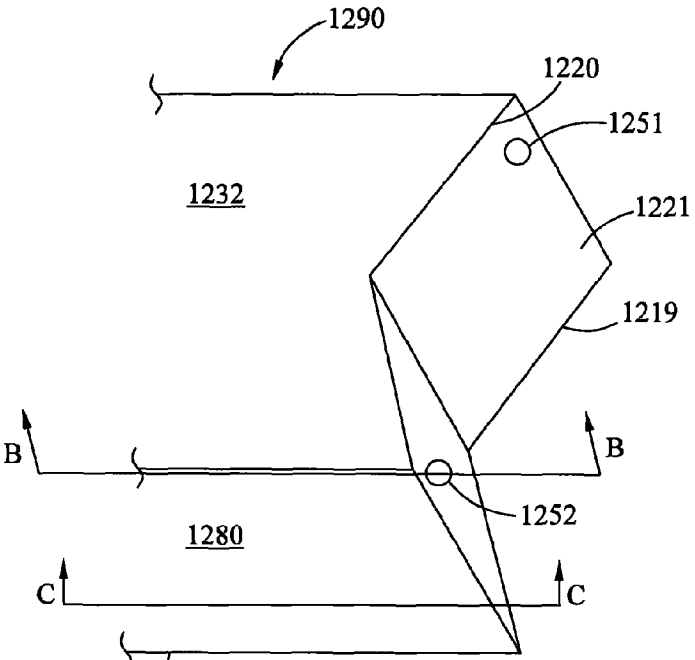
Figure 12C:
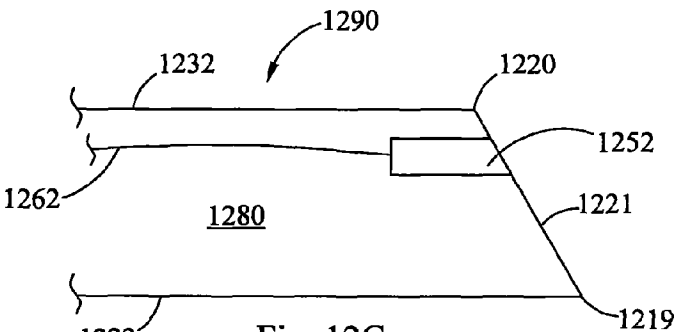

In FIGS. 12A-12C there is shown a configuration of laser cutters in a shear ram, only the leading portion, e.g., the portion intend to engage a tubular, of the ram is shown. Specifically, FIG. 12A shows a perspective view of the ram. FIG. 12B shows transverse cross-sectional view taken along line B-B of FIG. 12A and FIG. 12C shows a vertical cross-sectional view taken along line C-C of FIG. 12A. The shear ram 1290 has a trailing edge 1220, a trailing edge surface 1232, a leading edge 1219, a leading edge surface 1223, and a face surface 1221 positioned between and connecting the leading edge 1219 and the trailing edge 1220. The shear ram 1290 has two laser cutters 1251 and 1252. These laser cutters are positioned on the face surface 1221 in the half of the face closest to the trailing edge 1219, and adjacent the side surfaces 1280, 1281, as is generally depicted in the figures. Each of the laser cutters 1251 and 1252 has a support cable 1261 and 1262 associated with it. The laser cutters are also essentially unevenly spaced across the face surface 1221.

Figure 13B:
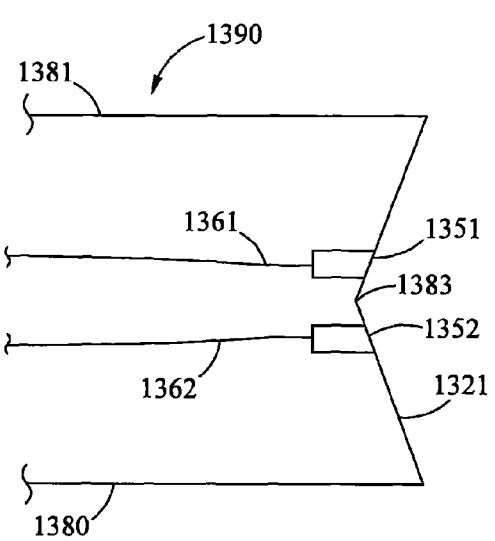
FIGS. 13A, 13B & 13C are views of a section of another laser shear ram of the present invention having laser cutters.
Figure 13A:
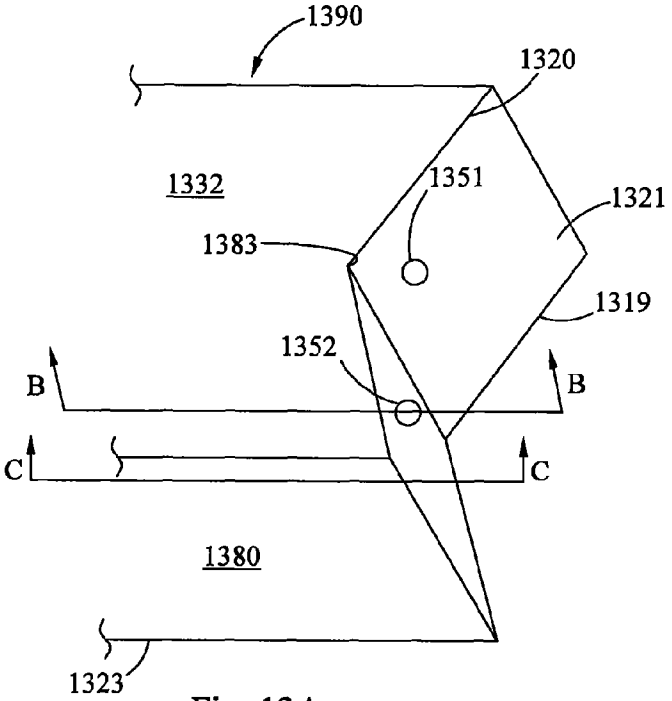
Figure 13C:
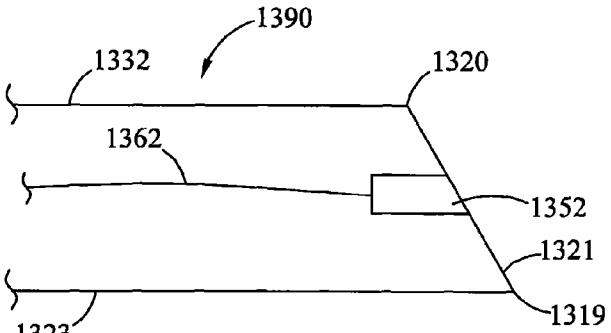

In FIGS. 13A-13C there is shown a configuration of laser cutters in a shear ram, only the leading portion, e.g., the portion intend to engage a tubular, of the ram is shown. Specifically, FIG. 13A shows a perspective view of the ram. FIG. 13B shows transverse cross-sectional view taken along line B-B of FIG. 13A and FIG. 13C shows a vertical cross-sectional view taken along line C-C of FIG. 13A. The ram 1390 has a trailing edge 1320, a trailing edge surface 1332, a leading edge 1319, a leading edge surface 1323, and a face surface 1321 positioned between and connecting the leading edge 1319 and the trailing edge 1320. The shear ram 1390 has two laser cutters 1351 and 1352. These laser cutters are positioned on the face surface 1321 in the general area of the midpoint of the face between the trailing edge 1320 and the leading edge 1319, removed from the side surfaces 1380, 1381, and adjacent the midpoint 1383 of the face between the side surfaces 1380, 1381 as is generally depicted in the figures. Each of the laser cutters 1351 and 1352 has a support cable 1361 and 1362 associated with it. The laser cutters are also essentially unevenly spaced across the face surface 1321.

In FIG. 14 there is shown a configuration of laser cutters in opposing shear rams 1402, 1403, which rams are in initial engagement with a tubular 1412. Shear ram 1403 is the upper ram, having two sides 1481, 1480, and a mating surface 1408. Shear ram 1402 is the lower ram, having two sides 1483, 1482 and a mating surface 1407. Mating surface 1408 has laser cutters 1451, 1452, 1453, 1454, 1455, 1456 and 1457 associated with it. These cutters have support cables associated with them, which cables are not shown in this figure. Mating surface 1407 has laser cutters 1471, 1472, 1472, 1374, 1475, 1476, 1477, and 1478 associated with it. These cutters have support cables associated with them, which cables are not shown in this figure. The cutters on shear ram 1402 are in a staggered relationship to the cutters on shear ram 1403. As such, the beam path leaving a cutter on shear ram 1402, for example beam path 1425 of cutter 1455, would not intersect any cutters on shear ram 1403. Similarly, the beam path leaving a cutter on shear ram 1402, for example beam path 1436 of cutter 1476, would not intersect any cutters on shear ram 1403.

In FIG. 15 there is shown a configuration of laser cutters in opposing shear rams 1502, 1503, which rams are in initial engagement with a tubular 1512. Shear ram 1503 is the upper ram, having two sides 1581, 1580, and a mating surface 1508. Shear ram 1502 is the lower ram, having two sides 1583, 1582 and a mating surface 1507. Mating surface 1508 has laser cutters 1551, 1552, 1553, 1554, 1555, 1556, 1557, 1558 and 1559 associated with it. These cutters have support cables associated with them, which cables are not shown in this figure. The laser cutters are also essentially evenly spaced with respect to each other and are unevenly spaced across the mating surfaces 1508, i.e., the cutters spacing in relation to the two sides 1581, 1580.

The firing sequence or order of the firing of laser cutters in the configurations shown in FIGS. 10A-C, 11A-C, 12A-C, 13A-C, 14 and 15 may be in series, sequentially, simultaneous, from the outside to the inside, from the inside to the outside, from side to side, or combinations and variations thereof. Preferably, the laser cutters would be fired sequentially with the central cutters firing first with the adjacent cutters firing next. Thus, turning to the configuration shown in FIGS. 10A-10C, by way of illustration, the cutters would be fired in pairs with the inner most cutters 1055, 1056 being fired first, then cutters 1057, 1054 would fire next, followed by 1058,1053 etc. A high-speed beam switch may be employed to control this firing sequence. Further, preferably, the timing of the firing of the laser cutters should be such that the first cutters cut completely through the wall of the tubular, e.g., they make a hole through the tubular, the next cutters will then fire taking advantage of, or otherwise creating, a traveling cut front in the tubular.

FIGS. 16, 17, 18, 19, 20 and 21 show illustrative examples of laser delivery patterns and their corresponding removal patterns for the laser removal of material from tubulars. Fewer or greater numbers of laser removal areas may be used, larger or smaller areas of laser removal may be used, the locations of the laser removal areas may be varied, the position of the laser removal areas may be uniformly or non-uniformly distributed across the tubular, and, other variations in laser removal patterns may be employed.

Figure 16:
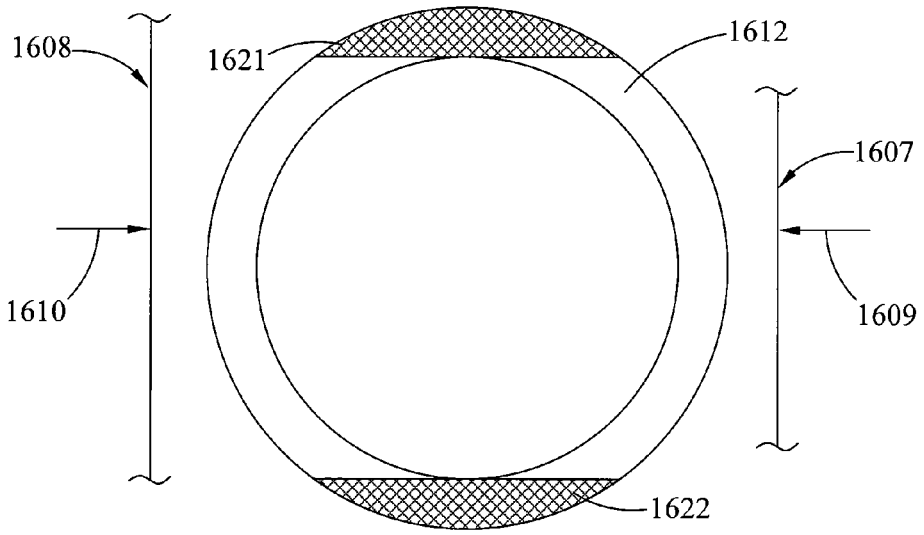
FIGS. 16, 17, 18, 19, 20 and 21 are schematic representation of laser delivery patterns of the present invention.

FIG. 16 illustrates an embodiment of a laser delivery pattern having two areas of laser removal 1621, 1622. These areas of laser removal 1621, 1622 are shown with respect to tubular 1612 and are oriented with respect to shear rams 1608, 1607. Arrows 1610, 1609 show the direction of movement of the shear rams 1608, 1609 upon activation and engagement with the tubular 1612. By controlling the laser cutters that fire, and the timing and duration of the laser cutter firing, this type of laser delivery pattern can be delivered by, for example, the configurations shown in FIGS. 2-9, 10A-C, 11A-C, 12A-C, 14, 15, and 22A-D.

Figure 17:
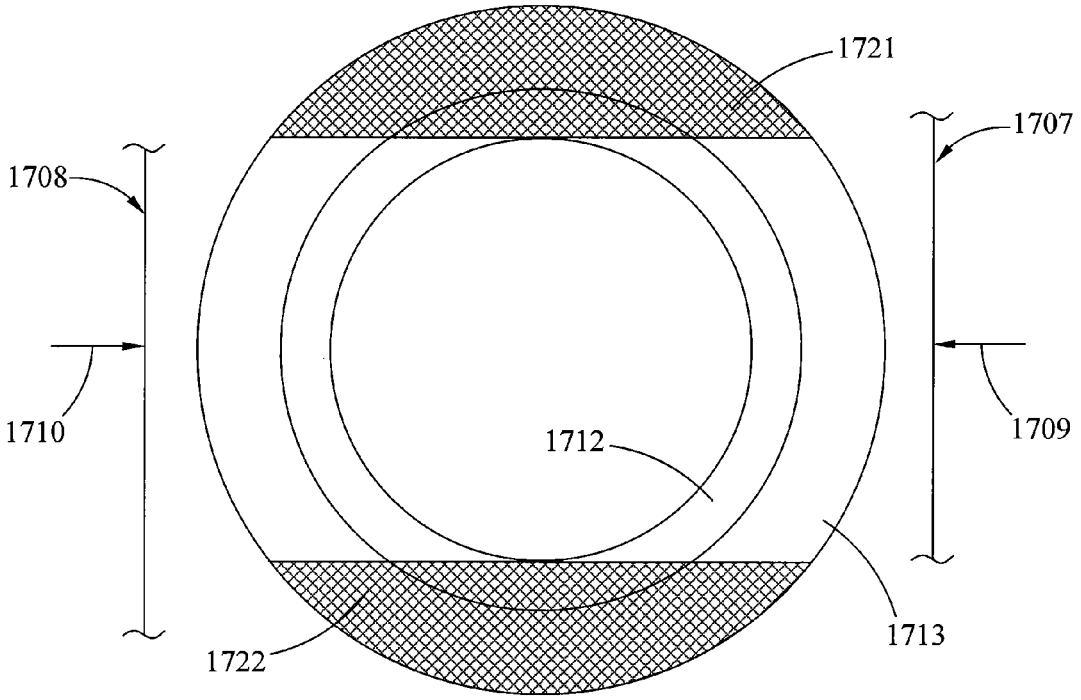

FIG. 17 illustrates the laser delivery pattern of FIG. 16 being applied to a tubular joint. Thus, the laser delivery pattern has two areas of laser removal 1721, 1722. These areas of laser removal 1721, 1722 are shown with respect to tubular 1712 and joint 1713. Although the transition from tubular to joint is shown as a line in this drawing, this is only for illustration purposes, it being understood that the transitions within a wall of a tubular joint can be complex and varied, and thus, a line is used to represent all of these transitions. This figure shows the increase in wall thickness that occurs at a joint and the application of the laser delivery pattern to that increased thickness. The areas of laser removal are oriented with respect to shear rams 1708, 1707. Arrows 1710, 1709 show the direction of movement of the shear rams 1708, 1709 upon activation and engagement with the tubular 1712.

Figure 18:
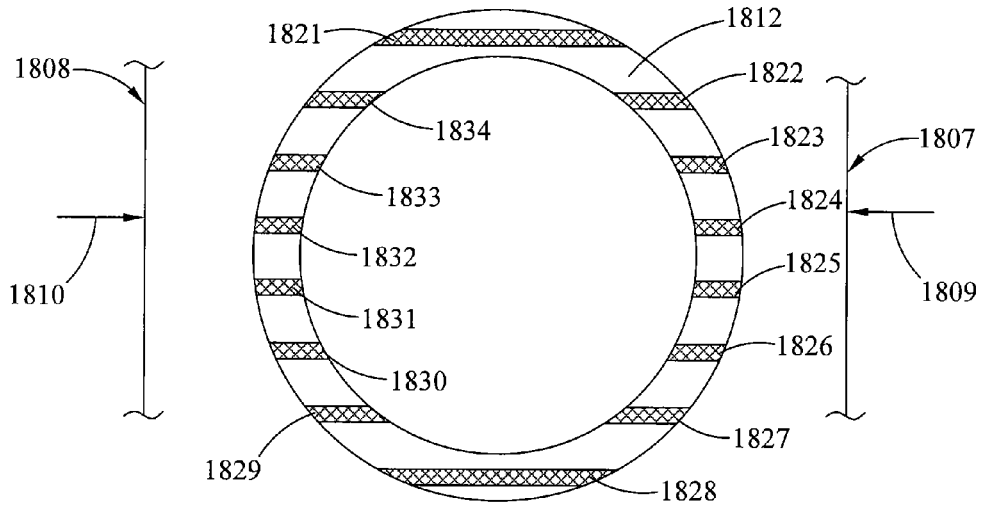

FIG. 18 illustrates an embodiment of a laser delivery pattern having fourteen areas of laser removal 1821, 1822, 1823, 1824, 1825, 1826, 1827, 1828, 1829, 1830, 1831, 1832, 1833, and 1834. These areas of laser removal are shown with respect to tubular 1812 and are oriented with respect to shear rams 1808, 1807. Arrows 1810, 1809 show the direction of movement of the shear rams 1808, 1807 upon activation and engagement with the tubular 1812. The areas of laser removal can be viewed as forming a number of channels or holes in the tubular having an orientation that is parallel to the movement of the rams, which movement is shown by arrows 1810, 1809. By controlling the laser cutters that fire, and the timing and duration of the laser cutter firing, this type of laser delivery pattern can be delivered by, for example, the configurations shown in FIGS. 7-9, 10A-C, 11A-C, and 14.

Figure 19:
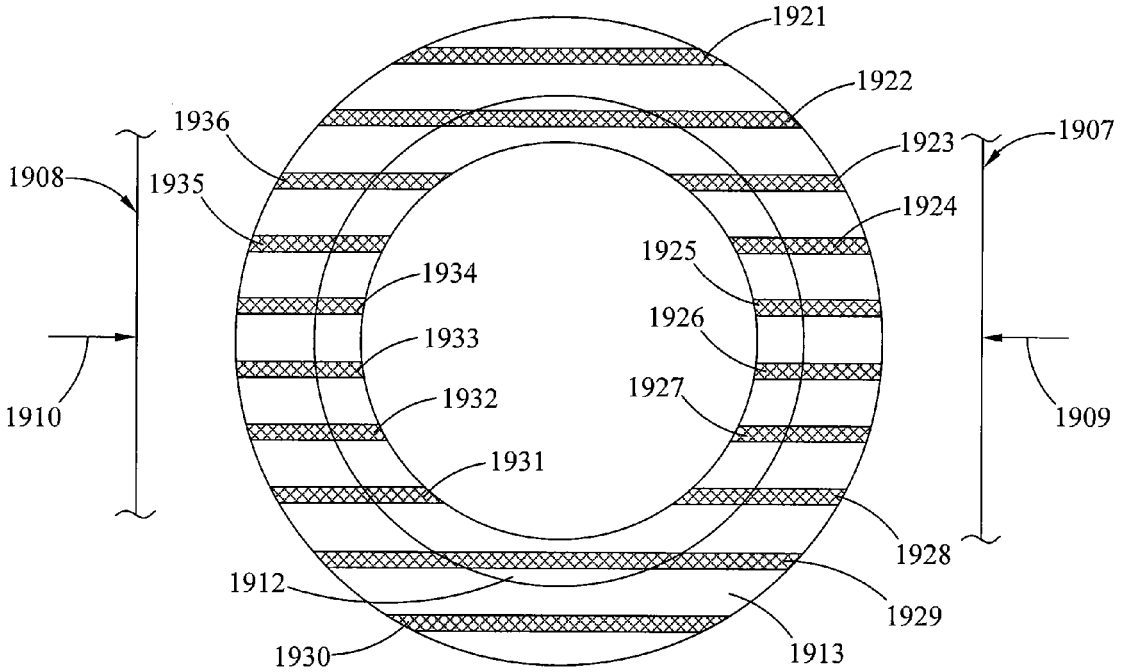

FIG. 19 illustrates the laser delivery pattern of FIG. 18 being applied to a tubular joint. Thus, the laser delivery pattern has 14 areas of laser removal 1921, 1922, 1923, 1924, 1925, 1926, 1927, 1928, 1929, 1930, 1931, 1932, 1933, and 1934. These areas of laser removal are shown with respect to tubular 1912 and joint 1913. Although the transition from tubular to joint is shown as a line in this drawing, this is only for illustration purposes, it being understood that the transitions within a wall of a tubular joint can be complex and varied, and thus, a line is used to represent all of these transitions. This figure shows the increase in wall thickness that occurs at a joint and the application of the laser delivery pattern to that increased thickness. The areas of laser removal are oriented with respect to shear rams 1908, 1907. Arrows 1910, 1909 show the direction of movement of the shear rams 1908, 1909 upon activation and engagement with the tubular 1912.

Figure 20:
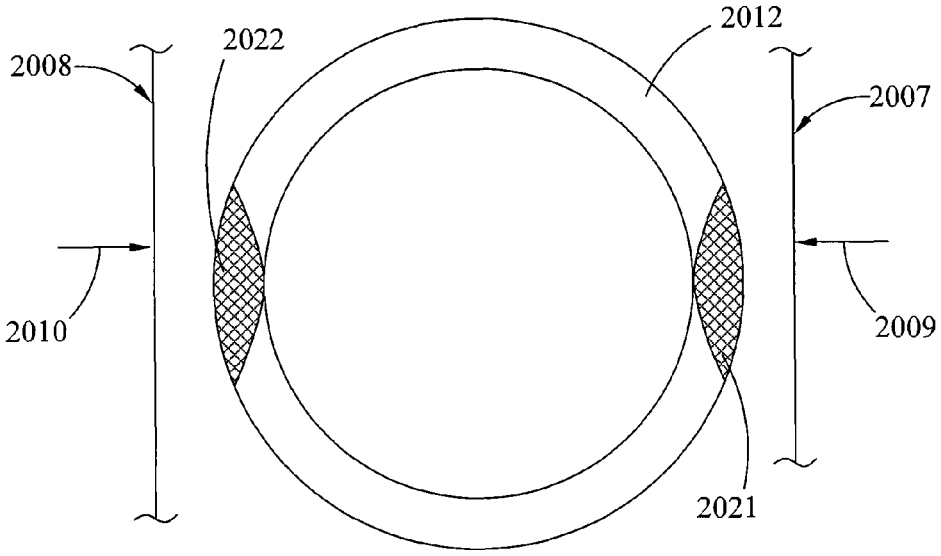

FIG. 20 illustrates an embodiment of a laser delivery pattern having two areas of laser removal 2021, 2022. These areas of laser removal 2021, 2022 are shown with respect to tubular 2012 and are oriented with respect to shear rams 2008, 2007. Arrows 2010, 2009 show the direction of movement of the shear rams 2008, 2007 upon activation and engagement with the tubular 2012. By controlling the laser cutters that fire, and the timing and duration of the laser cutter firing, this type of laser delivery pattern can be delivered by, for example, the configurations shown in FIGS. 2-6, and 9.

Figure 21:
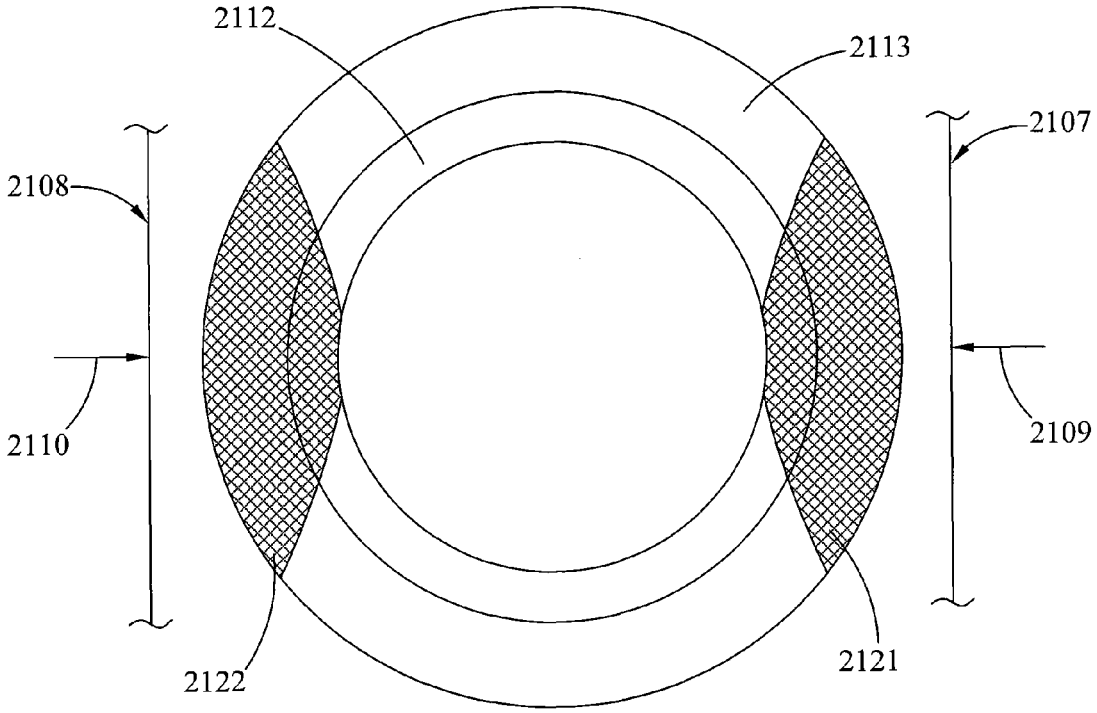

FIG. 21 illustrates the laser delivery pattern of FIG. 20 being applied to a tubular joint. Thus, the laser delivery pattern has two areas of laser removal 2121, 2122. These areas of laser removal 2121, 2122 are shown with respect to tubular 2112 and joint 2113. Although the transition from tubular to joint is shown as a line in this drawing, this is only for illustration purposes, it being understood that the transitions within a wall of a tubular joint can be complex and varied, and thus, a line is used to represent all of these transitions. This figure shows the increase in wall thickness that occurs at a joint and the application of the laser delivery pattern to that increased thickness. The areas of laser removal are oriented with respect to shear rams 2108, 2107. Arrows 2110, 2109 show the direction of movement of the shear rams 2108, 2107 upon activation and engagement with the tubular 2112.

In FIGS. 22A-22D there is shown an example of an embodiment of a laser shear ram assembly that could be used in a laser assisted BOP. Thus, there is shown a laser shear ram assembly 2200 having a body 2201. The body has a cavity 2204, which cavity has a center axis (dashed line) 2211 and a wall 2241. The BOP cavity also has a vertical axis and in this embodiment the vertical axis and the center axis are the same, which is generally the case for BOPs. (The naming of these axes is based upon the configuration of the BOP and are relative to the BOP structures themselves, not the position of the BOP with respect to the surface of the earth. Thus, the vertical axis of the BOP will not change if the BOP for example were laid on its side.) Typically, the center axis 2211 of cavity 2204 is on the same axis as the center axis of the wellhead cavity or opening through which tubulars are inserted into the borehole.

The body 2201 contains and supports lower shear ram 2202 and upper shear ram 2203, which rams have piston assembly 2205 and 2206 associated therewith. In operation, the piston assemblies 2205, 2206 drive the rams 2202, 2203 toward the center axis 2211, engaging, cutting and moving through tubular 2212, and sealing the cavity 2204, and thus, sealing the well. The body 2201 also has a feed-through assemblies 2213, 2214 for managing pressure and permitting optical fiber cables and other cables, tubes, wires and conveyance means, which may be needed for the operation of the laser cutter, to be inserted into the body 2201. The body, as seen in FIGS. 22B-D, houses two laser delivery assemblies 2224, 2225. The body 2201 also contains positioning rams 2220, 2221, which are associated with piston assemblies 2222, 2223, respectively.

Figure 22A:
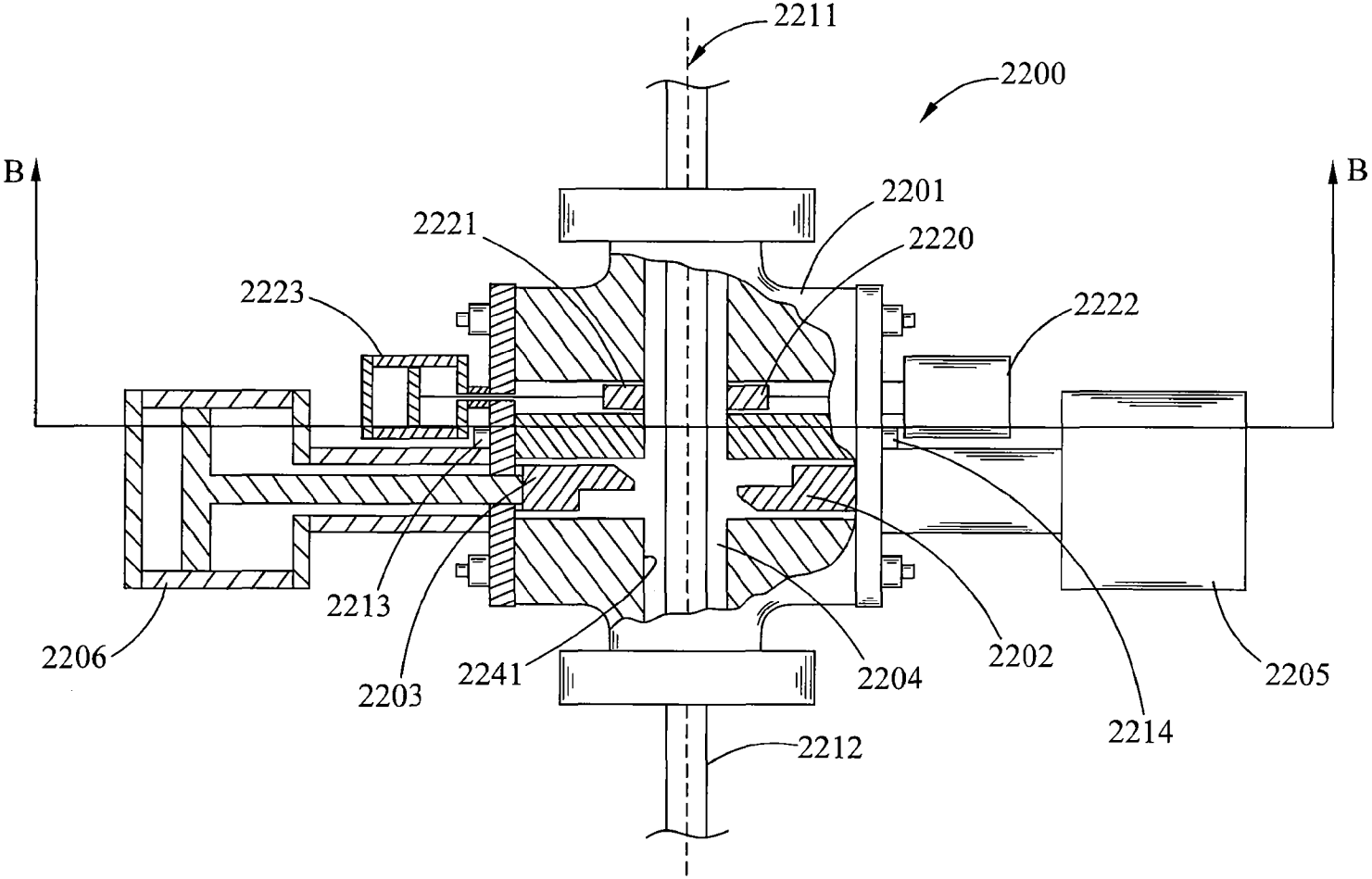
FIG. 22A is a partial cut away cross-sectional view of another embodiment of a laser shear ram assembly of the present invention.
Figure 22B:
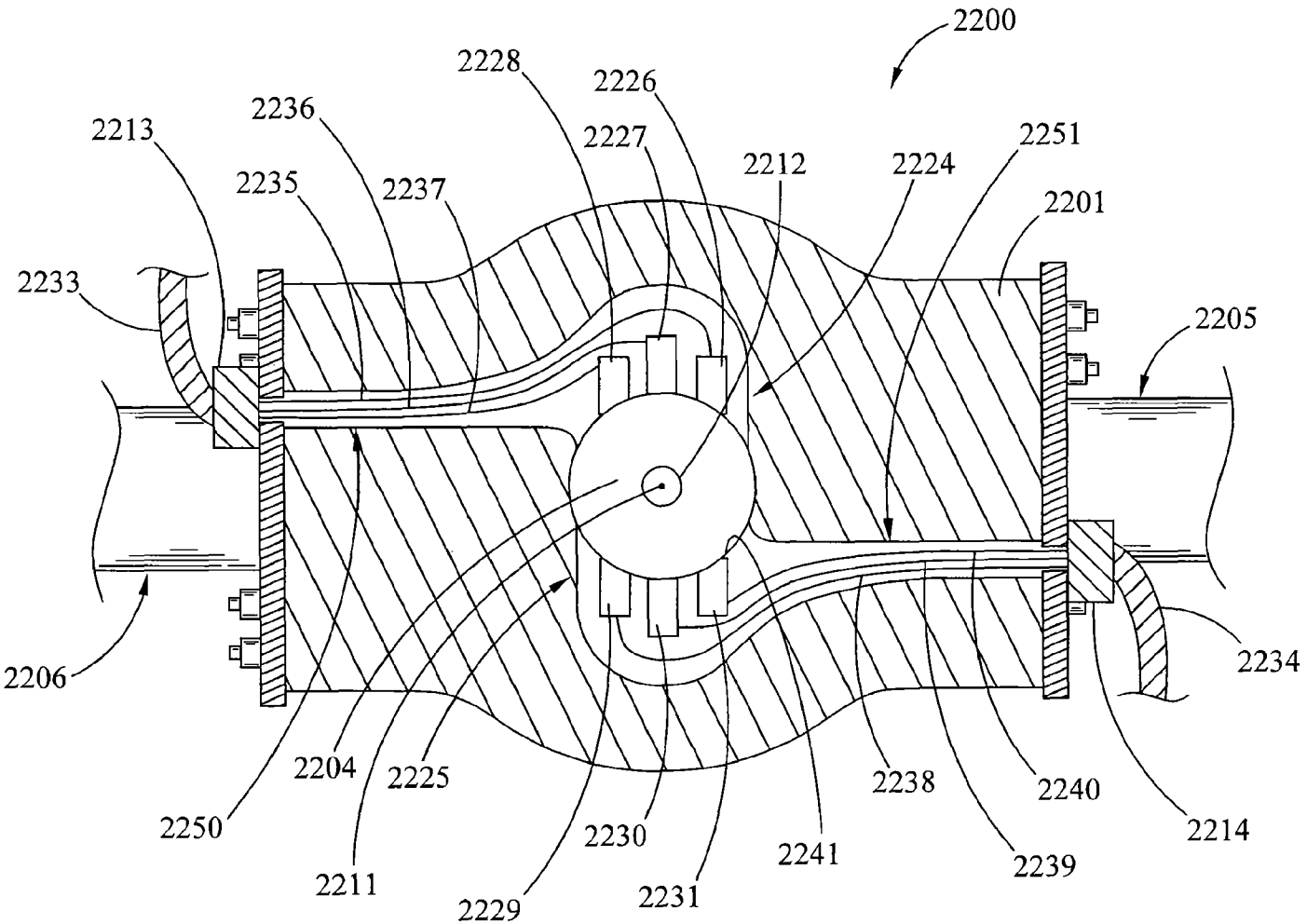
FIGS. 22B, 22C & 22D are transverse cross-sectional views of the embodiment of the laser shear ram assembly of FIG. 22A, taken along line B-B of FIG. 22A.
Figure 22C:
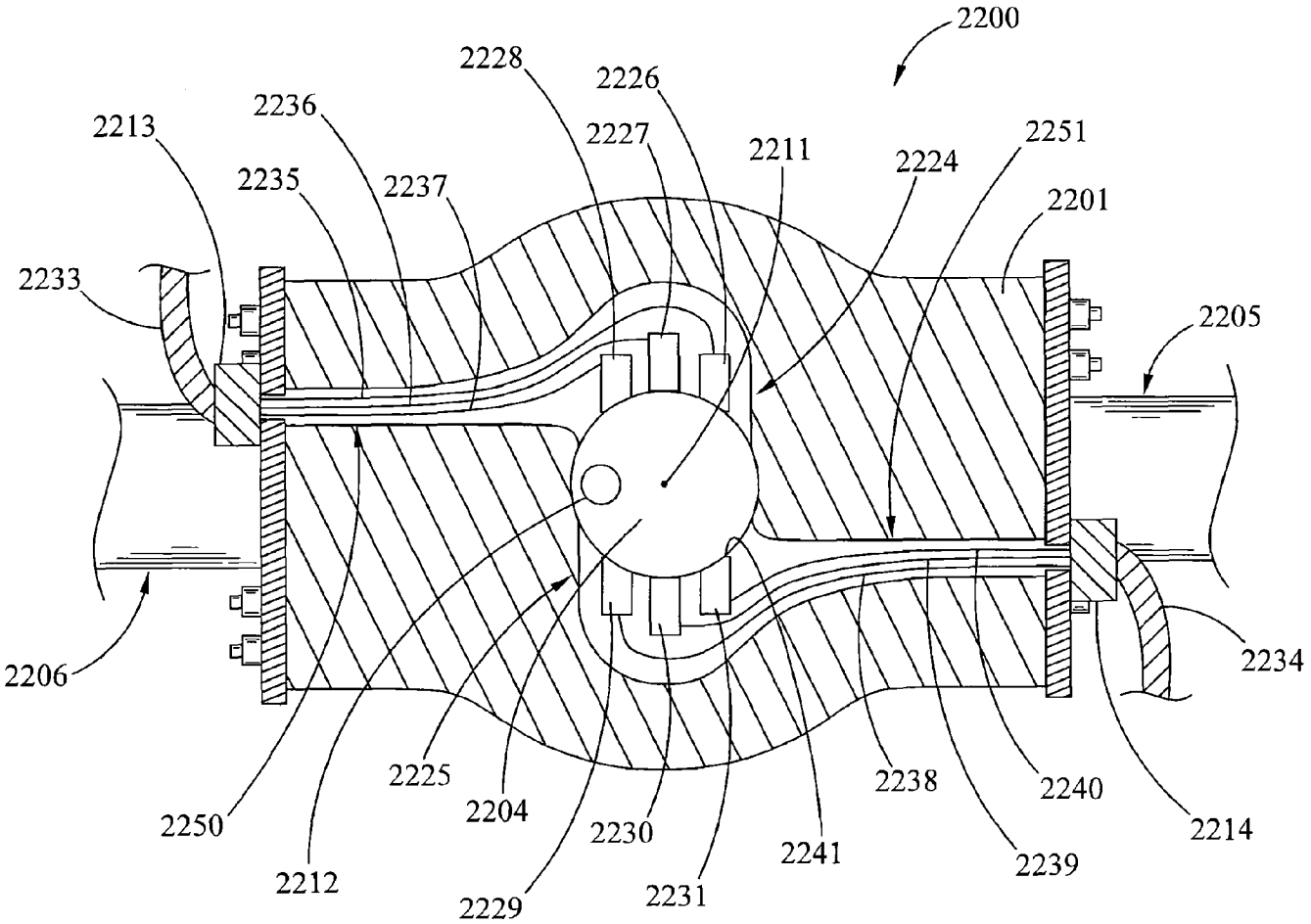
Figure 22D:
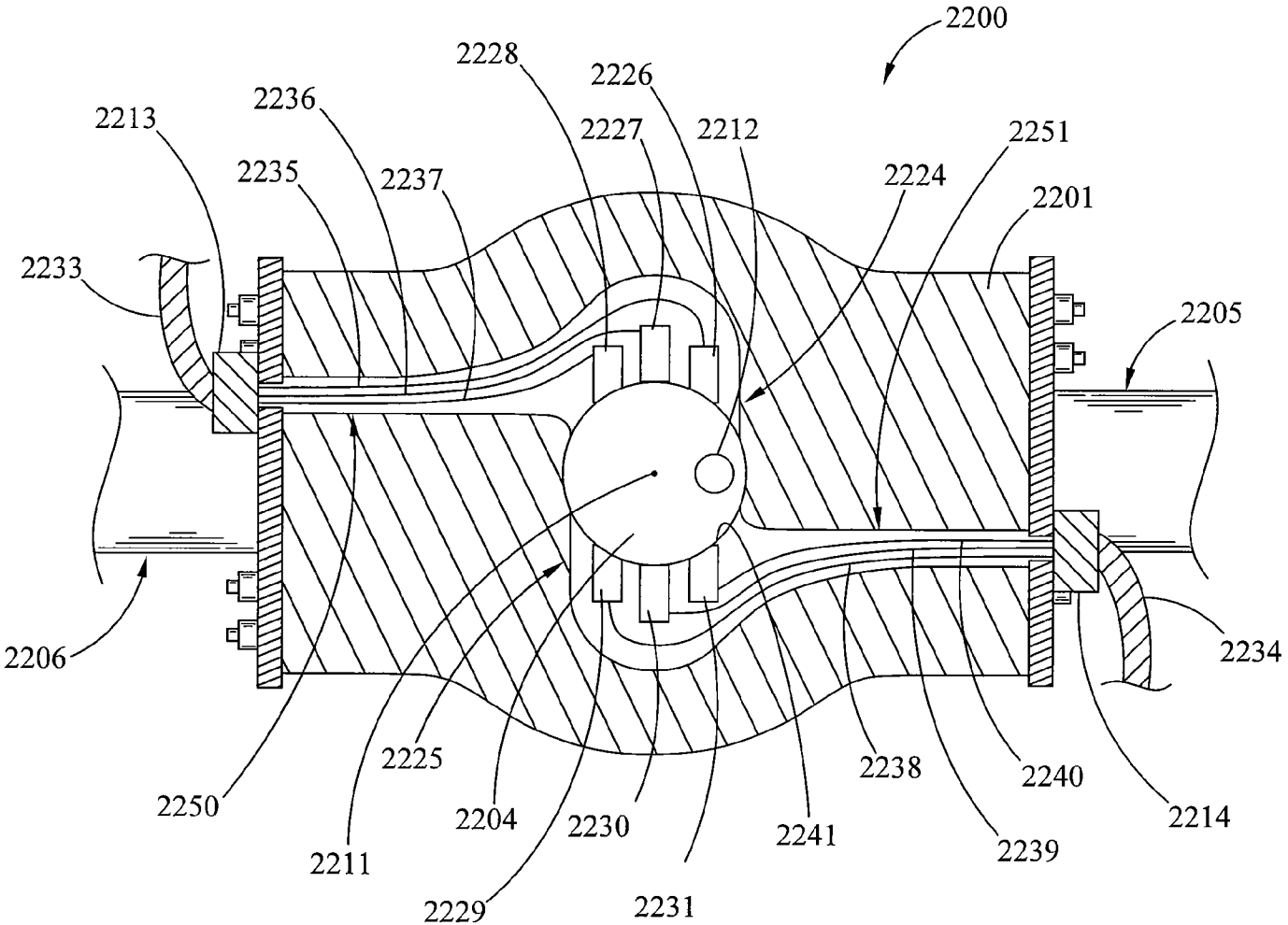

FIGS. 22B to 22D, are cross-sectional views of the embodiment shown in FIG. 22A taken along line B-B of FIG. 22A and show the sequences of operation of the laser shear ram assembly 2200, in cutting the tubular 2212. In FIGS. 22B to 22D there is also shown further detail of the laser delivery assemblies 2224, 2225 of laser ram assembly 2200. In this embodiment both laser assemblies 2224, 2225 could have similar components and configurations. However, the laser assemblies 2224, 2225 could have different configurations and more or fewer laser cutters.

The laser delivery assembly 2224 has three laser cutters 2226, 2227 and 2228. Flexible support cables are associated with each of the laser cutters. Flexible support cable 2235 is associated with laser cutter 2226, flexible support cable 2236 is associated with laser cutter 2227 and flexible support cable 2237 is associated with laser cutter 2228. The flexible support cables are located in channel 2250 and enter feed-through assembly 2213. In the general area of the feed-through assembly 2213 the support cables transition from flexible to semi-flexible, and may further be included in conduit 2233 for conveyance to a high power laser, or other sources of materials for the cutting operation.

The laser delivery assembly 2225 has three cutters 2231, 2230, and 2229. Flexible support cables are associated with each of the laser cutters. The flexible support cable 2240 is associated with laser cutter 2231, flexible support cable 2239 is associated with laser cutter 2230 and flexible support cable 2238 is associated with laser cutter 2229. The flexible support cables are located in channel 2251 and enter feed-through assembly 2214. In the general area of the feed-through assembly 2214 the support cables transition from flexible to semi-flexible, and may further be included in conduit 2234 for conveyance to a high power laser, or other sources of materials for the cutting operation.

FIGS. 22B to 22D show the sequence of activation of the positioning rams 2220, 2221 to sever a tubular 2212. In this example, the first view (e.g., a snap shot, since the sequence preferably is continuous rather than staggered or stepped) of the sequence is shown in FIG. 22B. As activated the six lasers cutters 2226, 2227, 2228, 2229, 2230, and 2231 shoot or fire laser beams toward the tubular to be cut. In this example the laser cutters are configured so that the beam paths are parallel with the beam paths of the laser cutters on the other side of cavity 2204. The beam paths and thus the laser beams, although not configured like the spokes of a wheel, are still directed into the cavity and toward the central axis. Further in this example the beam paths are configured to be co-linear, however, they could also be staggered. As such, the beams are shot from within the BOP, from outside of the cavity wall 2241, and travel toward the tubular 2212. The laser beams strike tubular 2212 and begin cutting, i.e., removing material from, the tubular 2212. Upon activation, the laser cutters begin firing their respective laser beams, at about the same time the positioning rams 2220, 2221 engage the tubular 2212 and move the tubular 2212 across the fixed laser beams toward shear ram 2203 the positioning rams 2220, 2221 than move the tubular 2212 across the fixed laser beams toward shear ram 2202. In this way the tubular to be cut is moved back and forth through the laser beams. Once the cut is completed the ram shears 2220, 2221 engage any remaining portion of the tubular, shearing it, or otherwise removing it from the path of the shears and sealing the cavity 2204 and the well.

Figure 26:
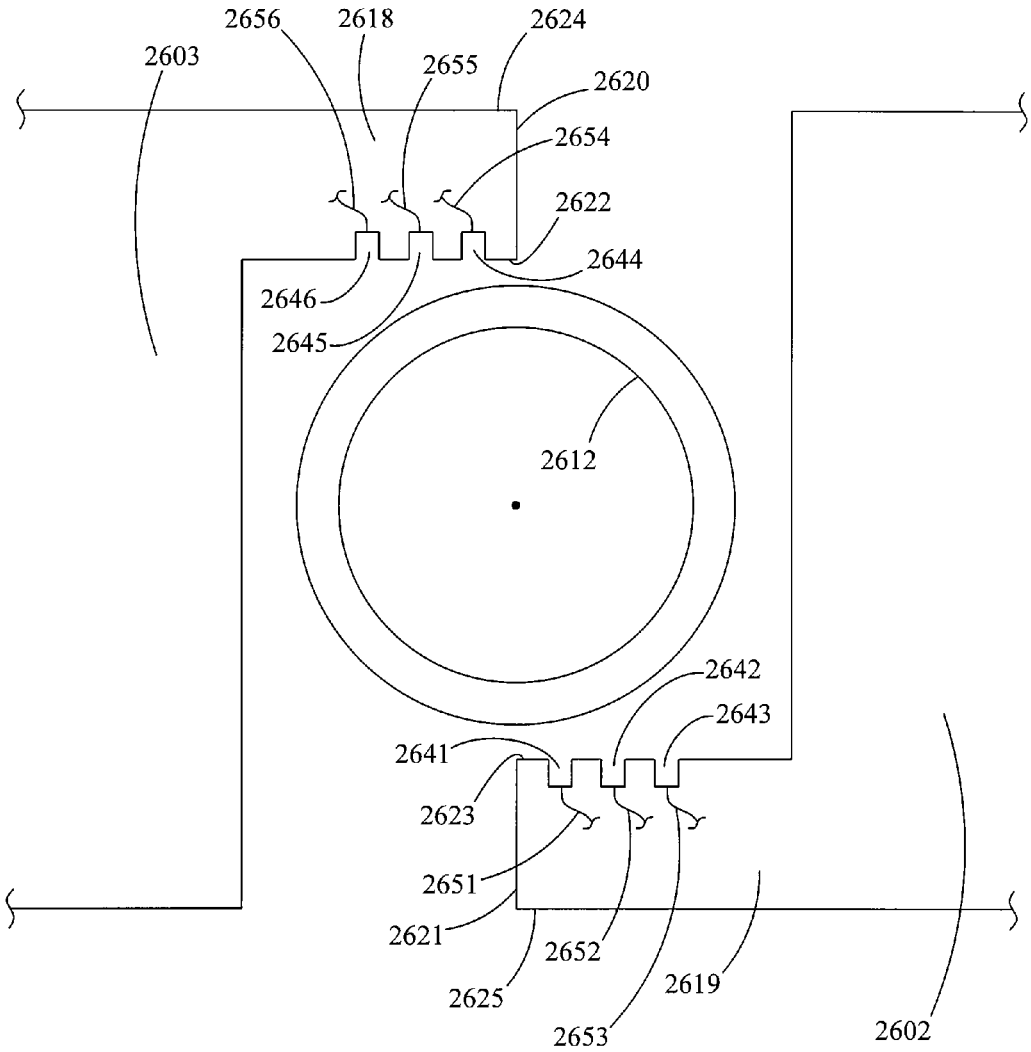
FIG. 26 is a schematic illustration of a tubular and laser shear rams.

FIG. 26 is a schematic illustration of an embodiment of laser shear rams having leading members. In this figure tubular 2612 is shown in relation to shear ram 2603 and shear ram 2602. Shear ram 2602 has a leading member 2618 that has a side surface 2624 and a leading surface 2620 and an inner surface 2622. Shear ram 2603 has a leading member 2619 that has a side surface 2625, a leading surface 2621 and an inner surface 2623. The leading members 2618, 2619 are configured to enable their respective laser cutters, 2644, 2645, 2646 and 2641, 2642, 2643 to move past the tubular 2612 as the rams 2602, 2603 move toward, engage and cut the tubular 2612. The members 2618, 2619 may be movable, adjustable and preferably biased, so that as the rams 2602, 2603 engage the tubular 2612, inner surfaces 2622, 2623 engage and remain in contact with the tubular 2612. For example a cam follower may be utilized. In this manner the distance between the laser cutters and the tubular is substantially reduced and kept to a minimum as the laser cutters are moved across the tubular.

Figure 24:
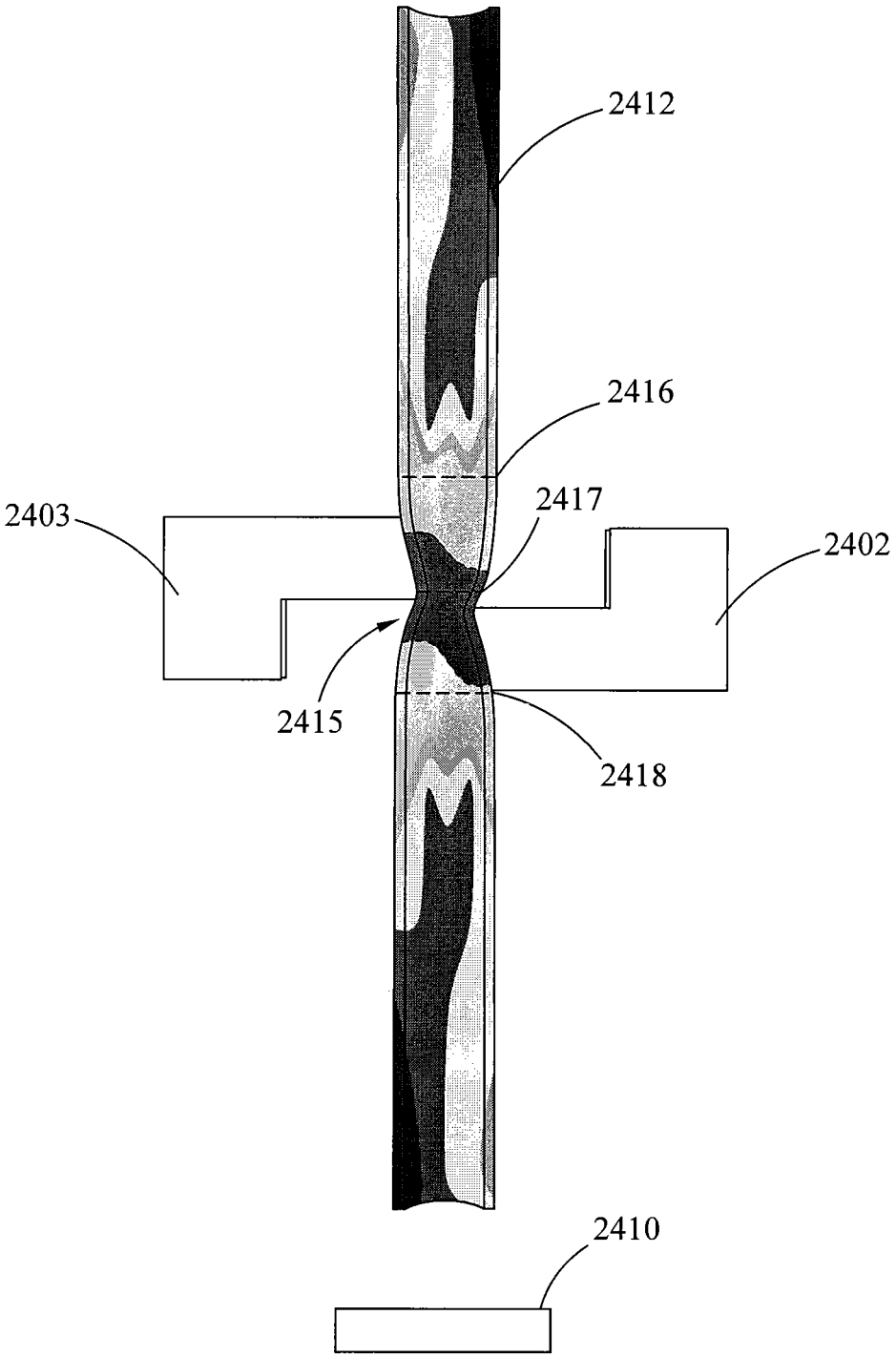
FIG. 24 is a schematic illustration of laser shear rams interacting with a tubular.

FIG. 24 provides a schematic illustration of the potential optical and mechanical interactions that are obtainable by various configurations and uses of a laser assisted BOP. Thus, FIG. 24 shows an upper ram shear 2403 and a lower ram shear 2402 in mechanical interaction with a tubular 2412, e.g., the tubular is being mechanically crushed as the pair of opposing rams engage. There is provided a zone of mechanical interaction 2415 in the tubular that is associated with the forces exerted on the tubular by the shear rams. There is also shown a laser pattern 2416 that is optically delivered to the tubular from a laser cutter (not shown in this figure) and which pattern is located above the mechanical interaction zone 2415. There is shown a preferred laser pattern 2417 that is optically delivered to the tubular from a laser cutter (not shown) and which pattern is located in the mechanical interaction zone 2415. These is shown a laser pattern 2418, that is optically delivered to the tubular from a laser cutter (not shown) and which pattern is located below the mechanical interaction zone 2415. These exemplary laser pattern placements can be used independently or in combination. The wellhead 2410 is shown as a point of reference.

Preferably, the beam path(s) may be configured to provide a completed cut at the area where the mechanical forces for the shear rams, the tension that the tubular may be under, or both, are the greatest. In this way, the likelihood that unwanted material may be left in the ram interface to obstruct or inhibit the sealing of the rams is reduced or eliminated. As described herein, other laser cutter placements, firing sequences, shear arrangements, or combinations of thereof, also address this issue of providing greater assurances that the rams enter into sealing engagement.

Example 1

Figure 25:
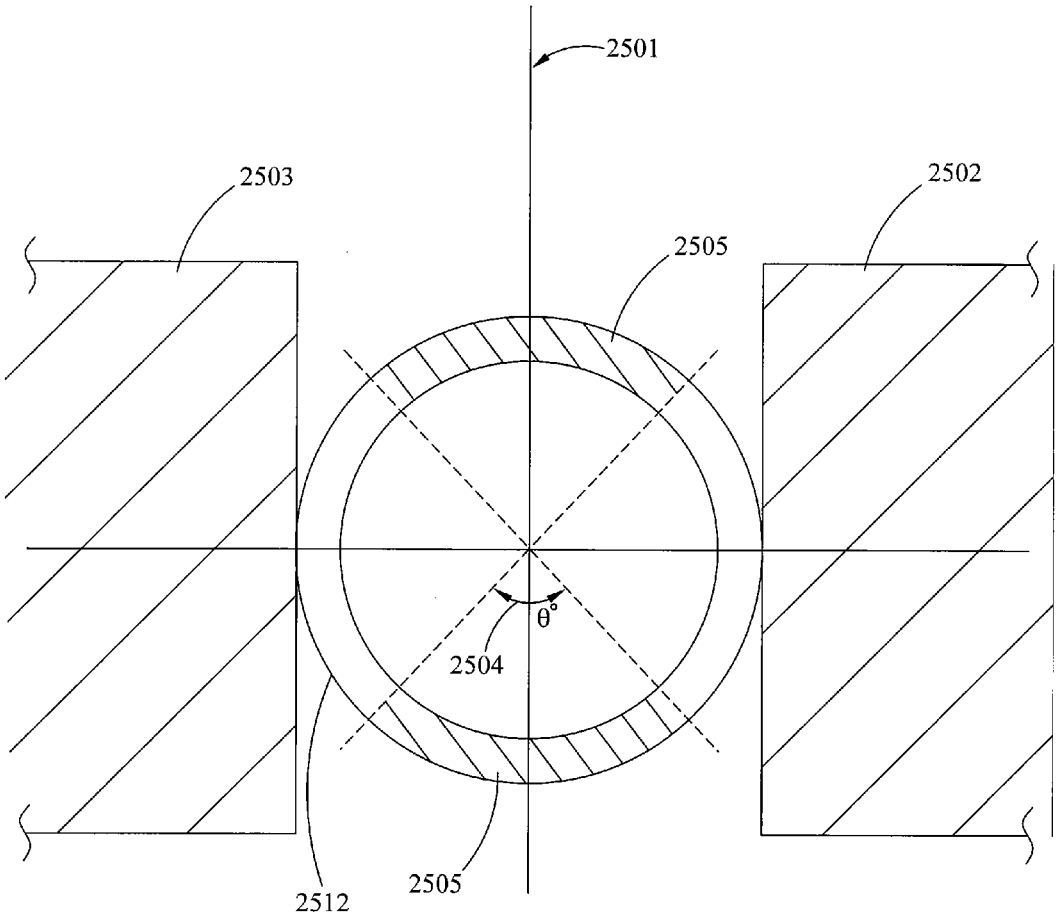
FIG. 25 is a schematic illustration of a tubular and laser shear rams.

In this example the amount of material to be removed from a 5" drill pipe by delivery of a high power laser pattern to the tubular is evaluated. In general the laser pattern is the type shown in FIG. 16. For this analysis a 1 mm slot cut though the wall of the tubular in this pattern will be used. In FIG. 25 there is provided a schematic of a tubular 2505 and shear rams 2502, 2503, with an x,y axis 2501 placed over those structures for reference purposes. As shown in the figure the size of angle θ° 2504 directly relates to the amount of material to be removed 2505 by the laser. Thus, the analysis of the decrease in the shear force obtained for varying angles is set forth in Table II.

TABLE II

| Case | Description | Shear Force (for given ram displacement) klbs. | Change |
|---|---|---|---|
| 1 | 5" drill pipe – no laser cut | 85.418 | |
| 2 | 5" drill pipe – angle θ° = 60° 1 mm slot to be removed by laser | 83.391 | −2.3% |
| 3 | 5" drill pipe – angle θ° = 90° 1 mm slot to be removed by laser | 30.959 | −63.76% |
| 4 | 5" drill pipe – angle θ° = 120° 1 mm slot to be removed by laser | 28.702 | −66.40% |

The configurations of and arrangement of the various components in a laser assisted BOP stack provide the capability of many varied sequences of laser cutter firing and activation of ram preventers and annular preventers. Thus, the sequence of laser firings and activations can be varied depending upon the situation present in the well or the BOP, to meet the requirements of that situation. Thus, for example, pipe rams could engage a tubular, laser cutters could sever the tubular without crushing it. In another example, where a casing and a tubular in that cases are in the BOP, the laser cutters could be fired to sever the casing, which then is pulled or dropped away, laser shear rams are then used to sever the tubular and seal the BOP cavity. In yet another example, in a situation where the BOP has for unknown reasons failed to seal off the well, all laser cutters can be repeatedly fired, removing whatever tubular may be obstructing the various rams, permitting the to seal the well. The present inventions provide the ability to quickly provide laser, laser-mechanical, and mechanical cutting and sealing actions in a BOP to address situations that may arise in offshore drilling. As such, the scope of the present inventions is not limited to a particular offshore situation or sequence of activities.

The invention may be embodied in other forms than those specifically disclosed herein without departing from its spirit or essential characteristics. The described embodiments are to be considered in all respects only as illustrative and not restrictive.

What is claimed:

1. A blowout preventer stack comprising:

A ram movable from a first position to a second position, thereby defining a ram path;

A laser cutter for emitting a high power laser beam defining a laser beam path, wherein the high power laser beam has at least about 1 kW of power;

The laser cutter positioned relative to the ram and facing a pressure containment cavity formed within the blowout preventer stack, whereby the laser beam path is adjacent the ram path, and wherein the beam path enters into the pressure containment cavity and the second position is located within the pressure containment cavity.

2. A blowout preventer stack comprising:

A ram preventer;

The blowout preventer stack defining a pressure containment cavity; and

The ram preventer comprising a high power laser cutter, for emitting a high power laser beam defining a laser beam path, wherein the high power laser beam has at least about 1 kW of power; and, the pressure containment cavity having an axis.

3. The blowout prevent stack of claim 2, wherein the ram preventer is a shear ram assembly and the stack comprises:

a. an annular preventer assembly;

b. a pipe ram assembly; and, c. the annular preventer assembly, shear ram assembly and pipe ram assembly define at least a portion of the pressure containment cavity.

4. The blowout preventer stack of claim 3, wherein the laser beam path is directed toward the axis of the pressure containment cavity.

5. The blowout preventer stack of claim 3, wherein the beam path is directed towards the pressure containment cavity.

6. The blowout preventer stack of claim 3, wherein the beam path intersects the axis of the pressure containment cavity.

7. The blowout preventer of claim 3, comprising a laser cutter shield located adjacent to the pressure containment cavity, wherein the laser cutter shield protects the laser cutter from damage, while not appreciably interfering with the movement of tubulars through the cavity.

8. A blowout preventer comprising:

a. A laser cutter for emitting a high power laser beam, wherein the high power laser beam has at least about 1 kW of power;

b. A ram preventer comprising opposing rams;

c. A pressure containment cavity within a stack for passing tubulars therethrough;
d. The laser cutter having a beam path;
e. The opposing rams capable of movement into the pressure containment cavity;
f. An area within the pressure containment cavity for engagement of the opposing rams with a tubular; and,
g. The beam path positioned in the area within the pressure containment cavity for engagement of the opposing rams with the tubular.

9. A subsea blowout preventer comprising:
a. A laser cutter for emitting a high power laser beam, wherein the high power laser beam has at least about 1 kW of power;
b. A ram preventer, having a ram;
c. A pressure containment cavity for passing tubulars therethrough;
d. The laser cutter having a beam path;
e. The ram capable of movement into the pressure containment cavity;
f. An area within the pressure containment cavity for engagement of the ram with a tubular; and,
g. The beam path directed adjacent to the area within the pressure containment cavity for engagement of the ram with the tubular.

10. The method of claim 9, wherein the beam path is above the area within the pressure containment cavity for engagement of the ram with the tubular.

11. The method of claim 9, wherein the beam path is below the area within the pressure containment cavity for engagement of the ram with the tubular.

12. A laser assisted blowout preventer comprising:
a. An annular preventer;
b. A pipe ram assembly; and,
c. A laser shear ram assembly comprising:
i. A ram movable from a first position to a second position; and,
ii. A laser cutter adjacent a pressure containment cavity formed within the laser assisted blowout preventer, wherein the laser cutter emits a high power laser beam that defines a laser beam path, wherein the high power laser beam has at least about 1 kW of power; the laser cutter positioned in the laser shear ram assembly, wherein the laser beam path enters into the pressure containment cavity and the second ram position is located within the pressure containment cavity.

13. The laser assisted blowout preventer of claim 12, wherein the blowout preventer is a subsea blowout preventer comprising: a shear ram assembly and a second pipe ram assembly; wherein the annular preventer, laser shear ram assembly, shear ram assembly, pipe ram assembly and second pipe ram assembly form a stack of components.

14. The laser assisted blowout preventer of claim 12, wherein the laser beam path extends toward a center axis of the pressure containment cavity.

15. The laser assisted blowout preventer of claim 12, wherein the pressure containment cavity has a vertical axis and the laser beam path forms an acute angle with the vertical axis.

16. The laser assisted blowout preventer of claim 12, wherein the pressure containment cavity has a vertical axis and the laser beam path that forms an obtuse angle with the vertical axis.

17. The laser assisted blowout preventer of claim 12, wherein the pressure containment cavity has a vertical axis and the laser beam path forms about a 90 degree angle with the vertical axis.

18. The laser assisted blowout preventer of claim 12, wherein the laser shear ram assembly comprises:
a. a body having the pressure containment cavity for passing tubulars therethrough;
b. the pressure containment cavity having a wall and a center axis; and
c. the laser cutter positioned prior to activation within the body of the laser shear ram assembly, adjacent the pressure containment cavity wall, and outside of the pressure containment cavity.

19. The laser assisted blowout preventer of claim 12, wherein the laser cutter is capable of at least partially orbiting an axis of the pressure containment cavity while firing the laser beam.

20. The laser assisted blowout preventer of claim 19, comprising a second laser cutter.

21. The laser assisted blowout preventer of claim 19, wherein it takes about ½ of an orbit to complete a cut of a tubular.

22. The laser assisted blowout preventer of claim 19, wherein it takes about ⅓ of an orbit to complete a cut of a tubular.

23. The laser assisted blowout preventer of claim 19, wherein it takes about ¼ of an orbit to complete a cut of a tubular.

24. The laser assisted blowout preventer of claim 12, wherein the laser cutter is contained in the ram.

25. The laser assisted blowout preventer of claim 12, wherein the ram has a path of travel for movement of the ram from the first position to the second position thereby defining a ram path.

26. The laser assisted blowout preventer of claim 25, wherein the laser beam path is transverse to the ram path.

27. The laser assisted blowout preventer of claim 25, wherein the laser beam path is parallel to the ram path.

28. The laser assisted blowout preventer of claim 12, comprising: a second laser cutter that emits a second laser beam that defines a second laser beam path, wherein the pressure containment cavity is substantially circular defining a center axis; and each of the laser cutter and the second laser cutter is adjacent to but not in the pressure containment cavity, and the laser beam path and the second laser beam path intersect the center axis of the pressure containment cavity.

29. A laser assisted blowout preventer comprising:
a. A frame;
b. A blowout preventer stack mechanically associated with the frame, whereby the frame at least in part encompasses and protects the blowout preventer stack, the blowout preventer stack comprising;
i. A pressure containment cavity formed within the blowout preventer stack for passing tubulars therethrough; and,
ii. A high power laser delivery assembly positioned outside of the pressure containment cavity when not activated, wherein the high power laser delivery assembly delivers a high power laser beam, wherein the high power laser beam has at least about 1 kW of power.

30. The laser assisted blowout preventer of claim 29, wherein the laser delivery assembly comprises:
a. a laser cutter having a laser beam path;
b. the laser cutter integral with a shear ram; and
c. the laser beam path directed into the pressure containment cavity.

31. The laser assisted blowout preventer of claim 29, wherein the pressure containment cavity for passing tubulars therethrough has a vertical axis, and the laser delivery assembly comprises:

a. a first laser cutter having a first beam path directed toward the pressure containment cavity;
b. a second laser cutter having a second beam path directed toward the pressure containment cavity;
c. at least one of the first or second laser cutters contained in a shear ram; and,
d. at least one of the first or second beam paths directed toward the vertical axis.

32. The laser assisted blowout preventer of claim 29, wherein the laser delivery assembly comprises:
a. a plurality of laser cutters each having a beam path;
b. at least one of the plurality of laser cutters mechanically associated with a shear ram, wherein the shear ram is contained within the blowout preventer stack, wherein the blowout preventer stack has an area within the pressure containment cavity for engagement with a tubular by the shear ram; and
c. at least one of the beam paths is directed toward the area within the pressure containment cavity for engagement with a tubular by the shear ram.

33. A laser assisted subsea blowout preventer drilling system, the system comprising:
a. A subsea riser;
b. A blowout preventer stack comprising:
i. A pressure containment cavity for passing tubulars through the blowout preventer stack, wherein the pressure containment cavity is in mechanical association and in fluid communication with the subsea riser, whereby tubulars can be passed to and from the subsea riser into the pressure containment cavity for the purpose of advancing a borehole;
ii. A laser delivery assembly;
iii. A shear ram assembly, wherein the laser delivery assembly is optically and mechanically associated with the shear ram assembly;
c. Whereby, upon activation the laser delivery assembly delivers a high power laser beam to a tubular within the pressure containment cavity resulting in cutting the tubular to reduce the risk that the tubular would prevent the closing of the shear ram assembly, wherein the high power laser beam has at least about 1 kW of power.

34. The laser assisted subsea blowout preventer drilling system of claim 33, wherein the high power laser beam forms a laser delivery pattern to sever the tubular in the blowout preventer cavity.

35. The laser assisted subsea blowout preventer drilling system of claim 33, wherein the high power laser beam forms a laser delivery pattern to weaken the tubular in the pressure containment cavity.

36. The laser assisted subsea blowout preventer drilling system of claim 33, wherein the high power laser beam forms a laser delivery pattern to remove a first and a second area of the tubular, wherein the first and second areas are discrete.

37. A laser assisted subsea blowout preventer drilling system, the system comprising:
a. A subsea riser;
b. A blowout preventer stack, comprising;
i. A blowout preventer cavity for passing tubulars therethrough, wherein the blowout preventer cavity is in fluid communication and mechanical association with the subsea riser, wherein tubulars can be passed from the subsea riser into the blowout preventer cavity and drilling fluids can be passed from the blowout preventer cavity to the subsea riser,
ii. A laser delivery assembly;
iii. A shear ram assembly having an opposed pair of shear rams, wherein the laser delivery assembly is optically and mechanically associated with at least one of the opposed pair of shear rams, whereby upon activation the laser delivery assembly delivers a high power laser beam to a tubular within the blowout preventer cavity resulting in the cutting of the tubular to assist the closing of the shear ram assembly, wherein the high power laser beam has at least about 1 kW of power.

38. The laser assisted subsea blowout preventer drilling system of claim 37, comprising a laser delivery pattern configured to sever the tubular in the blowout preventer cavity.

39. The laser assisted subsea blowout preventer drilling system of claim 37, comprising a laser delivery pattern configured to weaken the tubular in the blowout preventer cavity.

40. The laser assisted subsea blowout preventer drilling system of claim 37, comprising a laser delivery pattern configured to remove a first and a second area of the tubular, wherein the first and second areas are discrete.

41. A laser assisted subsea blowout preventer drilling system, the system comprising:
a. A subsea riser;
b. A blowout preventer stack;
c. The blowout preventer stack comprising:
a. A blowout preventer stack cavity for passing tubulars therethrough, wherein the blowout preventer stack cavity is in fluid communication with the subsea riser;
b. A laser delivery assembly for providing a high power laser beam, wherein the high power laser beam has at least about 1 kW of power; and,
c. A shear ram assembly having an opposed pair of shear rams, wherein the laser delivery assembly is mechanically associated with the shear ram assembly.

42. The subsea blowout preventer of claim 41, comprising a shield to protect the laser delivery assembly from drilling fluids.

43. A laser shear ram assembly comprising:
a. A body;
b. The body defining a pressure containment cavity that has a vertical axis, whereby the pressure containment cavity is capable of receiving a tubular for advancing or removing the tubular from a borehole;
c. A first shear ram having a first piston assembly, whereby the first piston assembly is capable of moving the first shear ram into the pressure containment cavity of the body upon activation of the first piston assembly;
d. A second shear ram having a second piston assembly, whereby the second piston assembly is capable of moving the second shear ram into the pressure containment cavity of the body upon activation of the second piston assembly; and,
e. A laser delivery assembly, whereby when activated the laser delivery assembly is capable of propagating a high power laser beam into the pressure containment cavity, wherein the high power laser beam has at least about 1 kW of power.

44. The laser shear ram assembly of claim 43, wherein the laser delivery assembly comprises a means for delivering a predetermined laser beam pattern to the tubular.

45. The laser shear ram assembly of claim 44, wherein the predetermined laser beam delivery pattern comprises two areas of removal of the tubular.

46. The laser shear ram assembly of claim 44, wherein the predetermined laser beam delivery pattern comprises a plurality of parallel areas of removal of the tubular.

47. An offshore drilling rig having a laser assisted subsea blowout preventer system for the rapid cutting of tubulars in the blowout preventer during emergency situations, the laser system comprising:

a. A riser capable of being lowered from and operably connected to an offshore drilling rig to a depth at or near a seafloor;

b. A blowout preventer capable of being operably connected to the riser and lowered by the riser from the offshore drilling rig to the seafloor;

c. A high power laser in optical communication with a laser cutter; and, d. The laser cutter operably associated with the blowout preventer and riser, whereby the laser cutter is capable of being lowered to at or near the seafloor and upon activation delivering a high power laser beam to a tubular that is within the blowout preventer, wherein the high power laser beam has at least about 1 kW of power.

48. An offshore drilling rig having a laser assisted subsea blowout preventer system for the rapid cutting of tubulars in the blowout preventer during emergency situations, the laser system comprising:

a. A riser positioned at a depth at or near a seafloor, wherein the riser is operably connected to an offshore drilling rig;

b. A blowout preventer positioned at or near the seafloor, wherein the blowout preventer is operably connected to the riser;

c. A high power laser in optical communication with a laser cutter; and, d. The laser cutter operably associated with the blowout preventer and riser and positioned at or near the seafloor, whereby upon activation the laser cutter delivers a high power laser beam to a tubular that is within the blowout preventer, wherein the high power laser beam has at least about 1 kW of power.

49. An offshore drilling rig having a laser assisted subsea blowout drilling system, the system comprising:

a. A riser capable of being lowered from and operably connected to an offshore drilling rig to a depth at or near a seafloor;

b. A blowout preventer capable of being operably connected to the riser and lowered by the riser from the offshore drilling rig to the seafloor;

c. The blowout preventer comprising a shear ram capable of mechanically interacting with an area of a tubular that is within the blowout preventer;

d. The shear ram being operably associated with a laser cutter;

e. A high power laser in optical communication with the laser cutter; and, f. The laser cutter operably associated with the blowout preventer and riser, whereby the laser cutter is capable of being lowered to at or near the seafloor and upon activation delivering a high power laser beam to the tubular that is within the blowout preventer and to an area on the tubular that is at or near the area of mechanical interaction with the shear ram, wherein the high power laser beam has at least about 1 kW of power.

50. A deep water offshore drilling rig capable of drilling in over 5000 feet of water, having a laser delivery assembly operably associated with a blowout preventer and a riser for the rapid cutting of tubulars in the blowout preventer, the offshore drilling rig comprising:

a. a means for hoisting tubulars and advancing a borehole and, a high power laser having at least 20 kW of power;

b. at least 5000 feet of riser sections, capable of being connected together and lowered to a depth at or near a seafloor;

c. a blowout preventer capable of being operably connected to the riser and lowered to the seafloor;

d. the high power laser in optical communication with a laser cutter;

e. the laser cutter mechanically associated and optically associated with the blowout preventer, whereby the laser cutter is capable of being lowered to at or near the seafloor and upon activation delivering a high power laser beam to a tubular that is within the blowout preventer and to an area on the tubular that is intended to be cut.

51. The drilling rig of claim 50, wherein the means for hoisting tubulars and advancing a borehole comprises a derrick, a drawworks and a top drive.

52. A subsea blowout preventer stack comprising:

A ram and a laser cutter positioned within the blowout preventer stack;

The laser cutter having a means to deliver a predetermined high power laser beam cutting pattern, with a high power laser beam having at least about 1 kW of power;

Whereby the predetermined laser beam cutting pattern corresponds to an area of a tubular to be removed within the blowout preventer stack.

53. A subsea blowout preventer stack comprising:

a. A ram movable from a first position to a second position; and, b. A high power directed energy means for providing energy greater than about 1 kW and for cutting positioned relative to the ram for cutting positioned relative to the ram and facing a pressure containment cavity formed within the stack, wherein the high power directed energy means for providing energy greater than about 1 kW and for cutting defines a directed energy path that enters into the pressure containment cavity and the second position is located within the pressure containment cavity.

54. A subsea blowout preventer comprising:

a. A high power directed energy means for providing energy greater than about 1 kW and for cutting;

b. A ram preventer comprising a ram;

c. A pressure containment cavity within the blowout preventer for passing tubulars therethrough;

d. The high power directed energy means for providing energy greater than about 1 kW and for cutting defining a directed energy path;

e. The ram capable of movement into the pressure containment cavity;

f. An area within the pressure containment cavity for engagement of the ram with a tubular; and, g. The directed energy path directed toward the area within the pressure containment cavity.

55. A method drilling subsea wells by using a laser assisted blowout preventer and riser, the method comprising:

a. Lowering a laser assisted blowout preventer having a first inner cavity from an offshore drilling rig to a seafloor using a riser having a second inner cavity, the seafloor having a borehole;

b. Securing the laser assisted blowout preventer to the borehole, whereby the borehole, the first inner cavity and the second inner cavity are in fluid and mechanical communication; and, c. Advancing the borehole by lowering tubulars from the offshore drilling rig down through the second inner cavity, the first inner cavity and into the borehole;

d. Wherein, the laser assisted blowout preventer has the capability to perform high power laser cutting with a high power laser beam having at least about 1 kW of power, of a tubular present in the first inner cavity.

56. The method of claim 55, wherein the laser assisted blowout preventer comprises:

a. a frame;

b. a blowout preventer stack mechanically associated with the frame;

c. the blowout preventer stack comprising a third cavity for passing tubulars therethrough, which third cavity is at least a part the first cavity; and, d. the blowout preventer stack comprising a laser delivery assembly, wherein the laser delivery assembly is positioned outside of the first and third cavities when not activated.

57. The method of claim 56, wherein the laser delivery assembly comprises:

a. a laser cutter having a beam path;

b. the laser cutter operationally associated with a shear ram; and c. the beam path directed into the cavity.

58. The method of claim 55, wherein the laser assisted blowout preventer comprises:

a. an annular preventer;

b. a pipe ram assembly; and, c. a laser shear ram assembly.

* * * * *